US005160098A

United States Patent [19]

Durkos

[11] Patent Number: 5,160,098

[45] Date of Patent: Nov. 3, 1992

[54] TENSION CONTROL SYSTEM AND METHOD

[76] Inventor: Larry G. Durkos, 95 S., 400 West, Lebanon, Ind. 46052

[21] Appl. No.: 616,885

[22] Filed: Nov. 21, 1990

[51] Int. Cl.[5] ..... B65H 23/185; B65H 23/198; B65H 77/00

[52] U.S. Cl. ..... 242/75.510; 242/45

[58] Field of Search ..... 242/75.51, 75.52, 45, 242/75.53, 75, 75.5; 226/195

[56] References Cited

U.S. PATENT DOCUMENTS

| | | | |
|---|---|---|---|
| 3,746,273 | 7/1973 | Elsworth | 242/75.51 |
| 4,159,808 | 7/1979 | Meihofer | 242/75.51 |
| 4,527,751 | 7/1985 | Grosz et al. | 242/75.51 |
| 4,566,646 | 1/1986 | Benjamin | 242/75.51 |
| 4,627,583 | 12/1986 | Huemer | 242/75.51 |
| 4,775,086 | 10/1988 | Kataoka | 242/75.51 |
| 4,777,413 | 10/1988 | Yoshimura et al. | 242/75.51 |
| 4,788,558 | 11/1988 | Caldwell et al. | 242/75.51 |
| 4,896,808 | 1/1990 | Bolza-Schunemann | 242/75.51 |
| 4,966,333 | 10/1990 | Bosch | 242/75.51 |

*Primary Examiner*—Daniel P. Stodola

*Assistant Examiner*—John Q. Nguyen

*Attorney, Agent, or Firm*—Barnes & Thornburg

[57] ABSTRACT

A tension control system for maintaining a substantially constant predetermined tension on material being unwound from or wound onto a roll of material. The control system includes a shaft for holding the roll of material and a motor coupled to the shaft for rotating the shaft at a predetermined speed to maintain the material at a substantially constant predetermined tension. The motor is mounted in a predetermined initial position and remains there when the material is at the predetermined tension. The shaft and motor are mounted to permit limited rotational movement of the motor relative to the frame in response to the tension on the material deviating from the predetermined tension. The system includes a displacement detector for detecting movement of the motor away from its initial preset position in response to the tension deviating from the predetermined tension. The system adjusts the speed at which the motor rotates the shaft by an amount based upon the displacement of the motor relative to its initial position to maintain the tension of the material at substantially the predetermined tension.

26 Claims, 4 Drawing Sheets

KEY PAD
86
LCD
84
MICRO - CONTROLLER BOARD
80
INTERFACE BOARD
82
INTERRUPT INPUT
COSINE DAC
110
SINE DAC
106
DAC
94
VCO
104
A/D CONVERTER
90
POWER DRIVER
108
STEPPER MOTOR
44
MECHANICAL UNIT
VERROR
102
98
100
96
92
64
-V
88
74
LVDT
62
ULTRASONIC SENSOR
70
66
14

TENSION CONTROL SYSTEM AND METHOD

BACKGROUND AND SUMMARY OF THE INVENTION

This invention relates to a system and method for maintaining a substantially constant tension on a material being unwound from or wound onto a roll of material. Specifically, the present invention relates to a control system which constantly updates or adjusts the speed of rotation of a shaft on which the roll of material is mounted to maintain substantially constant predetermined tension on the material.

In many situations, it is important that material being processed or handled remain at a substantially constant tension to avoid stretching or damaging the material. One such situation in which maintaining material at a substantially constant tension is critical is during the processing or manufacture of filtering material used to make filters for filtering various types of fluids. One illustrative example of such filters are filters used for filtering etchant solutions used to make integrated circuits.

The etchant solutions used in integrated circuit fabrication are filtered to remove impurities or contaminants from the etchant solutions. Any impurities or contaminants which remain in the etchant solutions after filtering can cause the integrated circuit to be flawed. Therefore, the filters used to filter the etchant solutions are vitally important to the success of manufacturing the integrated circuits, especially as the size of the line widths on the integrated circuits decrease. Impurities or contaminants in the etchant solutions can block lines on an integrated circuit chip, thereby causing the chip to be flawed.

Delicate materials are used to make filters such as the filters used for filtering etchant solutions. The filters are designed to have a predetermined pore size to remove impurities and contaminants larger than the predetermined pore size from the etchant solutions passing through the filters. The material for making the filters is typically a fine nylon or teflon mesh material. Prior to manufacturing the filters, a film material is pressed onto the nylon or teflon mesh to provide a backing on the mesh. Illustratively, the film material is a mylar film.

During processing, filter materials are wound and unwound from rolls of material at relatively low speeds. It is necessary to keep the tension of the material substantially constant while winding and unwinding the material on these rolls. If the tension on the material rises above a predetermined level the pore size of the filter material can be stretched. By stretching the material, the pore size of the filter material is increased. The stretched filter material permits contaminants or impurities to remain in the etchant solution that would otherwise be removed by unstretched filter material. Therefore, when handling the material, the material must be maintained at a substantially constant predetermined tension while being wound onto or unwound from the roll of material to prevent stretching of the material.

It is known to provide a "dancing arm" system for maintaining the tension of a material being unwound from or wound onto a roll substantially constant. The dancing arm system uses a roller which contacts the material at a location spaced apart from main roll of material. The roller is forced against the material with a force related to the desired predetermined tension. The weight of the roller causes problems as the desired tension on the material decreases. The present invention provides several advantages over the dancing arm system. The present system is more compact than the dancing arm system. The present invention is also able to measure and maintain smaller tensions on the material more accurately than the dancing arm system. In addition, the present system is a non-invasive system which does not contact the material. This is an important advantage over the dancing arm system, especially when handling delicate materials which could be damaged by the roller of the dancing arm system.

One object of the present invention is to provide a device for winding or unwinding a roll of material which is capable of maintaining the tension of the material being wound onto or unwound from the roll of material at a substantially constant tension.

According to the present invention, a control system is provided for maintaining a substantially constant predetermined tension on material being unwound from or wound onto a roll of material. The control system includes a frame, a shaft for holding the roll of material, and a motor coupled to the shaft for rotating the shaft at a predetermined speed to maintain the material at a substantially constant predetermined tension. The control system also includes means for rotatably coupling the shaft and the motor to the frame to position the motor in an initial preset position relative to the frame. The coupling means permits limited rotational movement of the motor relative to the frame in response to the tension on the material deviating from the predetermined tension. The control system further includes means for detecting displacement of the motor relative to the frame away from its initial preset position. The control system still further includes means for adjusting the speed at which the motor rotates the shaft by an amount based upon the displacement of the motor relative to its initial position to maintain the tension of the material at substantially the predetermined tension. The adjusting means is coupled between the detecting means and the motor.

In the illustrated embodiment, the coupling means includes bearing means for permitting rotation of the shaft relative to the frame and movement resisting means coupled to the motor for resisting movement of the motor relative to the frame. The movement resisting means has a predetermined resistance related to the predetermined tension so that the motor moves relative to the frame only when the tension on the material deviates from the predetermined tension. Illustratively, the movement resisting means includes at least one spring member having a predetermined spring constant coupled between the frame and the motor.

The illustrated embodiment also includes means for measuring the radius of the roll of material, and means for coupling the measuring means to the adjusting means so that the speed at which the motor rotates the shaft is also adjusted based upon the radius of the roll of material. Illustratively, the measuring means includes an ultrasonic sensor for measuring the radius of the roll of material. The ultrasonic sensor has an output coupled to the adjusting means.

The illustrated embodiment further includes means for damping movement of the motor relative to the frame to limit the rate of movement of the motor. Illustratively, the damping means includes a piston and cylinder assembly coupled between the motor and frame for limiting the rate of movement of the motor relative to the frame. Also illustratively, the means for detecting displacement of the motor includes a differential transformer coupled to the motor. The differential transformer has an output coupled to the adjusting means.

According to another aspect of the present invention, a method is provided for maintaining a substantially constant predetermined tension on material being unwound from or wound onto a roll of material mounted onto a shaft which is driven by a motor. The method includes the steps of establishing a predetermined initial position of the motor when the material is at the predetermined tension, determining the displacement of the motor away from its initial position upon deviation of the tension on the material away from the predetermined tension, and adjusting the speed at which the motor rotates the shaft by an amount based upon the displacement of the motor relative to its initial position to maintain the tension of the material at substantially the predetermined tension.

The method also includes the steps of determining the radius of the roll of material and changing the speed of rotation of the shaft based upon the radius of the roll of material to maintain the tension on the material at substantially the Predetermined tension.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
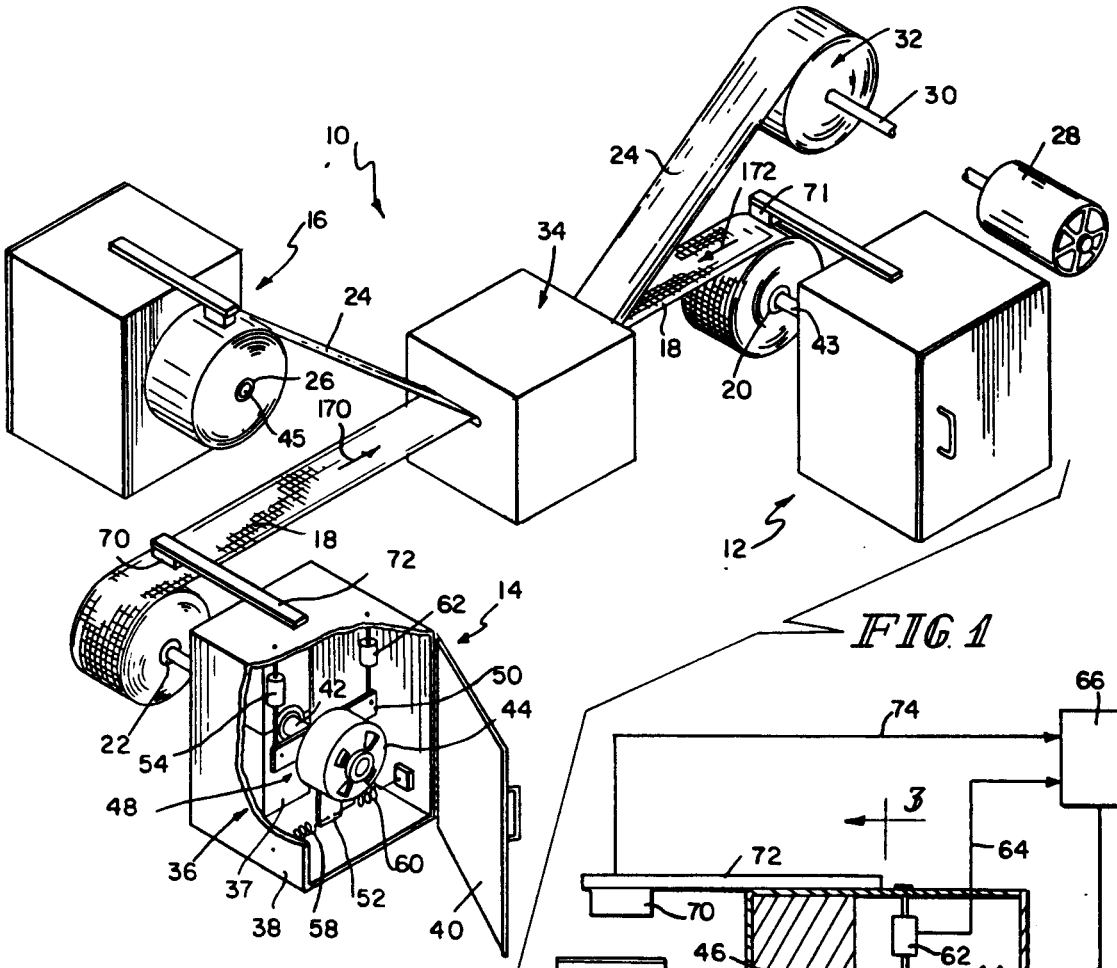
FIG. 1 is a perspective view with portions broken away illustrating a processing system for a filtering material in which three of the tension control systems of the present invention are used to maintain the tension of the material substantially constant.

Referring now to the drawings, FIG. 1 illustrates a processing system 10 for processing a material 18. Illustratively, material 18 is a filtering material used in the electronics industry to filter etchant solutions. Three tension control systems 12, 14, and 16 constructed according to the present invention are used in the processing system 10. Tension control system 12 is used to wind material 18 onto a roll 20. Tension control system 14 is used to unwind the material 18 from roll 22. Tension control system 16 is used to unwind a material 24 from a roll 26. Material 18 is illustratively a nylon or teflon mesh material used for filtering and material 24 is illustratively a mylar or nylon film. A drive motor 28 rotates a shaft 30 at a predetermined speed to wind the material 24 onto a roll 32. The material 18 and the material 24 are pressed together or processed and then separated in processing station 34 to produce a filtering material 18 having a mylar backing thereon.

It is critical to maintain the tension of the material 18 at a substantially constant predetermined tension when winding or unwinding the material 18. If the tension on material 18 exceeds the predetermined tension, the material 18 can be stretched which causes the pore size of the material 18 to increase. By increasing the pore size, the filtering characteristics of the material 18 are reduced. In other words, if the pore size of material 18 increases, filters made from the material 18 will permit larger size impurities or contaminant particles to remain in the solution passing through the filters. As discussed above, the filtering characteristics are critical when manufacturing filters for filtering etchant solutions. If impurities or contaminants remain in the etchant solutions, integrated circuits made with the etchant solution can be flawed. Advantageously, the tension control systems 12, 14, and 16 maintain the tension of the material 18 and 24 at a substantially constant predetermined tension to prevent stretching of the material.

It is understood that the present invention is not intended to be limited to a system for handling filter material 18. Any type of material that must be maintained at a substantially constant tension can be handled by the present system. Other materials which could be unwound from or wound onto rolls or spools by the tension control system of the present invention include, for example, fiber optic strands or fiber bundles or elongated tubes in which the diameter must remain constant.

Figure 2:
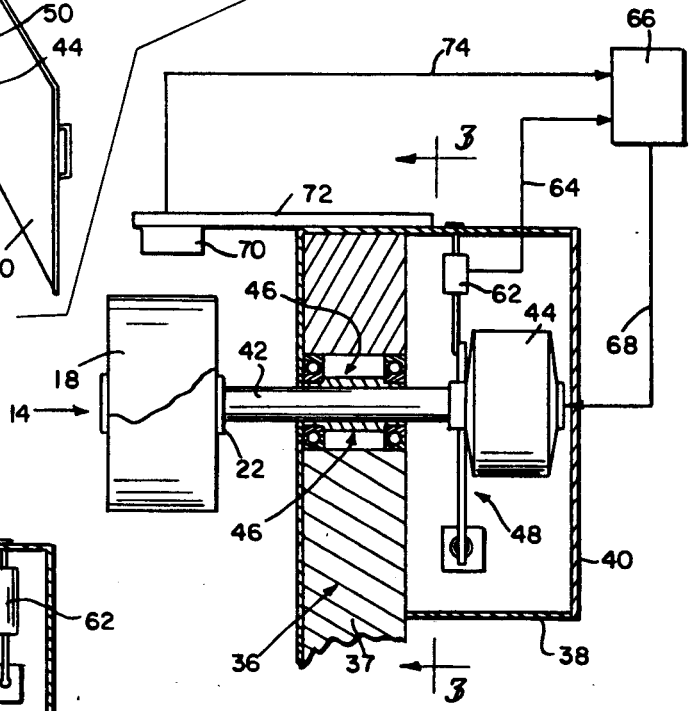
FIG. 2 is a transverse sectional view taken through one of the tension control systems illustrated in FIG. 1 with portions broken away.
Figure 3:
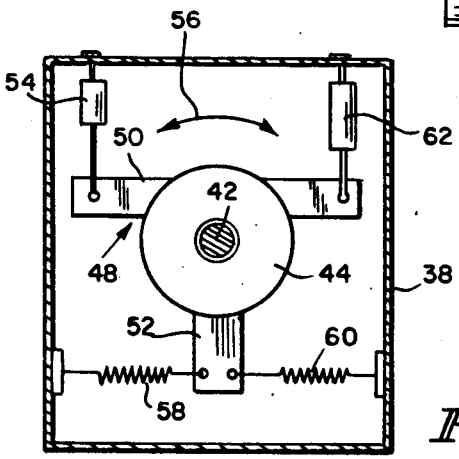
FIG. 3 is a sectional view taken across lines 3—3 of FIG. 2.

Tension control system 14 is illustrated in further detail in FIGS. 2 and 3. Tension control systems 12 and 16 have identical components which operate in an identical manner to the components in tension control system 14. System 14 includes a frame assembly 36 which includes a support beam 37, a cabinet 38, and an access door 40. System 14 also includes a shaft 42 for holding the roll 22 of material 18 thereon. A motor 44 is coupled to the shaft 42 for rotating the shaft 42 at a predetermined speed to unwind the material 18 from roll 20. Motor 44 is illustratively a MJ112FD12 stepper motor available from Superior Electric. Shaft 42 is coupled to frame 36 by bearing means 46 which permits rotation of shaft 42 relative to frame 36.

A T-shaped mounting plate 48 including a horizontal portion 50 and a vertical portion 52 is rigidly fixed to motor 44. A piston and cylinder arrangement or damper 54 is connected between one side of horizontal portion 50 of mounting plate 48 and the cabinet 38 of frame 36. Damper 54 limits the rate of movement of motor 44 relative to frame 36. Damper 54 is illustratively a F444A4 damper available from Airpot Corporation.

The system 14 includes a first extension spring 58 coupled between the vertical member 52 of mounting plate 48 and the frame 36. System 14 also includes a second extension spring 60 coupled between the vertical member 52 of plate 48. Extension springs 58 and 60 have a predetermined spring constant which is related to the predetermined tension that is desired for material 18. Springs 58 and 60 set a range of tensions at which the system 14 can operate. If the desired tension setting is outside the range set by springs 58 and 60, new springs having different spring constants must be added in place of springs 58 and 60.

Extension springs 58 and 60 set a predetermined initial position for the motor 44 relative to frame 36. When the tension on the material 18 exceeds the predetermined tension, the force on the material acts against the force of one of the springs 58 or 60 to move motor 44 relative to frame 36. In other words, if material 18 is being unwound faster from the roll 22 by a winder 12 than the speed of rotation of shaft 42 can keep up with, the force on material 18 will cause motor 44 to rotate relative to frame 36 as illustrated by double-headed arrow 56 in FIG. 3.

System 14 detects the movement of motor 44 and adjusts the speed of the motor 44 to correct the tension on material 18 in a manner to be discussed later. Once the rotational speed of shaft 42 is adjusted to reduce the excess tension on material 18, springs 58 and 60 move motor 44 back to its initial preset position illustrated in FIG. 3.

A differential transducer displacement detector 62 is coupled between the horizontal member 50 of plate 48 and cabinet 38 of frame 36. Displacement detector 62 measures the displacement of motor 44 relative to frame 36 away from its initial preset position. Displacement detector 62 is illustratively a DCT2000C linear variable differential transducer (LVDT) available from RDT-Electrosense Incorporated. Displacement detector 62 generates an output voltage related to the torque at the location of the detector 62 caused by movement of the motor 44 away from its initial preset position. The output voltage from displacement detector 62 changes in different directions away from an initial voltage depending on which way the tension on the material deviates from the preset tension. As illustrated in FIG. 2, an output 64 from displacement detector 62 is connected to an input of a processor 66. Processor 66 generates an output signal to drive the motor 44 for rotating shaft 42 at the predetermined speed. Processor 66 is coupled to motor 44 by line 68.

An ultrasonic sensor 70 is situated over the roll of material 18 for measuring the radius of the roll of material 18. Sensor 70 is coupled to frame 36 by a connecting bar 72. An output from sensor 70 representing the radius of the roll of material is coupled to a second input of processor 66. Processor 66 adjusts the control signal to change the speed of rotation of shaft 42 based upon the radius of the roll of material 18. Shaft 42 must rotate faster to dispense material 18 from roll 20 at the same speed as the radius of the roll of material 18 decreases. Ultrasonic sensor 70 is illustratively a PCUA30M30AZ ultrasonic sensor available from Electro Products Incorporated.

Figure 4:
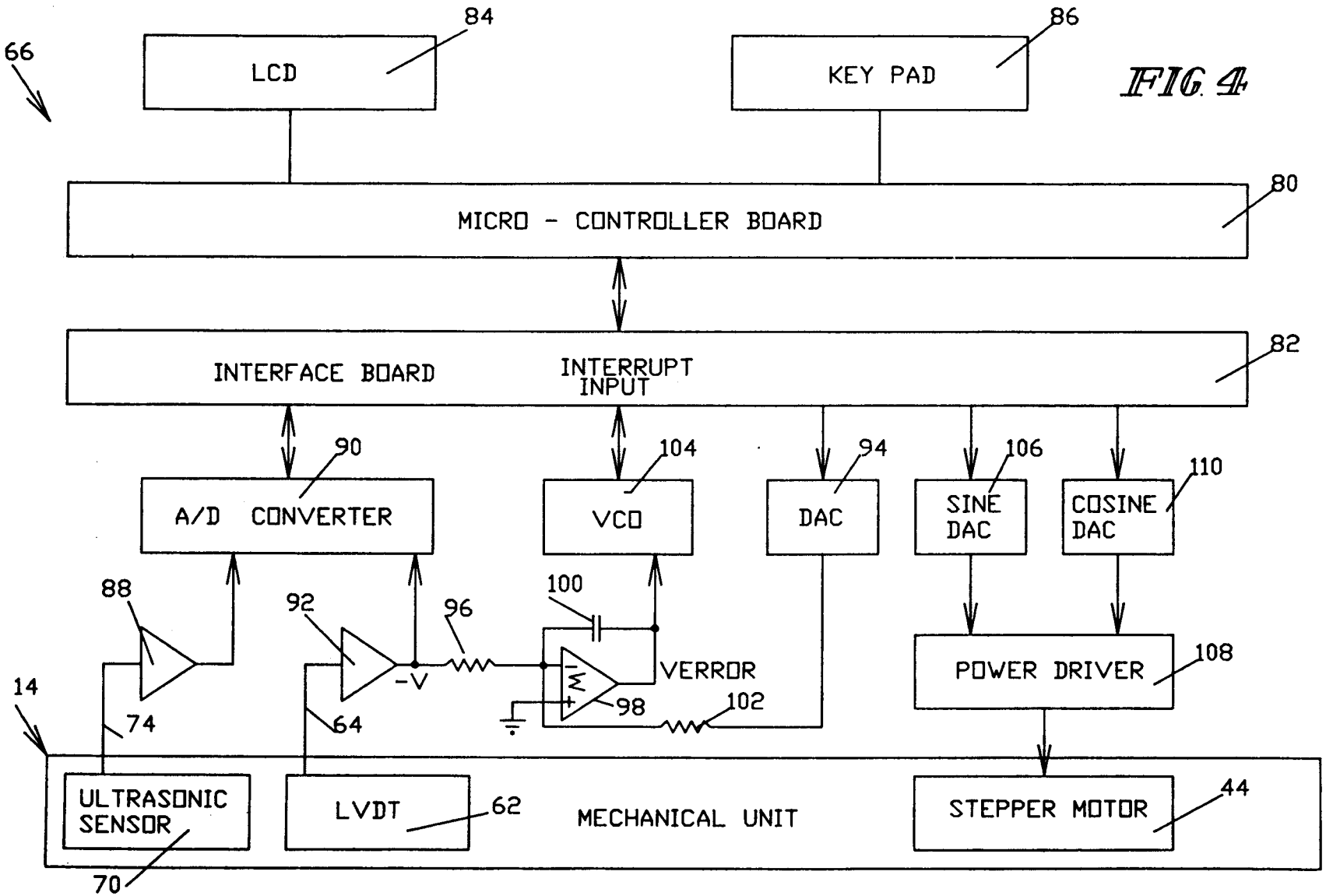
FIG. 4 is a partly schematic and partly block diagram illustrating the tension control system of the present invention.

Processor 66 is illustrated in more detail in FIG. 4. Processor 66 includes a micro-controller board 80. Micro-controller board 80 illustratively includes includes an 80C32 micro-processor available from Signetics Corporation, random access memory, two serial Ports, a LCD port, a keypad port, and an expansion port. An interface board 82 is used as a buffer for micro-controller board 80. LCD 84 is connected to the LCD port of micro-controller board 80 to provide a visual display for an operator of system 14. A keypad 86 is coupled to the keypad port of micro-controller board 80. LCD 84 provides information and instructions to an operator of the tension control system 14. Keypad 86 permits the operator to enter information into the system.

Ultrasonic sensor 70 is connected by line 74 through an amplifier 88 to an analog-to-digital converter 90. Converter 90 is illustratively a 12-bit A/D converter having four channels and two ports. Converter 90 is connected to interface board 82.

Displacement detector 62 is connected by line 64 through amplifier 92 to analog-to-digital converter 90. The displacement detector is illustrated as LVDT 62 in FIGS. 4–5. The output from amplifier 92 is a voltage (−V) which represents the torque or the displacement of the motor 44 at any given time. The output voltage from amplifier 92 is compared to a voltage output (+V) from a digital-to-analog converter or DAC 94. The output from DAC 94 is a voltage representing a programmed preset desired tension of the material. As discussed below, the output voltage from DAC 94 constantly changes based upon the output of sensor 70. Further discussion of how this voltage level (+V) from DAC 94 is calculated is given below.

Amplifier 92 is coupled through resistor 96 to the negative input of amplifier 98. The positive input of amplifier 98 is coupled to ground. The output of amplifier 98 is coupled to the negative input of amplifier 98 through capacitor 100. The output of DAC 94 is coupled through resistor 102 to the negative input of amplifier 98. Amplifier 98 is an integrating comparator which compares the output voltage (−V) from amplifier 92 to the output voltage (+V) from DAC 94 and generates an error voltage signal (V-error) representing the difference between the programmed tension and the actual tension of material 18. The output from amplifier 98 is coupled to an input of voltage controlled oscillator or VCO 104. The output from VCO 104 is coupled to an interrupt input of interface board 82. VCO 104 generates a clock signal which has a pulse rate such that motor 44 will rotate the shaft 42 at the correct rate to maintain the material 18 at substantially the predetermined tension.

Interface board 82 is coupled to a sine digital-to-analog converter 106. Converter 106 is coupled to one input of power driver 108. Power driver 108 is used to power motor 44 which rotates shaft 42. Interface board 82 is also coupled to cosine digital-to-analog converter 110. Converter 110 is coupled to a second input of power driver 108. The interrupt signals from VCO 104 cause a software routine to pick up the next point on a sine curve table and the next point on a cosine curve table. The sine and cosine tables are stored in the memory of micro-controller 80. These sine and cosine values are output to the sine DAC 106 and cosine DAC 110, respectfully. The sine/cosine driver arrangement causes stepper motor 44 to run smoothly.

Figure 5:
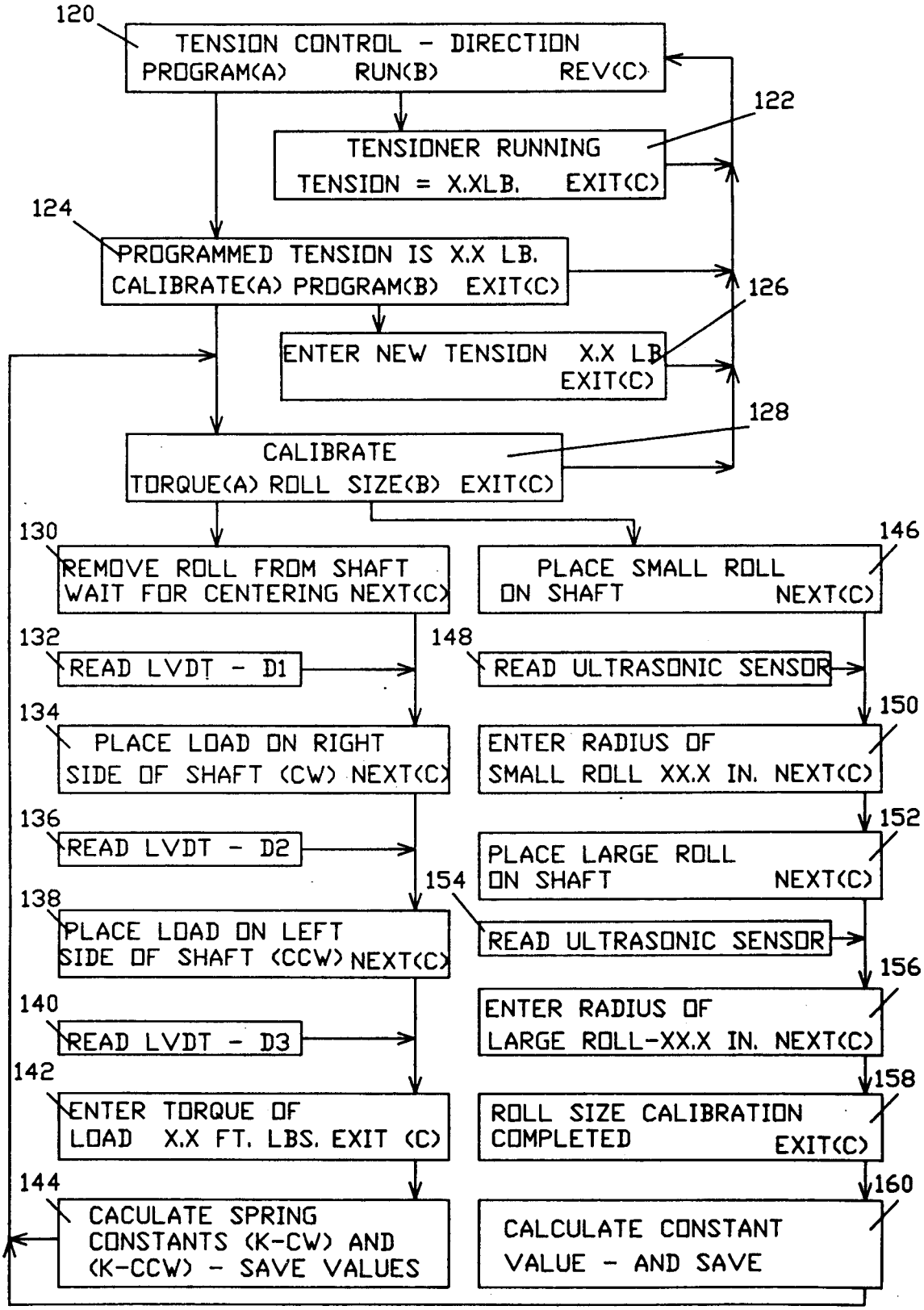
FIG. 5 is a flow chart of the steps performed by the tension control system of the present invention.

The flow chart for the computer program of the present invention is illustrated in FIG. 5. The flow chart illustrates the steps for operating, programming, and calibrating the tension control system 14 of the present invention. The computer program is used to generate the output voltage (+V) from DAC 94 which represents the desired programmed tension of the material. The main menu is illustrated by block 120. The LCD 84 prints out the direction which the shaft 42 is programmed to rotate, either clockwise or counter clockwise. Three selections are available from the main menu 120. A first selection is to program a new tension into the system 14. A second selection is to run the tension control system 14. A third selection is to reverse the direction of rotation of the shaft 42.

If the second selection is made to run the system 14 by entering a "B" on the keypad 86, LCD 84 indicates that the tensioner is running and also displays the tension of the material so that an operator can monitor the tension by simply looking at the visual display on the LCD 84. The RUN mode is illustrated by block 122 of the flow chart. By typing "C" on keypad 86, an operator can exit the RUN mode 122 and return to the main menu 120.

If the PROGRAM selection is made from main menu 120 by entering an "A" on keypad 86, LCD 84 displays the programmed tension of the material 18 as indicated by block 124. The operator again has three selections for proceeding. An operator can either calibrate the system, enter a new programmed tension, or exit to return to the main menu 120. If it is desired to change the predetermined tension, an operator enters a "B" on the keypad 86. LCD 84 then instructs the operator to enter a new preset tension for material 18, which the operator enters into the system 14 on keypad 86. This step is illustrated by block 126. After the new preset tension is entered, the operator can exit block 126 by entering a "C" on the keypad 86. This returns to the main menu 120.

If it is desired to calibrate the system, an operator can select the CALIBRATE mode from block 124 by entering an "A" on keypad 86. The CALIBRATE mode is illustrated by block 128. The operator can decide whether to calibrate the torque, calibrate the roll size, or exit back to the main menu 120.

If it is desired to calibrate the torque an "A" is entered on keypad 86. LCD 84 provides instructions for calibrating the torque on shaft 42. The LCD 84 first instructs the operator to remove the roll 22 of material 18 from the shaft 42 and to wait for centering as illustrated in block 130. After the roll 22 of material 18 is removed from shaft 42, motor 44 can move or settle slightly. Extension springs 58 and 60 act to return motor 44 to its initial preset position. After the motor 44 has reached its preset initial position, an operator enters a "C" character on keypad 86. The system then automatically reads the output voltage (Dl) from displacement detector or LVDT 62 as illustrated by block 132. This provides a voltage reading for the LVDT 62 when motor 44 is in its preset initial position. In other words, this provides a "zero setting" for the LVDT 62 voltage output.

LCD 84 next instructs an operator to place a load on the right side of the shaft as illustrated by block 134. An operator places a known weight on a known lever arm to provide a force on the right shaft 42 side which is in a clockwise direction. By placing a known weight with a known lever arm onto shaft 42, a known torque is applied on shaft 42. After motor 44 settles, an operator enters a "C" character keypad 86 to move to the next step. The output voltage (D2) from LVDT 62 is automatically read by system 66 as illustrated by block 136. This provides a voltage reading for a known torque on shaft 42 in the clockwise direction.

LCD 84 then instructs the operator to place the known load on the left side of the shaft 42 which is in the counter clockwise direction as illustrated by block 138. The operator places the known load and lever arm on the shaft on the left side of shaft 42 to provide a known torque in the counter clock wise direction. After motor 44 has settled, the operator enters a "C" character on keypad 86 to move to the next step. A voltage (D3) from LVDT 62 is automatically read by system 66 as illustrated by block 140. This provides a known voltage reading for a known torque on shaft 42 in the counter clockwise direction.

LCD 84 then instructs the operator to enter the known torque of the load as illustrated by block 142. Operator then enters the known torque of the load and lever arm onto keypad 86. The known torque is entered as X.X ft.lbs. The operator then exits the torque calibration mode by entering a "C" character on keypad 86.

As discussed below, the system 14 calculates the torque constants K−CW and K−CCW for extension springs 58 and 60 and saves the values of these torque constants for use in producing the output voltage from DAC 94. This calculation step is illustrated by block 144. From block 144, the computer program returns to the calibrate block 128. An operator can then select to calibrate the roll size or can exit the calibrate block 128 and return to main menu 120.

The calculation for the torque constants K−CW and K−CCW are as follows:

$$K - CW = \frac{D2 - D1}{X \cdot X}$$

$$K - CCW = \frac{D3 - D1}{X \cdot X}$$

If the operator selects to calibrate the roll size by entering a "B" on keypad 86, LCD again instructs the operator on calibrating the roll size as indicated by block 146. LCD 84 first instructs the operator to place a small roll 20 on shaft 42 as illustrated by block 146. The operator then enters a "C" character on keypad 86. A reading is automatically taken from ultrasonic distance sensor 70 to measure the radius of the small roll 22 as illustrated by block 148. An operator then enters the radius of the small roll on keypad 86 as illustrated by block 150.

LCD 84 then instructs the operator to place the large roll of material 18 on shaft 42 as illustrated by block 152. After the large roll is placed on the shaft 42, the operator enters a "C" character on keypad 86 to move to the next step. Another reading is automatically taken from ultrasonic distance sensor 70 to measure the radius of the large roll of material 18 as illustrated by block 154. LCD 84 then instructs the operator to enter the radius of the large roll on keypad 86 as illustrated by block 156. After another "C" has been entered on keypad 86, LCD 84 indicates that the roll size calibration has been completed as illustrated by block 158. The operator then exits the roll size calibration mode by entering another "C" on keypad 86. The system then calculates the roll size constant value (C−roll) and saves this value for use in generating the control voltage from DAC 94. The calculation and storage step is illustrated by block 160. The computer program then returns to calibrate block 128. An operator can then exit calibrate block 128 and return to the main menu 120 by entering "C" on keypad 86.

Figure 6:
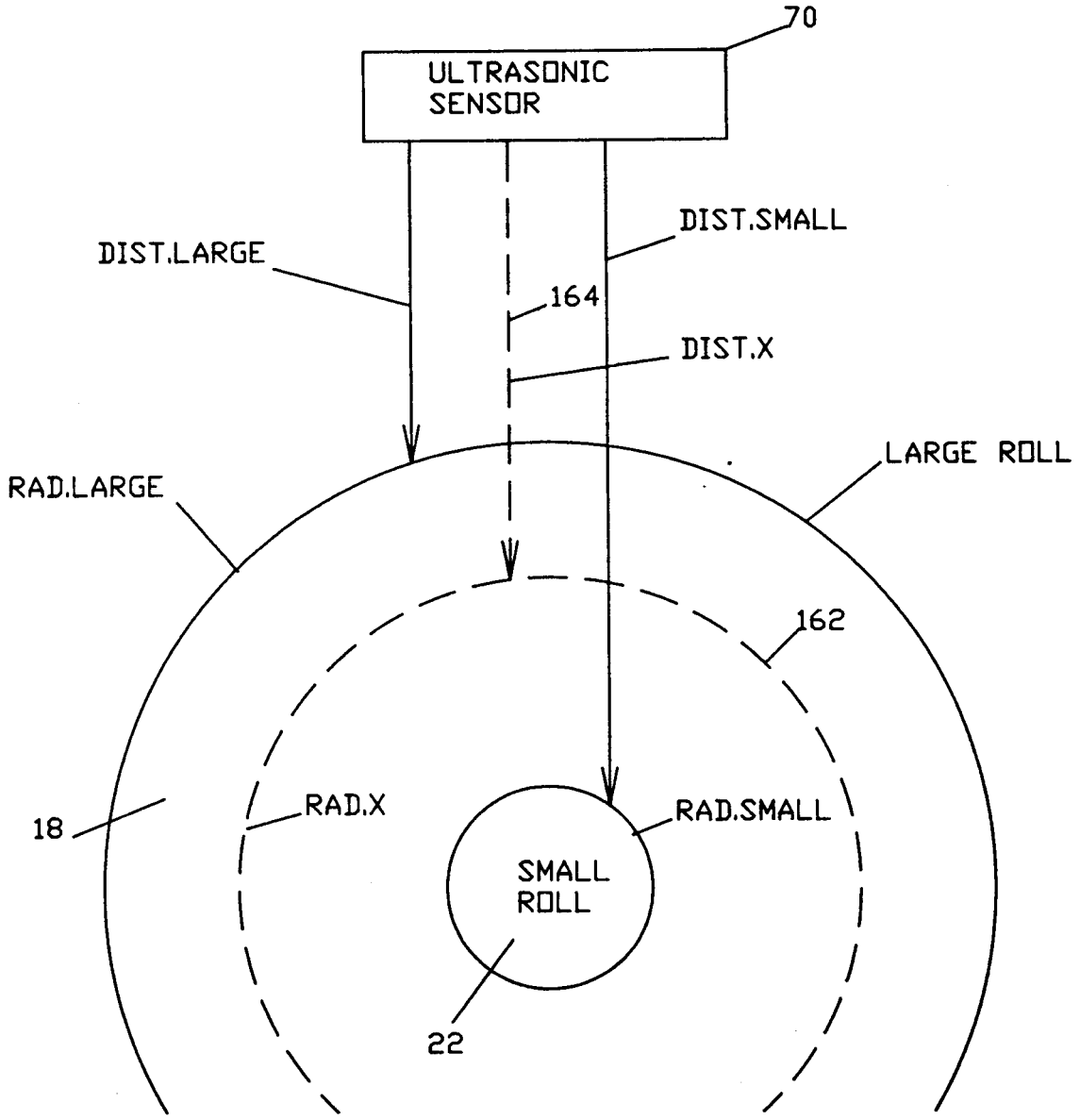
FIG. 6 is a diagrammatical illustration of the measurements made by the ultrasonic sensor.

FIG. 6 is a diagrammatical illustration of the distances measured by ultrasonic sensor 70. Sensor 70 measures the distance to the small roll 22 (DIST.-SMALL) which provides the radius of the small roll 22 (RAD.SMALL). Sensor 70 also measures the distance from sensor 70 to the large roll of material 18 (DIST-.LARGE) which provides the radius of the large roll of material 18 (RAD.LARGE). The radius of the roll of material 18 decreases as material is unwound from roll 22. The broken line 162 illustrates actual radius of the material 18 on the roll at any certain time during unwinding (RAD.X). The distance measured by sensor 70 to the radius of the material 18 (DIST.X) is illustrated by the broken line 164 from sensor 70.

The calculation for the roll size constant C−roll is as follows:

$$C - \text{roll} = \frac{(\text{RAD.LARGE}) - (\text{RAD.SMALL})}{(\text{DIST.SMALL}) - (\text{DIST.LARGE})}$$

The radius of the roll of material can constantly be calculated as the radius of the roll decreases when material is unwound from roll 22. As discussed above, this radius is indicated as RAD.X and is necessary to determine how fast the shaft 42 must rotate to maintain the substantially constant predetermined tension of the material 18.

When the distance to the roll of material 18 measured by sensor 70 (DIST.X) is a value between the distance measured by the ultrasonic sensor to the large roll (DIST.LARGE) and the distance measured by the ultrasonic-sensor 70 to the small roll (DIST.SMALL), then the calculation for RAD.X is as follows:

$$\text{RAD.X} = (\text{RAD.SMALL}) + ([(\text{DIST.SMALL}) - (\text{DIST.X})] \times \text{C-roll})$$

When the distance to the roll of material 18 measured by ultrasonic sensor 70 (DIST.X) is smaller than the distance measured to the large roll (DIST.LARGE), then the calculation for the RAD.X is as follows:

$$\text{RAD.X} = (\text{RAD.LARGE}) + ([(\text{DIST.LARGE}) - (\text{DIST.X})] \times \text{C-roll})$$

When the distance measured by ultrasonic sensor 70 to the roll of material 18 (DIST.X) is larger than the distance measured to the small roll (DIST.SMALL), then the calculation for RAD.X is as follows:

$$\text{RAD.X} = (\text{RAD.SMALL}) - ([(\text{DIST.X}) - (\text{DIST.SMALL})] \times \text{C-roll})$$

After the radius of the roll of material (RAD.X) is calculated, the system 14 generates the control voltage (+V) from DAC 94 using the following equation:

$$+V = \frac{(\text{Programmed Tension})(\text{RAD.}X)}{K - CW \text{ or } K - CCW}$$

Torque constant K−CW is used when the shaft 42 is rotating in the clockwise direction. Torque constant K−CCW is used when the shaft 42 is rotating in the counter clockwise direction.

A preferred embodiment of the computer program for performing the functions discussed above is attached to the present application as Appendix I.

After springs 58 and 60 have been selected and coupled between the vertical member 52 of mounting plate and frame 36 to set the predetermined tension range, an operator calibrates the torque constants and roll size constant for system 14 as discussed above. After system 14 is calibrated, the operator can program in a desired predetermined tension at which the material 18 is to be maintained while winding or unwinding the material from roll 22. After the predetermined tension is entered, the system is ready for operation. In operation, an operator sets the direction that the shaft will rotate. Tension control system 12 shown in FIG. 1 is used to wind material 18 onto roll 20. Tension control system 14 is used to unwind the material from roll 22. Therefore, a force is applied on material 18 in the direction of arrow 170 as it is unwound from roll 22. The force in the direction of arrow 170 is equal to the spring constant of spring 60 multiplied by the displacement of motor 44 relative to its initial position.

If the tension on material 18 exceeds the predetermined tension, motor 44 rotates in the clockwise direction as viewed in FIG. 1 relative to frame 36. The displacement or torque of motor 44 is measured by displacement detector 62. As discussed above, the output of displacement detector 62 is compared to a predetermined voltage value from DAC 94 representing the predetermined tension programmed into the system. If the output from displacement detector 62 deviates from the predetermined value output from DAC 94, then the speed of rotation of the shaft 42 is adjusted so that the tension on material 18 is maintained at substantially the predetermined tension. When the material returns to the substantially constant predetermined tension, motor 44 moves back to its initial position.

If slack develops in material 18 because winder 12 is taking up the material 18 slower than the unwinder 14 is unwinding the material 18, motor 44 will move slightly in the counter clockwise direction as viewed in FIG. 1 relative to frame 36. This deviation of motor 44 away from its initial position will cause the output from displacement detector 62 to change in the opposite direction away from the predetermined voltage than when the motor rotates in the clockwise direction. This causes an adjustment to motor 44 to slow down the speed of rotation of shaft 42 so that the tension on material 18 remains at the substantially constant predetermined tension even if the winder 12 slows down the speed that it winds the material 18 onto roll 20.

Tension control system 12 operates in a manner similar to tension control system 14. Tension control system 12 is set to wind material 18 onto roll 20 at a predetermined rate based upon the speed of shaft 43. The speed of rotation of shaft 43 decreases as the radius of the roll of material on roll 20 increases. The radius of material 18 on roll 20 is measured by ultrasonic sensor 71. If a force is applied to material 18 in the direction 172 so that the tension on material 18 rises above the predetermined tension level, the motor (not shown) of tension control system 12 rotates in a counter clockwise direction away from its initial position. This movement of the motor in system 12 is detected by a displacement detector (not shown) which adjusts the speed of rotation of the shaft 43 of system 12. By slowing down the speed of rotation of the shaft 43, the tension on the material 18 is maintained at a substantially predetermined tension constant.

Tension control system 16 is used to unwind material from roll 26. Shaft 45 of system 16 rotates in a direction opposite of shafts 42 and 43 of systems 14 and 12, respectively. Tension control system 16 operates in a manner similar to system 14.

Although the invention has been described in detail with reference to a certain illustrated embodiment, variations and modifications exist within the scope and spirit of the invention as described and defined in the following claims.

APPENDIX I

```
$ep (asm.err)
$DEBUG
$XR SB DB
$NOMOD51
;$NOLIST
NAME ALOG12
$TITLE(ALOG12.A51)
$NOGE
$INCLUDE(REG52.PDF)
;
CSEG    AT      1500H
;
PUBLIC  READ_CH1,READ_CH2,READ_CH3.READ_CH4,READ_ALL
ORG     1500H
READ_CH1:       RET
READ_CH2:       RET
READ_CH3:       RET
READ_CH4:       RET
READ_ALL:       RET
END
$ep (asm.err)
$DEBUG
$XR SB DB
$NOMOD51
;$NOLIST
NAME E2PROM
$TITLE(E2PROM.A51)
$NOGE
$INCLUDE(REG52.PDF)
;
;CSEG    AT      1200H
CSEG    AT 3000H
;
PUBLIC  E2_DPH,E2_DPL,E2PROM_INIT,READ_E2PROM,WRITE_E2PROM
;       THE FOLLOWING INITALIZES THE E2PROM
;
                E2PROM_TEST_LOCATION    EQU     81FFH
                E2PROM_TEST_VALUE       EQU     0A5H
;
;*****************************************************************
;       THE SYSTEM WILL EXECUTE E2PROM INITALIZATION INCLUDING
;       SETTING FACTORY DEFAULT VALUES ONLY IF LOCATION E2PROM_TEST_LOCATION
;       IS NOT ( 0A5 ).  IF 0A5 EXISTS THE SYSTEM BYPASSES E2PROM INIT
;       TOO LOCATION ( SYSTEM_READY )
;               THIS CODE WILL INITALIZE THE LCD
ORG             3000H
E2PROM_INIT:    MOV     DPTR,#E2PROM_TEST_LOCATION
                MOVX    A,@DPTR
                CJNE    A,#E2PROM_TEST_VALUE,CONT_INIT
                RET
;                LJMP    SYSTEM_READY
CONT_INIT:      MOV     DPTR,#E2PROM_TEST_LOCATION
                MOV     A,#E2PROM_TEST_VALUE
                MOVX    @DPTR,A
WAIT_FOR_INIT:  NOP
                NOP
                NOP
                NOP
                NOP
                NOP
                NOP
                MOV     A,#00H
                MOVX    A,@DPTR
                CJNE    A,#E2PROM_TEST_VALUE,WAIT_FOR_INIT
                RET
```

```
;
;*****************************************************************************
;THIS ROUTINE WILL READ THE E2PROM AT THE LOCATION E2_DPH
;E2_DPL AND  RETURN THE VALUE IN THE ACC
;
                E2_DPH          DATA    74H;5DH
                E2_DPL          DATA    75H;5EH
;
READ_E2PROM:    MOV     DPTR,#E2PROM_TEST_LOCATION
E2_LOOP:        MOVX    A,@DPTR
                CJNE    A,#E2PROM_TEST_VALUE,E2_LOOP
                MOV     DPH,E2_DPH
                MOV     DPL,E2_DPL
                MOVX    A,@DPTR
                RET
;
;
WRITE_E2PROM:   MOV     B,A
                MOV     DPH,E2_DPH
                MOV     DPL,E2_DPL
                MOVX    @DPTR,A
                MOVX    @DPTR,A
                MOVX    @DPTR,A
                MOVX    @DPTR,A
                NOP
                NOP
                NOP
                NOP
                NOP
                NOP
CONT_WRITE:     MOV     A,#00H
                MOVX    A,@DPTR
                CJNE    A,B,CONT_WRITE
                RET
;
;WRITE_E2PROM:
;This routine writes the value stored in the A register to the location
; in E2PROM that is pointed to by the values stored in E2_DPH and E2_DPL.
;
;;                          COUNT_OUT1      DATA        76H;6DH
;;                          COUNT_OUT2      DATA        77H;6EH
;                          IE_HOLDER       DATA        6FH
; If the EEPROM can't be read, it will time out and reboot system.
;
;WRITE_E2PROM:     ; MOV     IE_HOLDER,IE
;                  ; MOV     IE,#00H
;                    CLR         EA
;                    MOV     COUNT_OUT1,#0FFH
;EEWRITE_AGAIN:      MOV     COUNT_OUT2,#0FFH
;E2_LOOPW:         MOV     DPTR,#E2PROM_TEST_LOCATION ;point to test loc.
;                  MOVX    A,@DPTR ;load test value to Acc
;                   DJNZ    COUNT_OUT2,CONT1
;                   SJMP    OUT_ERROR
;CONT1:            CJNE    A,#E2PROM_TEST_VALUE,E2_LOOPW ;check if loaded it.
;                  MOV     DPH,E2_DPH ; point to high loc in eeprom
;                  MOV     DPL,E2_DPL ; point to low loc in eeprom
;                  MOV     A,R1 ;store value to write to ram
;                  MOVX    @DPTR,A ;move value to eeloc
;                   MOV     COUNT_OUT2,#0FFH
;VERIFY_WRITE:     MOV     DPTR,#E2PROM_TEST_LOCATION ;point to test loc.
;                  MOVX    A,@DPTR ;load test value to Acc
;                   DJNZ    COUNT_OUT2,CONT2
;                   SJMP    OUT_ERROR
;CONT2:            CJNE    A,#E2PROM_TEST_VALUE,VERIFY_WRITE ;wait till can read
;                  MOV     DPH,E2_DPH ; point to high loc in eeprom
;                  MOV     DPL,E2_DPL ; point to low loc in eeprom
;                  MOVX     A,@DPTR ;read value from eeprom
;                  SUBB    A,R1 ;make A zero if eeprom value = store value
;                   DJNZ    COUNT_OUT1,CONT3
;                   SJMP    OUT_ERROR
;CONT3:            JNZ     EEWRITE_AGAIN ;if not same rewrite value
```

```
;;                  MOV     IE,IE_HOLDER
;                  SETB  EA
;                   SJMP    CONT4
;OUT_ERROR:         RET                 ;LJMP    POWER_ON
;CONT4:            RET
END
```

```
$ep (asm.err)
$DEBUG
$XR SB DB
$NOMOD51
;$NOLIST
NAME KEYSCAN
$TITLE(KEYSCAN.A51)
$NOGE
$INCLUDE(REG52.PDF)
;
CSEG    AT      3800H
PUBLIC KEY_FLAGS1,KEY_FLAGS2,KEY_FLAGS3,KEY_FLAGS4
PUBLIC KEY_00_FOUND,KEY_01_FOUND,KEY_02_FOUND,KEY_03_FOUND,KEY_04_FOUND
PUBLIC KEY_10_FOUND,KEY_11_FOUND,KEY_12_FOUND,KEY_13_FOUND,KEY_14_FOUND
PUBLIC KEY_20_FOUND,KEY_21_FOUND,KEY_22_FOUND,KEY_23_FOUND,KEY_24_FOUND
PUBLIC KEY_30_FOUND,KEY_31_FOUND,KEY_32_FOUND,KEY_33_FOUND,KEY_34_FOUND
PUBLIC KEY_40_FOUND,KEY_41_FOUND,KEY_42_FOUND,KEY_43_FOUND,KEY_44_FOUND
PUBLIC ANY_KEY,KEY_FOUND
PUBLIC KEY_VALUE
PUBLIC KEY_SCAN,CLEAR_KEYS
;
;
                KEY_FLAGS1              DATA    20H     ;
                KEY_00_FOUND            BIT     00H
                KEY_01_FOUND            BIT     01H
                KEY_02_FOUND            BIT     02H
                KEY_03_FOUND            BIT     03H     ;SOFT1_KEY
                KEY_04_FOUND            BIT     04H
                KEY_10_FOUND            BIT     05H
                KEY_11_FOUND            BIT     06H
                KEY_12_FOUND            BIT     07H
;
                KEY_FLAGS2              DATA    21H     ;
                KEY_13_FOUND            BIT     08H     ;SOFT2_KEY
                KEY_14_FOUND            BIT     09H
                KEY_20_FOUND            BIT     0AH
                KEY_21_FOUND            BIT     0BH
                KEY_22_FOUND            BIT     0CH
                KEY_23_FOUND            BIT     0DH     ;SOFT3_KEY
                KEY_24_FOUND            BIT     0EH
                KEY_30_FOUND            BIT     0FH
;
                KEY_FLAGS3              DATA    22H
                KEY_31_FOUND            BIT     10H
                KEY_32_FOUND            BIT     11H
                KEY_33_FOUND            BIT     12H
                KEY_34_FOUND            BIT     13H
                KEY_40_FOUND            BIT     14H     ;START
                KEY_41_FOUND            BIT     15H     ;STOP
                KEY_42_FOUND            BIT     16H     ;DIR CHANGE
                KEY_43_FOUND            BIT     17H     ;UPPER JOG
;
                KEY_FLAGS4              DATA    23H     ;
                KEY_44_FOUND            BIT     18H     ;LOWER JOG
                KEY FOUND               BIT     19H
                SOFT_KEY_FOUND          BIT     1AH
                KEY_DELAY               BIT     20H
                KEY_TEST                BIT     21H
                ANY_KEY                 BIT     22H
                KEY_PASS_DONE           BIT     3CH
;
                ROW_0                   EQU     0FEH
                ROW_1                   EQU     0FDH
                ROW_2                   EQU     0FBH
                ROW_3                   EQU     0F7H
```

```
ROW_4                   EQU     0EFH
ROW_5                   EQU     0DFH
ROW_6                   EQU     0BFH
ROW_7                   EQU     07FH
NO_KEYS_CLOSED          EQU     0FFH
KEYS_OUT_PORT           EQU     0A020H
KEYS_IN_PORT            EQU     0A010H
KEY_DELAY_TIME          EQU     1FH
;
KEY_TIMER               DATA    3CH;54H
KEY_VALUE               DATA    37H
KEY_CLOCK               BIT     33H
;
SET_KEY_FOUND_HIGH      DATA    39H
SET_KEY_FOUND_LOW       DATA    3AH
KEY_ROW_SELECT          DATA    3BH
KEY_COL_MASK            DATA    38H;3AH
;
KEY_00_VALUE            EQU     31H
KEY_01_VALUE            EQU     32H
KEY_02_VALUE            EQU     33H
KEY_03_VALUE            EQU     41H
KEY_04_VALUE            EQU     00H
;
KEY_10_VALUE            EQU     34H
KEY_11_VALUE            EQU     35H
KEY_12_VALUE            EQU     36H
KEY_13_VALUE            EQU     42H
KEY_14_VALUE            EQU     00H
;
KEY_20_VALUE            EQU     37H
KEY_21_VALUE            EQU     38H
KEY_22_VALUE            EQU     39H
KEY_23_VALUE            EQU     44H
KEY_24_VALUE            EQU     00H
;
KEY_30_VALUE            EQU     46H
KEY_31_VALUE            EQU     30H
KEY_32_VALUE            EQU     45H
KEY_33_VALUE            EQU     44H
KEY_34_VALUE            EQU     00H
;
KEY_40_VALUE            EQU     00H
KEY_41_VALUE            EQU     00H
KEY_42_VALUE            EQU     00H
KEY_43_VALUE            EQU     00H
KEY_44_VALUE            EQU     00H
;
;
KEY_00_MASK             EQU     01H
KEY_01_MASK             EQU     02H
KEY_02_MASK             EQU     04H
KEY_03_MASK             EQU     08H
KEY_04_MASK             EQU     10H
;
KEY_10_MASK             EQU     01H
KEY_11_MASK             EQU     02H
KEY_12_MASK             EQU     04H
KEY_13_MASK             EQU     08H
KEY_14_MASK             EQU     10H
;
KEY_20_MASK             EQU     01H
KEY_21_MASK             EQU     02H
KEY_22_MASK             EQU     04H
KEY_23_MASK             EQU     08H
KEY_24_MASK             EQU     10H
;
KEY_30_MASK             EQU     01H
KEY_31_MASK             EQU     02H
KEY_32_MASK             EQU     04H
KEY_33_MASK             EQU     08H
KEY_34_MASK             EQU     10H
```

```
;
                KEY_40_MASK          EQU     01H
                KEY_41_MASK          EQU     02H
                KEY_42_MASK          EQU     04H
                KEY_43_MASK          EQU     08H
                KEY_44_MASK          EQU     10H

;
SHORT_RUNNING:  LJMP    KEY_RUNNING
KEY_SCAN:       CPL     KEY_CLOCK
                JB      ANY_KEY,SHORT_RUNNING          :IS ANY KEY SW
;                JB      KEY_FOUND,KEY_WAITING          ;
;                JB      SOFT_KEY_FOUND,KEY_WAITING
                CALL    GET_ROW_0                    ;
                CJNE    A,#NO_KEYS_CLOSED,ROW_0_KEYS
                CALL    GET_ROW_1                    ;
                CJNE    A,#NO_KEYS_CLOSED,ROW_1_KEYS
                CALL    GET_ROW_2                    ;
                CJNE    A,#NO_KEYS_CLOSED,ROW_2_KEYS
                CALL    GET_ROW_3                    ;
                CJNE    A,#NO_KEYS_CLOSED,ROW_3_KEYS
                CALL    GET_ROW_4                    ;
                CJNE    A,#NO_KEYS_CLOSED,SHORT_ROW_4_KEYS
KEY_WAITING:    LJMP    KEY_END
SHORT_ROW_4_KEYS:       LJMP    ROW_4_KEYS
;
ROW_0_KEYS:     JNB     ACC.0,JMP_KEY_00             ;
                JNB     ACC.1,JMP_KEY_01             ;BEING PROCESSED
                JNB     ACC.2,JMP_KEY_02             ;
                JNB     ACC.3,JMP_KEY_03             ;BEING PROCESSED
                JNB     ACC.4,JMP_KEY_04             ;
                LJMP    CLEAR_KEYS

;
JMP_KEY_00:     LJMP    SET_KEY_00
JMP_KEY_01:     LJMP    SET_KEY_01
JMP_KEY_02:     LJMP    SET_KEY_02
JMP_KEY_03:     LJMP    SET_KEY_03
JMP_KEY_04:     LJMP    SET_KEY_04
;
;
ROW_1_KEYS:     JNB     ACC.0,JMP_KEY_10             ;
                JNB     ACC.1,JMP_KEY_11             ;BEING PROCESSED
                JNB     ACC.2,JMP_KEY_12             ;
                JNB     ACC.3,JMP_KEY_13             ;BEING PROCESSED
                JNB     ACC.4,JMP_KEY_14             ;
                LJMP    CLEAR_KEYS

;
JMP_KEY_10:     LJMP    SET_KEY_10
JMP_KEY_11:     LJMP    SET_KEY_11
JMP_KEY_12:     LJMP    SET_KEY_12
JMP_KEY_13:     LJMP    SET_KEY_13
JMP_KEY_14:     LJMP    SET_KEY_14
;
;
ROW_2_KEYS:     JNB     ACC.0,JMP_KEY_20             ;
                JNB     ACC.1,JMP_KEY_21             ;BEING PROCESSED
                JNB     ACC.2,JMP_KEY_22             ;
                JNB     ACC.3,JMP_KEY_23             ;BEING PROCESSED
                JNB     ACC.4,JMP_KEY_24             ;
                LJMP    CLEAR_KEYS

;
JMP_KEY_20:     LJMP    SET_KEY_20
JMP_KEY_21:     LJMP    SET_KEY_21
JMP_KEY_22:     LJMP    SET_KEY_22
JMP_KEY_23:     LJMP    SET_KEY_23
JMP_KEY_24:     LJMP    SET_KEY_24
;
ROW_3_KEYS:     JNB     ACC.0,JMP_KEY_30             ;
                JNB     ACC.1,JMP_KEY_31             ;BEING PROCESSED
                JNB     ACC.2,JMP_KEY_32             ;
                JNB     ACC.3,JMP_KEY_33             ;BEING PROCESSED
                JNB     ACC.4,JMP_KEY_34             ;
                LJMP    CLEAR_KEYS
```

```
;
JMP_KEY_30:      LJMP    SET_KEY_30
JMP_KEY_31:      LJMP    SET_KEY_31
JMP_KEY_32:      LJMP    SET_KEY_32
JMP_KEY_33:      LJMP    SET_KEY_33
JMP_KEY_34:      LJMP    SET_KEY_34
;
;
ROW_4_KEYS:      JNB     ACC.0,JMP_KEY_40                ;
                 JNB     ACC.1,JMP_KEY_41            ;BEING PROCESSED
                 JNB     ACC.2,JMP_KEY_42
                 JNB     ACC.3,JMP_KEY_43          ;BEING PROCESSED
                 JNB     ACC.4,JMP_KEY_44              ;
                 LJMP    CLEAR_KEYS
;
JMP_KEY_40:      LJMP    SET_KEY_40
JMP_KEY_41:      LJMP    SET_KEY_41
JMP_KEY_42:      LJMP    SET_KEY_42
JMP_KEY_43:      LJMP    SET_KEY_43
JMP_KEY_44:      LJMP    SET_KEY_44
;
;
;
SET_KEY_00:      SETB    ANY_KEY                         ;
                 MOV     KEY_ROW_SELECT,#ROW_0
                 MOV     KEY_COL_MASK,#KEY_00_MASK
                 MOV     KEY_VALUE,#KEY_00_VALUE
                 MOV     SET_KEY_FOUND_HIGH,#HIGH SET_KEY_00_FOUND
                 MOV     SET_KEY_FOUND_LOW,#LOW SET_KEY_00_FOUND
                 SETB    KEY_TEST
                 LJMP    KEY_END
;
SET_KEY_00_FOUND: SETB     KEY_00_FOUND
                 SETB    KEY_FOUND
                 LJMP    KEY_RETURN
;
SET_KEY_01:      SETB    ANY_KEY                         ;
                 MOV     KEY_ROW_SELECT,#ROW_0
                 MOV     KEY_COL_MASK,#KEY_01_MASK
                 MOV     KEY_VALUE,#KEY_01_VALUE
                 MOV     SET_KEY_FOUND_HIGH,#HIGH SET_KEY_01_FOUND
                 MOV     SET_KEY_FOUND_LOW,#LOW SET_KEY_01_FOUND
                 SETB     KEY_TEST
                 LJMP    KEY_END
SET_KEY_01_FOUND: SETB     KEY_01_FOUND
                 SETB    KEY_FOUND
                 LJMP    KEY_RETURN
;
SET_KEY_02:      SETB    ANY_KEY                         ;
                 MOV     KEY_ROW_SELECT,#ROW_0
                 MOV     KEY_COL_MASK,#KEY_02_MASK
                 MOV     KEY_VALUE,#KEY_02_VALUE
                 MOV     SET_KEY_FOUND_HIGH,#HIGH SET_KEY_02_FOUND
                 MOV     SET_KEY_FOUND_LOW,#LOW SET_KEY_02_FOUND
                 SETB     KEY_TEST
                 LJMP    KEY_END
SET_KEY_02_FOUND: SETB     KEY_02_FOUND
                 SETB    KEY_FOUND
                 LJMP    KEY_RETURN
;
SET_KEY_03:      SETB    ANY_KEY                         ;
                 MOV     KEY_ROW_SELECT,#ROW_0
                 MOV     KEY_COL_MASK,#KEY_03_MASK
                 MOV     KEY_VALUE,#KEY_03_VALUE
                 MOV     SET_KEY_FOUND_HIGH,#HIGH SET_KEY_03_FOUND
                 MOV     SET_KEY_FOUND_LOW,#LOW SET_KEY_03_FOUND
                 SETB     KEY_TEST
                 LJMP    KEY_END
SET_KEY_03_FOUND: SETB     KEY_03_FOUND
                 SETB    SOFT_KEY_FOUND
                 LJMP    KEY_RETURN
```

```
;
SET_KEY_04:        SETB    ANY_KEY                                  ;
                   MOV     KEY_ROW_SELECT,#ROW_0
                   MOV     KEY_COL_MASK,#KEY_04_MASK
                   MOV     KEY_VALUE,#KEY_04_VALUE
                   MOV     SET_KEY_FOUND_HIGH,#HIGH SET_KEY_04_FOUND
                   MOV     SET_KEY_FOUND_LOW,#LOW SET_KEY_04_FOUND
                   SETB     KEY_TEST
                   LJMP    KEY_END
SET_KEY_04_FOUND: SETB      KEY_04_FOUND
                   SETB    KEY_FOUND
                   LJMP    KEY_RETURN
;
SET_KEY_10:        SETB    ANY_KEY                                  ;
                   MOV     KEY_ROW_SELECT,#ROW_1
                   MOV     KEY_COL_MASK,#KEY_10_MASK
                   MOV     KEY_VALUE,#KEY_10_VALUE
                   MOV     SET_KEY_FOUND_HIGH,#HIGH SET_KEY_10_FOUND
                   MOV     SET_KEY_FOUND_LOW,#LOW SET_KEY_10_FOUND
                   SETB    KEY_TEST
                   LJMP    KEY_END
;
SET_KEY_10_FOUND: SETB      KEY_10_FOUND
                   SETB    KEY_FOUND
                   LJMP    KEY_RETURN
;
SET_KEY_11:        SETB    ANY_KEY                                  ;
                   MOV     KEY_ROW_SELECT,#ROW_1
                   MOV     KEY_COL_MASK,#KEY_11_MASK
                   MOV     KEY_VALUE,#KEY_11_VALUE
                   MOV     SET_KEY_FOUND_HIGH,#HIGH SET_KEY_11_FOUND
                   MOV     SET_KEY_FOUND_LOW,#LOW SET_KEY_11_FOUND
                   SETB    KEY_TEST
                   LJMP    KEY_END
;
SET_KEY_11_FOUND: SETB      KEY_11_FOUND
                   SETB    KEY_FOUND
                   LJMP    KEY_RETURN
;
SET_KEY_12:        SETB    ANY_KEY                                  ;
                   MOV     KEY_ROW_SELECT,#ROW_1
                   MOV     KEY_COL_MASK,#KEY_12_MASK
                   MOV     KEY_VALUE,#KEY_12_VALUE
                   MOV     SET_KEY_FOUND_HIGH,#HIGH SET_KEY_12_FOUND
                   MOV     SET_KEY_FOUND_LOW,#LOW SET_KEY_12_FOUND
                   SETB    KEY_TEST
                   LJMP    KEY_END
;
SET_KEY_12_FOUND: SETB      KEY_12_FOUND
                   SETB    KEY_FOUND
                   LJMP    KEY_RETURN
;
SET_KEY_13:        SETB    ANY_KEY                                  ;
                   MOV     KEY_ROW_SELECT,#ROW_1
                   MOV     KEY_COL_MASK,#KEY_13_MASK
                   MOV     KEY_VALUE,#KEY_13_VALUE
                   MOV     SET_KEY_FOUND_HIGH,#HIGH SET_KEY_13_FOUND
                   MOV     SET_KEY_FOUND_LOW,#LOW SET_KEY_13_FOUND
                   SETB    KEY_TEST
                   LJMP    KEY_END
;
SET_KEY_13_FOUND: SETB      KEY_13_FOUND
                   SETB    SOFT_KEY_FOUND
                   LJMP    KEY_RETURN
;
SET_KEY_14:        SETB    ANY_KEY                                  ;
                   MOV     KEY_ROW_SELECT,#ROW_1
                   MOV     KEY_COL_MASK,#KEY_14_MASK
                   MOV     KEY_VALUE,#KEY_14_VALUE
                   MOV     SET_KEY_FOUND_HIGH,#HIGH SET_KEY_14_FOUND
                   MOV     SET_KEY_FOUND_LOW,#LOW SET_KEY_14_FOUND
                   SETB    KEY_TEST
                   LJMP    KEY_END
```

```
;
SET_KEY_14_FOUND: SETB     KEY_14_FOUND
                  SETB     KEY_FOUND
                  LJMP     KEY_RETURN
;
SET_KEY_20:       SETB     ANY_KEY                          ;
                  MOV      KEY_ROW_SELECT,#ROW_2
                  MOV      KEY_COL_MASK,#KEY_20_MASK
                  MOV      KEY_VALUE,#KEY_20_VALUE
                  MOV      SET_KEY_FOUND_HIGH,#HIGH SET_KEY_20_FOUND
                  MOV      SET_KEY_FOUND_LOW,#LOW SET_KEY_20_FOUND
                  SETB     KEY_TEST
                  LJMP     KEY_END
;
SET_KEY_20_FOUND: SETB     KEY_20_FOUND
                  SETB     KEY_FOUND
                  LJMP     KEY_RETURN
;
SET_KEY_21:       SETB     ANY_KEY                          ;
                  MOV      KEY_ROW_SELECT,#ROW_2
                  MOV      KEY_COL_MASK,#KEY_21_MASK
                  MOV      KEY_VALUE,#KEY_21_VALUE
                  MOV      SET_KEY_FOUND_HIGH,#HIGH SET_KEY_21_FOUND
                  MOV      SET_KEY_FOUND_LOW,#LOW SET_KEY_21_FOUND
                  SETB     KEY_TEST
                  LJMP     KEY_END
;
SET_KEY_21_FOUND: SETB     KEY_21_FOUND
                  SETB     KEY_FOUND
                  LJMP     KEY_RETURN
;
SET_KEY_22:       SETB     ANY_KEY                          ;
                  MOV      KEY_ROW_SELECT,#ROW_2
                  MOV      KEY_COL_MASK,#KEY_22_MASK
                  MOV      KEY_VALUE,#KEY_22_VALUE
                  MOV      SET_KEY_FOUND_HIGH,#HIGH SET_KEY_22_FOUND
                  MOV      SET_KEY_FOUND_LOW,#LOW SET_KEY_22_FOUND
                  SETB     KEY_TEST
                  LJMP     KEY_END
;
SET_KEY_22_FOUND: SETB     KEY_22_FOUND
                  SETB     KEY_FOUND
                  LJMP     KEY_RETURN
;
SET_KEY_23:       SETB     ANY_KEY                          ;
                  MOV      KEY_ROW_SELECT,#ROW_2
                  MOV      KEY_COL_MASK,#KEY_23_MASK
                  MOV      KEY_VALUE,#KEY_23_VALUE
                  MOV      SET_KEY_FOUND_HIGH,#HIGH SET_KEY_23_FOUND
                  MOV      SET_KEY_FOUND_LOW,#LOW SET_KEY_23_FOUND
                  SETB     KEY_TEST
                  LJMP     KEY_END
;
SET_KEY_23_FOUND: SETB     KEY_23_FOUND
                  SETB     SOFT_KEY_FOUND
                  LJMP     KEY_RETURN
;
SET_KEY_24:       SETB     ANY_KEY                          ;
                  MOV      KEY_ROW_SELECT,#ROW_2
                  MOV      KEY_COL_MASK,#KEY_24_MASK
                  MOV      KEY_VALUE,#KEY_24_VALUE
                  MOV      SET_KEY_FOUND_HIGH,#HIGH SET_KEY_24_FOUND
                  MOV      SET_KEY_FOUND_LOW,#LOW SET_KEY_24_FOUND
                  SETB     KEY_TEST
                  LJMP     KEY_END
;
SET_KEY_24_FOUND: SETB     KEY_24_FOUND
                  SETB     KEY FOUND
                  LJMP     KEY_RETURN
;
SET_KEY_30:       SETB     ANY_KEY                          ;
                  MOV      KEY_ROW_SELECT,#ROW_3
```

```
                MOV     KEY_COL_MASK,#KEY_30_MASK
                MOV     KEY_VALUE,#KEY_30_VALUE
                MOV     SET_KEY_FOUND_HIGH,#HIGH SET_KEY_30_FOUND
                MOV     SET_KEY_FOUND_LOW,#LOW SET_KEY_30_FOUND
                SETB    KEY_TEST
                LJMP    KEY_END
;
SET_KEY_30_FOUND: SETB     KEY_30_FOUND
                SETB    KEY_FOUND
                LJMP    KEY_RETURN
;
SET_KEY_31:     SETB    ANY_KEY                         ;
                MOV     KEY_ROW_SELECT,#ROW_3
                MOV     KEY_COL_MASK,#KEY_31_MASK
                MOV     KEY_VALUE,#KEY_31_VALUE
                MOV     SET_KEY_FOUND_HIGH,#HIGH SET_KEY_31_FOUND
                MOV     SET_KEY_FOUND_LOW,#LOW SET_KEY_31_FOUND
                SETB    KEY_TEST
                LJMP    KEY_END
;
SET_KEY_31_FOUND: SETB     KEY_31_FOUND
                SETB    KEY_FOUND
                LJMP    KEY_RETURN
;
SET_KEY_32:     SETB    ANY_KEY                         ;
                MOV     KEY_ROW_SELECT,#ROW_3
                MOV     KEY_COL_MASK,#KEY_32_MASK
                MOV     KEY_VALUE,#KEY_32_VALUE
                MOV     SET_KEY_FOUND_HIGH,#HIGH SET_KEY_32_FOUND
                MOV     SET_KEY_FOUND_LOW,#LOW SET_KEY_32_FOUND
                SETB    KEY_TEST
                LJMP    KEY_END
;
SET_KEY_32_FOUND: SETB     KEY_32_FOUND
                SETB    KEY_FOUND
                LJMP    KEY_RETURN
;
SET_KEY_33:     SETB    ANY_KEY                         ;
                MOV     KEY_ROW_SELECT,#ROW_3
                MOV     KEY_COL_MASK,#KEY_33_MASK
                MOV     KEY_VALUE,#KEY_33_VALUE
                MOV     SET_KEY_FOUND_HIGH,#HIGH SET_KEY_33_FOUND
                MOV     SET_KEY_FOUND_LOW,#LOW SET_KEY_33_FOUND
                SETB    KEY_TEST
                LJMP    KEY_END
;
SET_KEY_33_FOUND: SETB     KEY_33_FOUND
                SETB    KEY_FOUND
                LJMP    KEY_RETURN
;
SET_KEY_34:     SETB    ANY_KEY                         ;
                MOV     KEY_ROW_SELECT,#ROW_3
                MOV     KEY_COL_MASK,#KEY_34_MASK
                MOV     KEY_VALUE,#KEY_34_VALUE
                MOV     SET_KEY_FOUND_HIGH,#HIGH SET_KEY_34_FOUND
                MOV     SET_KEY_FOUND_LOW,#LOW SET_KEY_34_FOUND
                SETB    KEY_TEST
                LJMP    KEY_END
;
SET_KEY_34_FOUND: SETB     KEY_34_FOUND
                SETB    KEY_FOUND
                LJMP    KEY_RETURN
;
SET_KEY_40:     SETB    ANY_KEY                         ;
                MOV     KEY_ROW_SELECT,#ROW_4
                MOV     KEY_COL_MASK,#KEY_40_MASK
                MOV     KEY_VALUE,#KEY_40_VALUE
                MOV     SET_KEY_FOUND_HIGH,#HIGH SET_KEY_40_FOUND
                MOV     SET_KEY_FOUND_LOW,#LOW SET_KEY_40_FOUND
                SETB    KEY_TEST
```

```
                LJMP    KEY_END
;
SET_KEY_40_FOUND: SETB     KEY_40_FOUND
                SETB    SOFT_KEY_FOUND
                LJMP    KEY_RETURN
;
SET_KEY_41:     SETB    ANY_KEY                         ;
                MOV     KEY_ROW_SELECT,#ROW_4
                MOV     KEY_COL_MASK,#KEY_41_MASK
                MOV     KEY_VALUE,#KEY_41_VALUE
                MOV     SET_KEY_FOUND_HIGH,#HIGH SET_KEY_41_FOUND
                MOV     SET_KEY_FOUND_LOW,#LOW SET_KEY_41_FOUND
                SETB    KEY_TEST
                LJMP    KEY_END
;
SET_KEY_41_FOUND: SETB     KEY_41_FOUND
                SETB    SOFT_KEY_FOUND
                LJMP    KEY_RETURN
;
SET_KEY_42:     SETB    ANY_KEY                         ;
                MOV     KEY_ROW_SELECT,#ROW_4
                MOV     KEY_COL_MASK,#KEY_42_MASK
                MOV     KEY_VALUE,#KEY_42_VALUE
                MOV     SET_KEY_FOUND_HIGH,#HIGH SET_KEY_42_FOUND
                MOV     SET_KEY_FOUND_LOW,#LOW SET_KEY_42_FOUND
                SETB    KEY_TEST
                LJMP    KEY_END
;
SET_KEY_42_FOUND: SETB     KEY_42_FOUND
                SETB    SOFT_KEY_FOUND
                LJMP    KEY_RETURN
;
SET_KEY_43:     SETB    ANY_KEY                         ;
                MOV     KEY_ROW_SELECT,#ROW_4
                MOV     KEY_COL_MASK,#KEY_43_MASK
                MOV     KEY_VALUE,#KEY_43_VALUE
                MOV     SET_KEY_FOUND_HIGH,#HIGH SET_KEY_43_FOUND
                MOV     SET_KEY_FOUND_LOW,#LOW SET_KEY_43_FOUND
                SETB    KEY_TEST
                LJMP    KEY_END
;
SET_KEY_43_FOUND: SETB     KEY_43_FOUND
                SETB    SOFT_KEY_FOUND
                LJMP    KEY_RETURN
;
SET_KEY_44:     SETB    ANY_KEY                         ;
                MOV     KEY_ROW_SELECT,#ROW_4
                MOV     KEY_COL_MASK,#KEY_44_MASK
                MOV     KEY_VALUE,#KEY_44_VALUE
                MOV     SET_KEY_FOUND_HIGH,#HIGH SET_KEY_44_FOUND
                MOV     SET_KEY_FOUND_LOW,#LOW SET_KEY_44_FOUND
                SETB    KEY_TEST
                LJMP    KEY_END
;
SET_KEY_44_FOUND: SETB     KEY_44_FOUND
                SETB    SOFT_KEY_FOUND
                LJMP    KEY_RETURN
;
KEY_RUNNING:    JB      KEY_TEST,KEY_TESTING
                JB      KEY_DELAY,KEY_DELAYING      ;
                LJMP    CLEAR_KEYS                  ;
;
KEY_TESTING:    CALL    GET_KEY                     ;USES KEY_ROW_SELECT
                JNZ     KEY_ERROR                   ;AND KEY_COL_MASK
;                SETB    KEY_FOUND
                MOV     A,#00H
                MOV     DPH,SET_KEY_FOUND_HIGH
                MOV     DPL,SET_KEY_FOUND_LOW
                JMP     @A+DPTR
KEY_RETURN:     SETB    KEY_DELAY
                CLR     KEY_TEST
```

```
                ;
                MOV     KEY_TIMER,#KEY_DELAY_TIME       ;
                LJMP    KEY_END
KEY_ERROR   :   LJMP    CLEAR_KEYS
;
KEY_DELAYING:   DJNZ    KEY_TIMER,KEY_PASS              ;
                CALL    GET_KEY
                JZ      DELAY_KEY
                CLR     KEY_DELAY
                CLR     ANY_KEY
                LJMP    KEY_END                         ;
;
DELAY_KEY:      MOV     KEY_TIMER,#KEY_DELAY_TIME
KEY_PASS:       LJMP    KEY_END
;
;
GET_ROW_0:      MOV     DPTR,#KEYS_OUT_PORT
                MOV     A,#ROW_0
                MOVX    @DPTR,A
                MOV     DPTR,#KEYS_IN_PORT
                MOVX    A,@DPTR
                RET
;
GET_ROW_1:      MOV     DPTR,#KEYS_OUT_PORT
                MOV     A,#ROW_1
                MOVX    @DPTR,A
                MOV     DPTR,#KEYS_IN_PORT
                MOVX    A,@DPTR
                RET
;
GET_ROW_2:      MOV     DPTR,#KEYS_OUT_PORT
                MOV     A,#ROW_2
                MOVX    @DPTR,A
                MOV     DPTR,#KEYS_IN_PORT
                MOVX    A,@DPTR
                RET
;
GET_ROW_3:      MOV     DPTR,#KEYS_OUT_PORT
                MOV     A,#ROW_3
                MOVX    @DPTR,A
                MOV     DPTR,#KEYS_IN_PORT
                MOVX    A,@DPTR
                RET
;
GET_ROW_4:      MOV     DPTR,#KEYS_OUT_PORT
                MOV     A,#ROW_4
                MOVX    @DPTR,A
                MOV     DPTR,#KEYS_IN_PORT
                MOVX    A,@DPTR
                RET
;
GET_ROW_5:      MOV     DPTR,#KEYS_OUT_PORT
                MOV     A,#ROW_5
                MOVX    @DPTR,A
                MOV     DPTR,#KEYS_IN_PORT
                MOVX    A,@DPTR
                RET
;
GET_ROW_6:      MOV     DPTR,#KEYS_OUT_PORT
                MOV     A,#ROW_6
                MOVX    @DPTR,A
                MOV     DPTR,#KEYS_IN_PORT
                MOVX    A,@DPTR
                RET
;
GET_ROW_7:      MOV     DPTR,#KEYS_OUT_PORT
                MOV     A,#ROW_7
                MOVX    @DPTR,A
                MOV     DPTR,#KEYS_IN_PORT
                MOVX    A,@DPTR
                RET
```

```
;
GET_KEY:        MOV     DPTR,#KEYS_OUT_PORT
                MOV     A,KEY_ROW_SELECT
                MOVX    @DPTR,A
                MOV     DPTR,#KEYS_IN_PORT
                MOVX    A,@DPTR
                ANL     A,KEY_COL_MASK
                RET
;
CLEAR_KEYS:      MOV     KEY_FLAGS1,#00H
                MOV     KEY_FLAGS2,#00H
                MOV     KEY_FLAGS3,#00H
                MOV     KEY_FLAGS4,#00H
KEY_END:        RET
END
$ep (asm.err)
$DEBUG
$XR SB DB
$NOMOD51
;$NOLIST
NAME LCD
$TITLE(LCD.A51)
$NOGE
$INCLUDE(REG52.PDF)
;
CSEG    AT      3100H
PUBLIC DISP_DVR_FLAG,LCD_LOW_LINE_BUFFER,FLASH_BLANK_SYMBOL
PUBLIC DISP_DVR,LINE_SCAN_RAM_OUT1,LINE_SCAN_RAM_OUT2,OUT_RAM_LINE1
PUBLIC SCAN,OUT_RAM_LINE2,BLANK_CHAR,LCDINIT
PUBLIC LCD_INST_NOT_DATA,LCD_DIGIT_START_FLAG
PUBLIC INST,LCD_DIGIT_START1_ADDRESS,LCD_DIGIT_START2_ADDRESS,LCD_SET_L1
PUBLIC OUT_LINE1,OUT_LINE2
;EXTRN DATA(KEY_FLAGS1,KEY_FLAGS2,KEY_FLAGS3,KEY_FLAGS4)
;
                DISP_DVR_FLAG           BIT     27H.3
                LCD_LOW_LINE_BUFFER     DATA    35H
                FLASH_BLANK_SYMBOL      DATA    34H;WAS 69H
;
;***********THIS IS FOR TESTING*********
;ORG              00
;                 LJMP    LCDINIT
;*****************************************
ORG             3100H
LCDINIT:        MOV     INST,#LCD_INIT  ;FUNCTION SET, 8 DATA LINES
                CALL    WINST           ;2 DISPLAY LINES,5X10 DOT
                CALL    WINST           ;EXECUTE INSTRUCTION
                CALL    WINST           ;THREE CYCLES NEEDED
                CALL    WINST           ;
                CALL    WINST           ;
                MOV     INST,#01H           ;CLEAR LCD
                CALL    WINST           ;
                MOV     INST,#06H           ;INC. AND MOVE CURSSOR
                CALL    WINST           ;
                 MOV     INST,#0FH           ;DISPLAY ON CURSOR ON AND BLINK
;               MOV     INST,#0CH       ;DISPLAY ON
                CALL    WINST           ;
                MOV     INST,#80H           ;DISPLAY ADDR. =00H
                CALL    WINST           ;
;END_TEST:       JMP     END_TEST
               RET              ;TESTING
;
WINST:          MOV     DPTR,#LCD_RD_INST     ;READ BUSY FLAG IN LCD
BSYLOOP:        MOVX    A,@DPTR         ;LCD STATUS TO ACC.
                JB      ACC.7,BSYLOOP   ;WAIT TILL NOT BUSY
                MOV     A,INST        ;LOAD INSTRUCTION INTO ACC
                MOV     DPTR,#LCD_WR_INST  ;LCD INSTRUCTION PORT
                MOVX    @DPTR,A         ;
                CALL    LCDBSY1          ;WAIT FOR LCD READY
                RET                     ;ALL DONE HERE
;
```

```
;
LCDBSY1:        PUSH   ACC                ;SAVE STATUS
                PUSH   DPL                ;
                PUSH   DPH                ;
                MOV    DPTR,#LCD_RD_INST    ;LOW BYTE ADDR OF LCD INST
WAITLCD:        MOVX   A,@DPTR            ;LCD STATUS TO ACC
                JB     ACC.7,WAITLCD      ;
                POP    DPH                ;
                POP    DPL                ;
                POP    ACC                ;RESTORE
                RET
;
OUT_LINE1:      JB     DISP_DVR_FLAG,OUT_LINE1
                MOV    INST,#LCD_SET_L1
                SETB   LCD_INST_NOT_DATA
                SETB   DISP_DVR_FLAG
;                MOV    KEY_FLAGS1,#00H
;                MOV    KEY_FLAGS2,#00H
;                MOV    KEY_FLAGS3,#00H
;                MOV    KEY_FLAGS4,#00H
WAIT1:          JB     DISP_DVR_FLAG,WAIT1
                CALL   GET_MSG
                CLR    LCD_INST_NOT_DATA
                SETB   DISP_DVR_FLAG
WAIT_OUT_LINE1: JB     DISP_DVR_FLAG,WAIT_OUT_LINE1
                RET
OUT_LINE2:      JB     DISP_DVR_FLAG,OUT_LINE2
                MOV    INST,#LCD_SET_L2
                SETB   LCD_INST_NOT_DATA
                SETB   DISP_DVR_FLAG
;                MOV    KEY_FLAGS1,#00H
;                MOV    KEY_FLAGS2,#00H
;                MOV    KEY_FLAGS3,#00H
;                MOV    KEY_FLAGS4,#00H
WAIT2:          JB     DISP_DVR_FLAG,WAIT2
                CALL   GET_MSG
                CLR    LCD_INST_NOT_DATA
                SETB   DISP_DVR_FLAG
WAIT_OUT_LINE2: JB     DISP_DVR_FLAG,WAIT_OUT_LINE2
                RET
;
OUT_RAM_LINE1:  JB     DISP_DVR_FLAG,OUT_RAM_LINE1
                MOV    INST,#LCD_SET_L1
                SETB   LCD_INST_NOT_DATA
                SETB   DISP_DVR_FLAG
;                MOV    KEY_FLAGS1,#00H
;                MOV    KEY_FLAGS2,#00H
;                MOV    KEY_FLAGS3,#00H
;                MOV    KEY_FLAGS4,#00H
WAIT3:          JB     DISP_DVR_FLAG,WAIT3
                CLR    LCD_INST_NOT_DATA
                SETB   DISP_DVR_FLAG
WAIT_OUT_LINE3: JB     DISP_DVR_FLAG,WAIT_OUT_LINE3
                RET
OUT_RAM_LINE2:  JB     DISP_DVR_FLAG,OUT_RAM_LINE2
                MOV    INST,#LCD_SET_L2
                SETB   LCD_INST_NOT_DATA
                SETB   DISP_DVR_FLAG
;                MOV    KEY_FLAGS1,#00H
;                MOV    KEY_FLAGS2,#00H
;                MOV    KEY_FLAGS3,#00H
;                MOV    KEY_FLAGS4,#00H
WAIT4:          JB     DISP_DVR_FLAG,WAIT4
                CLR    LCD_INST_NOT_DATA
                SETB   DISP_DVR_FLAG
WAIT_OUT_LINE4: JB     DISP_DVR_FLAG,WAIT_OUT_LINE4
                RET
;
;
                LINE_LENGTH                DATA    30H;WAS 3BH
                INST          DATA    36H;WAS 34H
```

```
;
;
;
;          LCD_DATA_HI       EQU    0FFH
;          LCD_DATA_LOW      EQU    08AH
           LCD_RD_INST       EQU    0A03AH
           LCD_WR_INST       EQU    0A038H
           LCD_RD_DATA       EQU    0A03BH
           LCD_WR_DATA       EQU    0A039H
           LCD_INIT          EQU    38H
           LINE1             EQU    2500H
           LINE2             EQU    2520H
           LCD_SET_L1        EQU    80H
           LCD_SET_L2        EQU    0A8H
           DISPLAY_CODE      EQU    1000H
           LCD_LENGTH        EQU    18H
           MSG_LENGTH        EQU    28H
           LCD_RAM_LINE_ADDR  EQU   0B8H
;          LCD_CHAR_01       EQU    0B8H
;          LCD_CHAR_02       EQU    0B9H
;          LCD_CHAR_03       EQU    0BAH
;          LCD_CHAR_04       EQU    0BBH
;          LCD_CHAR_05       EQU    0BCH
;          LCD_CHAR_06       EQU    0BDH
;          LCD_CHAR_07       EQU    0BEH
;          LCD_CHAR_08       EQU    0BFH
;          LCD_CHAR_09       EQU    0C0H
;          LCD_CHAR_10       EQU    0C1H
;          LCD_CHAR_11       EQU    0C2H
;          LCD_CHAR_12       EQU    0C3H
;          LCD_CHAR_13       EQU    0C4H
;          LCD_CHAR_14       EQU    0C5H
;          LCD_CHAR_15       EQU    0C6H
;          LCD_CHAR_16       EQU    0C7H
;          LCD_CHAR_17       EQU    0C8H
;          LCD_CHAR_18       EQU    0C9H
;          LCD_CHAR_19       EQU    0CAH
;          LCD_CHAR_20       EQU    0CBH
;          LCD_CHAR_21       EQU    0CCH
;          LCD_CHAR_22       EQU    0CDH
;          LCD_CHAR_23       EQU    0CEH
;          LCD_CHAR_24       EQU    0CFH
;;
;;
           LCD_DVR_FLAGS             DATA    2AH
           LCD_BSY_FLAG              BIT     50H
           LCD_OUTPUT_RUNNING        BIT     51H
           LCD_INST_NOT_DATA         BIT     52H
           OFFSET_DISP               BIT     54H
           INC_LCD_LOW_LINE_BUFFER   BIT     55H
           LCD_END                   EQU     0D0H
;
DISP_DVR:  PUSH    ACC
           PUSH    DPH
           PUSH    DPL
           PUSH    07H
           PUSH    01H
           CALL    LCDBSY          ;
           JB      LCD_BSY_FLAG,LCD_PASS_BY
           JB      LCD_OUTPUT_RUNNING,OUTLINE
           JB      LCD_INST_NOT_DATA,OUTPUT_INST
           MOV     LINE_LENGTH,#LCD_LENGTH          ;LINE LENGTH
           JB      OFFSET_DISP,OFFSET_LCD
           MOV     LCD_LOW_LINE_BUFFER,#LCD_RAM_LINE_ADDR
OFFSET_LCD: SETB   LCD_OUTPUT_RUNNING
           CLR     OFFSET_DISP
OUTLINE:   MOV     R1,LCD_LOW_LINE_BUFFER     ;ADDRESS OF LINE IN RAM
           MOV     R7,LINE_LENGTH
           MOV     DPTR,#LCD_WR_DATA     ;ADDRESS OF LCD
           MOV     A,@R1             ;GET LCD BYTE FROM DATA MEM
           MOVX    @DPTR,A           ;WRITE BYTE TO LCD
           INC     R1                ;
```

```
                MOV     LCD_LOW_LINE_BUFFER,R1
                DJNZ    R7,LCD_PASS_BY
                CLR     DISP_DVR_FLAG
                CLR     LCD_BSY_FLAG
                CLR     LCD_OUTPUT_RUNNING
LCD_PASS_BY:    MOV     LINE_LENGTH,R7
                POP     01H
                POP     07H
                POP     DPL
                POP     DPH
                POP     ACC
                RET
;
;
OUTPUT_INST:    MOV     A,INST          ;LOAD INSTRUCTION INTO ACC
                MOV     DPTR,#LCD_WR_INST  ;LCD INSTRUCTION PORT
                MOVX    @DPTR,A         ;
                POP     01H
                POP     07H
                POP     DPL
                POP     DPH
                POP     ACC
                CLR     DISP_DVR_FLAG
                RET
;
LCDBSY:         MOV     DPTR,#LCD_RD_INST
                MOVX    A,@DPTR
                JB      ACC.7,BSY_FLAG
                RET
;
BSY_FLAG:       SETB    LCD_BSY_FLAG
                RET
;
GET_MSG:        MOV     R5,#LCD_LENGTH
                MOV     R0,#LCD_RAM_LINE_ADDR
GET_MORE:       MOV     A,#00H
                MOVC    A,@A+DPTR
                MOV     @R0,A
                INC     DPTR
                INC     R0
                DJNZ    R5,GET_MORE
                RET
;;
LINE_SCAN_RAM_OUT1:  CALL OUT_LINE1
                     CALL SCAN
                     CALL OUT_RAM_LINE1
                     RET
;
;
LINE_SCAN_RAM_OUT2:  CALL OUT_LINE2
                     CALL SCAN
                     CALL OUT_RAM_LINE2
                     RET
;
;SCAN: is a routine that begins seaching the ram display output buffer at
; LCD_RAM_LINE_ADDR and then incrementally checks each character in the
; ram buffer.  It is called after calling OUTLINE 1 or 2.  Each character is
; checked against the ascii contents located in SOLID_CHAR_TST_SYMBOL,
; ARROW_CHAR_TST_SYMBOL, or DIGIT_ENTRY_TST_SYMBOL.  Each of these variables
; can be preset before calling SCAN, but are currently ([), ({), and (@) resp.
; If scan finds a ([) it replaces it with #SOLID_CHAR.  If scan finds ({),
; it replaces it with #ARROW_CHAR.  If scan finds a (@) it replaces it with
; #BLANK_CHAR and stores the address in LCD_DIGIT_START1_ADDRESS if it is the
; first (@) and in LCD_DIGIT_START2_ADDRESS if it is the second (@).  These
; two character address variables are available after returning from scan.
; You must must call OUT_RAM_LINE 1 or 2 to refresh the display with the
; updated buffer after calling scan.
;*** Note: In using SCAN for two display lines, if the first both lines
;have @ characters then the results of the @ addresses must be saved before
;calling SCAN for the second line.  The variable addresses for the @ will
;always reflect the last line called!
```

```
;THIS ROUTINE SCANS FOR SPECIAL MESSAGE SYMBOLS set here as:
                SOLID_CHAR_TST_SYMBOL      EQU    5BH ; ([)
                LEFT_ARROW_TST_SYMBOL      EQU    7BH ; ({)
                RIGHT_ARROW_TST_SYMBOL     EQU    7DH ; (})
                DIGIT_ENTRY_TST_SYMBOL     EQU    40H ; (@)
                BUF_CHAR_OVERFLOW          EQU    19H ; 24+1
;SCAN replaces the test characters with the following display characters:
                SOLID_CHAR                 EQU   0FFH ;black square
                LEFT_ARROW_CHAR            EQU    7FH ;left arrow symbol
                RIGHT_ARROW_CHAR           EQU    7EH ;right arrow symbol
                BLANK_CHAR                 EQU    20H ;blank symbol
;SCAN uses the following variables and returns LCD_DIGIT_START1(or2)_ADDRESS
                SCAN_LOCATOR               DATA   31H ;position in Buf.;60H
                LCD_DIGIT_START1_ADDRESS   DATA   32H ;addr for 1st @; WAS 61H
                LCD_DIGIT_START2_ADDRESS   DATA   33H ;addr for 2nd @; WAS 62H
                LCD_DIGIT_START_FLAG       BIT    44H ;it is 1st @ if 0
;
; Program comments:
; SCAN uses the external ram buffer start address LCD_RAM_LINE_ADDR.
;
SCAN:           CLR     LCD_DIGIT_START_FLAG
; Get the first (and later the current) position in the display buffer.
                MOV     SCAN_LOCATOR,#LCD_RAM_LINE_ADDR
SCANNING:       MOV     R0,SCAN_LOCATOR
;  Find the ([) for the solid blank and move blank to display buffer.
FIND_SOLID:     CJNE    @R0,#SOLID_CHAR_TST_SYMBOL,FIND_LARROW
                MOV     @R0,#SOLID_CHAR
;  Find the ({) for the left arrow symbol and move it to the display buffer.
FIND_LARROW:    CJNE    @R0,#LEFT_ARROW_TST_SYMBOL,FIND_RARROW
                MOV     @R0,#LEFT_ARROW_CHAR
;  Find the (}) for the right arrow symbol and move it to the display buffer.
FIND_RARROW:    CJNE    @R0,#RIGHT_ARROW_TST_SYMBOL,FIND_DIGIT
                MOV     @R0,#RIGHT_ARROW_CHAR
;  Find the (@) for the 1st Digit symbol and remember its buffer loc.
;
;       1/10/90 MODIFIED FIND_DIGIT SO IT WILL FIND ONLY ONE @ CHAR
;       RETURN UNTIL CALLED AGAIN.  L. DURKOS
FIND_DIGIT:     JB      LCD_DIGIT_START_FLAG,RE_SCAN
                  CJNE    @R0,#DIGIT_ENTRY_TST_SYMBOL,RE_SCAN
;                 JB      LCD_DIGIT_START_FLAG,SECND_DIGIT
                  MOV     LCD_DIGIT_START1_ADDRESS,SCAN_LOCATOR
                  MOV     @R0,#SOLID_CHAR        ;CHANGED FROM BLAMK_CHAR
                  SETB    LCD_DIGIT_START_FLAG
                  SJMP    RE_SCAN
;SECND_DIGIT:     MOV     LCD_DIGIT_START2_ADDRESS,SCAN_LOCATOR
;                 MOV    @R0,#BLANK_CHAR
RE_SCAN:        INC     SCAN_LOCATOR
                MOV     R0,SCAN_LOCATOR
                CJNE    R0,#BUF_CHAR_OVERFLOW,SCANNING
                RET
END

$ep (asm.err)
$DEBUG
$XR SB DB
$NOMOD51
;$NOLIST
NAME MATH
$TITLE(MATH.A51)
$NOGE
$INCLUDE(REG52.PDF)
;
CSEG    AT      1000H
PUBLIC PR_LOW,PR_HIGH,DAMS_0,DAMS_1,DAMS_2,DAMS_3,OP_0,OP_1,OP_2,OP_3
PUBLIC TMP_0,TMP_1,TMP_2,TMP_3
PUBLIC DIV_16,ADD_32,SUB_32,MUL_16,TEN_THOU_ASCII
PUBLIC SAVE_OP_A,SAVE_OP_B,OP_TO_DAMS,GET_OP_A,GET_OP_B
PUBLIC THOU_ASCII,HUNDRED_ASCII,TEN_ASCII,ONE_ASCII,ASC_BIN,HEX_ASCII
;PUBLIC LOW_ASC_TO_BIN_ADDR,HIGH_ASC_TO_BIN_ADDR
                DIV_LOOP_COUNTER  . DATA    07CH;38H
                PR_LOW          DATA    07DH;5BH
                PR_HIGH         DATA    07EH;5CH
```

```
                DAMS_0          DATA    074H;49H
                DAMS_1          DATA    075H;42H
                DAMS_2          DATA    076H;35H
                DAMS_3          DATA    077H;3EH
                OP_0            DATA    070H;4AH
                OP_1            DATA    071H;4BH
                OP_2            DATA    072H;4CH
                OP_3            DATA    073H;4DH
                TMP_0           DATA    078H;55H
                TMP_1           DATA    079H;56H
                TMP_2           DATA    07AH;58H
                TMP_3           DATA    07BH;37H
;*****************************************************************************
;
;       THIS DIVIDES THE 32 BIT OP REGISTER BY THE VALUE SUPPLIED
;       IN  DAMS_0 AND DAMS_1
;
DIV_16:         MOV     PR_HIGH,#00H            ;R7
                MOV     PR_LOW,#00H             ;R6
                MOV     TMP_0,#00H
                MOV     TMP_1,#00H
                MOV     TMP_2,#00H
                MOV     TMP_3,#00H
;               DAMS_1 CONTAINS LOWER BYTE ;R1
;               DAMS_0 CONTAINS HIGH BYTE   ;R0
                MOV     DIV_LOOP_COUNTER,#32        ;R5
;       THIS BEGINS THE LOOP
DIV_LOOP:       CALL    SHIFT_D         ;SHIFTS THE DIVIDEND AND RETURNS
                                        ;MSB IN C
                MOV     A,PR_LOW        ;SHIFTS CARRY INTO LSB OF PR_LOW
                RLC     A
                MOV     PR_LOW,A
                MOV     A,PR_HIGH
                RLC     A
                MOV     PR_HIGH,A
;NOW TEST TO SEE IF PR_HIGH:PR_LOW )= DAMS_1:DAMS_0
                CLR     C
                MOV     A,PR_HIGH       ;SUBTRACT DAMS_1 FROM PR_HIGH
                                        ;TO SEE IF DAMS_1 ( PR_HIGH
                SUBB    A,DAMS_1  ;A = PR_HIGH - DAMS_1, CARRY
                                        ;SET IF PR_HIGH ( DAMS_1
                JC      CANT_SUB
;AT THIS POINT ( PR_HIGH ) DAMS_1 ) OR ( PR_HIGH = DAMS_1 )
                JNZ     CAN_SUB         ;JUMP IF (PR_HIGH ) DAMS_1)
;IF (PR_HIGH = DAMS_1), TEST FOR (PR_LOW )= DAMS_0)
                CLR     C
                MOV     A,PR_LOW
                SUBB    A,DAMS_0   ;A = PR_LOW - DAMS_0, CARRY
                                        ;SET IF PR_LOW ( DAMS_0
                JC      CANT_SUB
CAN_SUB:        ;SUBTRACT THE DIVISOR FORM THE PARTIAL REMAINDER
                CLR     C
                MOV     A,PR_LOW
                SUBB    A,DAMS_0   ;A = PR_LOW - DAMS_0
                MOV     PR_LOW,A
                MOV     A,PR_HIGH
                SUBB    A,DAMS_1  ;A = PR_HIGH - DAMS_1 - BORROW
                MOV     PR_HIGH,A
                SETB    C               ;SHIFT A 1 INTO THE QUOTIENT
                JMP     QUOT
CANT_SUB:       ;SHIFT 0 INTO QUOTIENT
                CLR     C
QUOT:           ;SHIFT THE CARRY BIT INTO THE QUOTIENT
                CALL SHIFT_Q
                ;TEST FOR COMPLETION
                DJNZ    DIV_LOOP_COUNTER,DIV_LOOP
                ;NOW WE ARE ALL DONE MOVE THE TMP VALUES BACK INTO OP
                MOV     OP_0,TMP_0
                MOV     OP_1,TMP_1
                MOV     OP_2,TMP_2
                MOV     OP_3,TMP_3
                RET
```

```
;
SHIFT_D:        ;SHIFT THE DIVIDEND ONE BIT THE LEFT AND
                ;RETURN THE MSB IN CARRY BIT
                CLR     C
                MOV     A,OP_0
                RLC     A
                MOV     OP_0,A
                MOV     A,OP_1
                RLC     A
                MOV     OP_1,A
                MOV     A,OP_2
                RLC     A
                MOV     OP_2,A
                MOV     A,OP_3
                RLC     A
                MOV     OP_3,A
                RET
SHIFT_Q:        ;SHIFT THE QUOTIENT ONE BIT TO THE LEFT AND SHIFT
                ;THE CARRY BIT INTO LSB
                MOV     A,TMP_0
                RLC     A
                MOV     TMP_0,A
                MOV     A,TMP_1
                RLC     A
                MOV     TMP_1,A
                MOV     A,TMP_2
                RLC     A
                MOV     TMP_2,A
                MOV     A,TMP_3
                RLC     A
                MOV     TMP_3,A
                RET
;
;*****************************************************************
;                       SUB_32
;       THIS ROUTINE SUBTRACTS TWO 32 BIT NUMBERS
;  ( OP_3,OP-2,OP_1,OP_0 ) - ( DAMS_3,DAMS_2,DAMS_1,DAMS_0 ) =
;               ( OP_3,OP_2,OP_1,OP_0 )
;*****************************************************************
;
SUB_32:         CLR     C
                MOV     A,OP_0
                SUBB    A,DAMS_0        ;LOW BYTE FIRST
                MOV     OP_0,A
                MOV     A,OP_1
                SUBB    A,DAMS_1        ;MID_LOW_ BYTE+CARRY
                MOV     OP_1,A
                MOV     A,OP_2
                SUBB    A,DAMS_2        ;MID_HIGH_BYTE+ CARRY
                MOV     OP_2,A
                MOV     A,OP_3
                SUBB    A,DAMS_3        ;HIGH_BYTE+CARRY
                MOV     OP_3,A
                RET
;*****************************************************************
;*****************************************************************
;                       ADD_32
;       THIS ROUTINE ADDAS TWO 32 BIT NUMBERS
;  ( OP_3,OP-2,OP_1,OP_0 ) + ( DAMS_3,DAMS_2,DAMS_1,DAMS_0 ) =
;               ( OP_3,OP_2,OP_1,OP_0 )
;*****************************************************************
ADD_32:         CLR     C
                MOV     A,OP_0
                ADDC    A,DAMS_0        ;LOW BYTE FIRST
                MOV     OP_0,A
                MOV     A,OP_1
                ADDC    A,DAMS_1        ;MID_LOW_ BYTE+CARRY
                MOV     OP_1,A
                MOV     A,OP_2
                ADDC    A,DAMS_2        ;MID_HIGH_BYTE+ CARRY
                MOV     OP_2,A
                MOV     A,OP_3
```

```
                ADDC    A,DAMS_3        ;HIGH_BYTE+CARRY
                MOV     OP_3,A
                RET
;
MUL_16:         MOV     TMP_3,#00H      ;CLEAR
                MOV     TMP_2,#00H      ;
                ;GENERATE THE LOWEST BYTE OF THE RESULT
                MOV     B,OP_0
                MOV     A,DAMS_0
                MUL     AB
                MOV     TMP_0,A         ;LOW_ORDER RESULT
                MOV     TMP_1,B         ;HIGH_ORDER RESULT
                ;GENERATE NEXT HIGHER ORDER
                MOV     B,OP_1
                MOV     A,DAMS_0
                MUL     AB
                ADD     A,TMP_1         ;LOW_ORDER RESULT
                MOV     TMP_1,A         ;SAVE
                MOV     A,B             ;GET HIGH ORDER RESULT
                ADDC    A,TMP_2         ;INCLUDE CARRY FROM PREVIOUS OPERAT
                MOV     TMP_2,A         ;SAVE
                JNC     MUL_LOOP1
                INC     TMP_3           ;PROPAGATE CARRY INTO TMP_3
MUL_LOOP1:      MOV     B,OP_0
                MOV     A,DAMS_1
                MUL     AB
                ADD     A,TMP_1         ;LOW_ORDER RESULT
                MOV     TMP_1,A         ;SAVE
                MOV     A,B             ;GET HIGH ORDER RESULT
                ADDC    A,TMP_2         ;INCLUDE CARRY
                MOV     TMP_2,A         ;SAVE
                JNC     MUL_LOOP2       ;
                INC     TMP_3           ;PROP CARRY INTOP TMP_3
MUL_LOOP2:      ;NOW START WORKING ON THIRD BYTE
                MOV     B,OP_2
                MOV     A,DAMS_0
                MUL     AB
                ADD     A,TMP_2
                MOV     TMP_2,A
                MOV     A,B
                ADDC    A,TMP_3
                MOV     TMP_3,A
                ;NOW THE OTHER HALF
                MOV     B,OP_1
                MOV     A,DAMS_1
                MUL     AB
                ADD     A,TMP_2
                MOV     TMP_2,A
                MOV     A,B
                ADDC    A,TMP_3
                MOV     TMP_3,A
                ;NOW FINISH OFF THE HIGHEST ORDER BYTE
                MOV     B,OP_3
                MOV     A,DAMS_0
                MUL     AB
                ADD     A,TMP_3
                MOV     TMP_3,A
                ;FORGOT ABOUT THE HIGH_ORDER RESULT
                MOV     B,OP_2
                MOV     A,DAMS_1
                MUL     AB
                ADD     A,TMP_3
                MOV     TMP_3,A
                ;NOW WE ARE ALL DONE, MOVE TMPS TO OPS
                MOV     OP_0,TMP_0
                MOV     OP_1,TMP_1
                MOV     OP_2,TMP_2
                MOV     OP_3,TMP_3
                RET
;
;
;ASCII_TO_BINARY CONVERSION:  Assume that the ASCII data values
```

```
; for TEN_THOU_ASCII,THOU_ASCII,HUNDRED_ASCII, TEN_ASCII, and ONE_ASCII
; are already filled with  ASCII values when this routine is called.
;The resulting FOUR byte binary values are then returned in OP_0,1,2,3.
; The range of the decimal ascii values that can be converted is [00000,99999].
;                TEN_THOU_ASCII
;                THOU_ASCII
                 HUNDRED_ASCII              DATA   62H;66H
                 TEN_ASCII                  DATA   61H;67H
                 ONE_ASCII                  DATA   60H;68H
; The converted FOUR byte binary number is returned in the locations:
;                OP_0      ;LSB
;                OP_1      ;NEXT BYTE
;                OP_2      ;NEXT BYTE
;                OP_3      ;MSB
;
ASC_BIN:         ANL       TEN_THOU_ASCII,#0FH
                 ANL       THOU_ASCII,#0FH
                 ANL       HUNDRED_ASCII,#0FH
                 ANL       TEN_ASCII,#0FH
                 ANL       ONE_ASCII,#0FH
                 MOV       A,TEN_THOU_ASCII
                 JZ        THOU_CONV
                 MOV       B,#03H
                 MUL       AB
                 MOV       B,A
                 MOV       DPTR,#N00000_MSB
                 MOVC      A,@A+DPTR
                 MOV       OP_2,A
                 INC       DPTR
                 MOV       A,B
                 MOVC      A,@A+DPTR
                 MOV       OP_1,A
                 INC       DPTR
                 MOV       A,B
                 MOVC      A,@A+DPTR
                 MOV       OP_0,A
                 MOV       OP_3,#00H
                 CALL      OP_TO_DAMS
THOU_CONV:       MOV       A,THOU_ASCII
                 JZ        HUN_CONV
                 MOV       B,#02H
                 MUL       AB
                 MOV       B,A
                 MOV       DPTR,#N0000_MSB
                 MOVC      A,@A+DPTR
                 MOV       OP_1,A
                 INC       DPTR
                 MOV       A,B
                 MOVC      A,@A+DPTR
                 MOV       OP_0,A
                 MOV       OP_2,#00H
                 MOV       OP_3,#00H
                 CALL      ADD_32
                 CALL      OP_TO_DAMS
HUN_CONV:        MOV       A,HUNDRED_ASCII
                 JZ        TEN_CONV
                 MOV       B,#02H
                 MUL       AB
                 MOV       B,A
                 MOV       DPTR,#N000_MSB
                 MOVC      A,@A+DPTR
                 MOV       OP_1,A
                 INC       DPTR
                 MOV       A,B
                 MOVC      A,@A+DPTR
                 MOV       OP_0,A
                 MOV       OP_2,#00H
                 MOV       OP_3,#00H
                 CALL      ADD_32
                 CALL      OP_TO_DAMS
TEN_CONV:        MOV       A,TEN_ASCII
                 JZ        ONE_CONV
```

```
                MOV     DPTR,#N00
                MOVC    A,@A+DPTR
                MOV     OP_0,A
                MOV     OP_1,#00H
                MOV     OP_2,#00H
                MOV     OP_3,#00H
                CALL    ADD_32
                CALL    OP_TO_DAMS
ONE_CONV:       MOV     A,ONE_ASCII
                JZ      CONV_DONE
                MOV     OP_0,A
                MOV     OP_1,#00H
                MOV     OP_2,#00H
                MOV     OP_3,#00H
                CALL    ADD_32
CONV_DONE:      RET
;
;
;ORG  ASCII_TO_BINARY_TABLE
;               DB      01H     ;Needed to make next OH
TEN_THOUSAND:;
N00000_MSB:     DB      000H
N00000_BSB:     DB      000H
N00000_LSB:     DB      000H
N10000_MSB:     DB      000H
N10000_BSB:     DB      027H
N10000_LSB:     DB      010H
N20000_MSB:     DB      000H
N20000_BSB:     DB      04EH
N20000_LSB:     DB      020H
N30000_MSB:     DB      000H
N30000_BSB:     DB      053H
N30000_LSB:     DB      030H
N40000_MSB:     DB      000H
N40000_BSB:     DB      05CH
N40000_LSB:     DB      040H
N50000_MSB:     DB      000H
N50000_BSB:     DB      063H
N50000_LSB:     DB      050H
N60000_MSB:     DB      000H
N60000_BSB:     DB      0EAH
N60000_LSB:     DB      060H
N70000_MSB:     DB      001H
N70000_BSB:     DB      011H
N70000_LSB:     DB      070H
N80000_MSB:     DB      001H
N80000_BSB:     DB      038H
N80000_LSB:     DB      080H
N90000_MSB:     DB      001H
N90000_BSB:     DB      05FH
N90000_LSB:     DB      090H
;
;
THOUSAND:       ;
N0000_MSB:      DB      000H
N0000_LSB:      DB      000H
N1000_MSB:      DB      003H
N1000_LSB:      DB      0E8H
N2000_MSB:      DB      007H
N2000_LSB:      DB      0D0H
N3000_MSB:      DB      00BH
N3000_LSB:      DB      0B8H
N4000_MSB:      DB      0A0H
N4000_LSB:      DB      00FH
N5000_MSB:      DB      013H
N5000_LSB:      DB      088H
N6000_MSB:      DB      017H
N6000_LSB:      DB      070H
N7000_MSB:      DB      01BH
N7000_LSB:      DB      058H
N8000_MSB:      DB      01FH
N8000_LSB:      DB      040H
```

```
N9000_MSB:      DB      023H
N9000_LSB:      DB      028H
;
HUNDRED:;
N000_MSB:       DB      000H
N000_LSB:       DB      000H
N100_MSB:       DB      000H
N100_LSB:       DB      064H
N200_MSB:       DB      000H
N200_LSB:       DB      0C8H
N300_MSB:       DB      001H
N300_LSB:       DB      02CH
N400_MSB:       DB      001H
N400_LSB:       DB      090H
N500_MSB:       DB      001H
N500_LSB:       DB      0F4H
N600_MSB:       DB      002H
N600_LSB:       DB      058H
N700_MSB:       DB      002H
N700_LSB:       DB      0BCH
N800_MSB:       DB      003H
N800_LSB:       DB      020H
N900_MSB:       DB      003H
N900_LSB:       DB      084H
;
TEN:;
N00:            DB      00H     ;00D 4
N10:            DB      0AH     ;10D 5
N20:            DB      14H     ;20D 6
N30:            DB      1EH     ;30D 7
N40:            DB      28H     ;40D 8
N50:            DB      32H     ;50D 9
N60:            DB      3CH     ;60D a
N70:            DB      46H     ;70D b
N80:            DB      50H     ;80D c
N90:            DB      5AH     ;90D d
;************UNDER CONSTRICTION*********************
;    HEX NUMBER TO CONVERT TO ASCII
;
;       OP_0 = LOW BYTE  OF HEX NUMBER
;       OP_1 = MID_LOW   OF HEX NUMBER
;       OP_2 = MID_HIGH  OF HEX NUMBER
;       OP_3 = HIGH BYTE OF HEX NUMBER
;
;    ASCII NUMBER RETURNED AS FOLLOWS   LIMITED TO 99999 ASCII
;
;       ONE_ASCII
;       TEN_ASCII.
;       HUNDRED_ASCII
;       THOU_ASCII
;       TEN_THOU_ASCII
        THOU_ASCII      DATA            63H;63H
        TEN_THOU_ASCII  DATA            64H;5FH
;
;       THE CALLING ROUTINE WILL LOAD OP_0 THRU OP_3
;       WITH HEX NUMBER TO BE CONVERTED
;
;*****************************************************
; THIS ROUTINE COPIES THE OP REGS. TO DAMS REGS.
;
OP_TO_DAMS:     MOV     DAMS_0,OP_0
                MOV     DAMS_1,OP_1
                MOV     DAMS_2,OP_2
                MOV     DAMS_3,OP_3
                RET
;
SAVE_OP_A:      MOV     10H,OP_0
                MOV     11H,OP_1
                MOV     12H,OP_2
                MOV     13H,OP_3
                RET
```

```
;
SAVE_OP_B:      MOV     14H,OP_0
                MOV     15H,OP_1
                MOV     16H,OP_2
                MOV     17H,OP_3
                RET
;
GET_OP_A:       MOV     OP_0,10H
                MOV     OP_1,11H
                MOV     OP_2,12H
                MOV     OP_3,13H
                RET
;
GET_OP_B:       MOV     OP_0,14H
                MOV     OP_1,15H
                MOV     OP_2,16H
                MOV     OP_3,17H
                RET
;
;
HEX_ASCII:      MOV     ONE_ASCII,#00H  ;CLEAR
                MOV     TEN_ASCII,#00H  ;CLEAR
                MOV     HUNDRED_ASCII,#00H  ;CLEAR
                MOV     THOU_ASCII,#00H  ;CLEAR
                MOV     TEN_THOU_ASCII,#00H
                CALL    SAVE_OP_A       ;       NUMBER  (SAVE_OP_A)
                CALL    LOAD_DAMS_0AH   ;       DIVISOR   (LOAD_DAMS_0AH)
                CALL    DIV_16          ;       NUMBER/0AH = Q1= OP
                CALL    SAVE_OP_B       ;       SAVE Q1  (SAVE_OP_B)
                CALL    TEST_OP_FOR_0   ;       IS Q1 = 0
                JNC     ONE_MORE        ;       IF 0 THEN SET CARRY FLAG
;                                       ;       AND LOAD ONE_ASCII WITH
                CALL    GET_OP_A
                MOV     A,OP_0
                ADD     A,#30H
                MOV     ONE_ASCII,A
                MOV     TEN_ASCII,#20H
                MOV     HUNDRED_ASCII,#20H
                MOV     THOU_ASCII,#20H
                MOV     TEN_THOU_ASCII,#20H
                LJMP    HEX_ASCII_DONE
;                                       ;       NUMBER AND DONE
;                                       ;       IF NOT ZERO THEN
ONE_MORE:       CALL    GET_OP_B        ;       GET Q1 (GET_OP_B)
                CALL    LOAD_DAMS_0AH   ;       MENU    (LOAD_DAMS_0AH)
                CALL    MUL_16          ;       Q1 X 0AH = PRODUCT=OP
                CALL    OP_TO_DAMS      ;       SAVE PRODUCT IN DAMS
                CALL    GET_OP_A        ;       GET NUMBER (GET_OP_A)
                CALL    SUB_32          ;       NUMBER - PRODUCT = OP
                MOV     A,OP_0          ;       SET UPPER NIB TO 3
                ADD     A,#30H          ;       LOAD ONE_ASCII
                MOV     ONE_ASCII,A     ;
;
                CALL    GET_OP_B        ;       Q1 TO OP
                CALL    LOAD_DAMS_0AH   ;       DIVISOR = 0AH
                CALL    DIV_16          ;       Q1 / 0A = Q2
                CALL    SAVE_OP_A       ;       SAVE Q2 IN OP_A
                CALL    TEST_OP_FOR_0   ;       IF Q1 = 0 THEN
                JNC     TEN_MORE        ;       SAVE Q1 (OP_B) TO TEN_ASCII
;
                CALL    GET_OP_B
                MOV     A,OP_0
                ADD     A,#30H
                MOV     TEN_ASCII,A
                MOV     HUNDRED_ASCII,#20H
                MOV     THOU_ASCII,#20H
                MOV     TEN_THOU_ASCII,#20H
                LJMP    HEX_ASCII_DONE
;
TEN_MORE:       CALL    GET_OP_A        ;       GET Q2 (GET_OP_A)
                CALL    LOAD_DAMS_0AH   ;       MENU    (LOAD_DAMS_0AH)
                CALL    MUL_16          ;       Q2 X 0AH = PRODUCT=OP
```

```
                CALL    OP_TO_DAMS      ;       SAVE PRODUCT IN DAMS
                CALL    GET_OP_B        ;       GET Q1 (GET_OP_B)
                CALL    SUB_32          ;       Q1 - PRODUCT = OP
                MOV     A,OP_0          ;       SET UPPER NIB TO 3
                ADD     A,#30H          ;       LOAD TEN_ASCII
                MOV     TEN_ASCII,A     ;
;
                CALL    GET_OP_A        ;       Q2 TO OP
                CALL    LOAD_DAMS_0AH   ;       DIVISOR = 0AH
                CALL    DIV_16          ;       Q2 / 0A = Q3
                CALL    SAVE_OP_B       ;       SAVE Q3 IN OP_A
                CALL    TEST_OP_FOR_0   ;       IF Q3 = 0 THEN
                JNC      HUN_MORE       ;       SAVE Q2 (OP_A) TO HUN_ASCII
;
                CALL    GET_OP_A
                MOV     A,OP_0
                ADD     A,#30H
                MOV     HUNDRED_ASCII,A
                MOV     THOU_ASCII,#20H
                MOV     TEN_THOU_ASCII,#20H
                LJMP    HEX_ASCII_DONE
;
HUN_MORE:       CALL    GET_OP_B        ;       GET Q3 (GET_OP_A)
                CALL    LOAD_DAMS_0AH   ;       MENU    (LOAD_DAMS_0AH)
                CALL    MUL_16          ;       Q3 X 0AH = PRODUCT=OP
                CALL    OP_TO_DAMS      ;       SAVE PRODUCT IN DAMS
                CALL    GET_OP_A        ;       GET Q2 (GET_OP_A)
                CALL    SUB_32          ;       Q2 - PRODUCT = OP
                MOV     A,OP_0          ;       SET UPPER NIB TO 3
                ADD     A,#30H          ;       LOAD HUN_ASCII
                MOV     HUNDRED_ASCII,A     ;
;
                CALL    GET_OP_B        ;       Q3 TO OP
                CALL    LOAD_DAMS_0AH   ;       DIVISOR = 0AH
                CALL    DIV_16          ;       Q3 / 0A = Q4
                CALL    SAVE_OP_A       ;       SAVE Q4 IN OP_A
                CALL    TEST_OP_FOR_0   ;       IF Q4 = 0 THEN
                JNC      THOU_MORE       ;       SAVE Q3 (OP_A) TO HUN_ASCII
;
                CALL    GET_OP_B
                MOV     A,OP_0
                ADD     A,#30H
                MOV     THOU_ASCII,A
                MOV     TEN_THOU_ASCII,#20H
                LJMP    HEX_ASCII_DONE
;
THOU_MORE:      CALL    GET_OP_A        ;       GET Q4 (GET_OP_A)
                CALL    LOAD_DAMS_0AH   ;       MENU    (LOAD_DAMS_0AH)
                CALL    MUL_16          ;       Q4 X 0AH = PRODUCT=OP
                CALL    OP_TO_DAMS      ;       SAVE PRODUCT IN DAMS
                CALL    GET_OP_B        ;       GET Q3 (GET_OP_A)
                CALL    SUB_32          ;       Q3 - PRODUCT = OP
                MOV     A,OP_0          ;       SET UPPER NIB TO 3
                ADD     A,#30H          ;       LOAD THOU_ASCII
                MOV     THOU_ASCII,A    ;
;
                CALL    GET_OP_A        ;       Q3 TO OP
                CALL    LOAD_DAMS_0AH   ;       DIVISOR = 0AH
                CALL    DIV_16          ;       Q3 / 0A = Q4
                CALL    SAVE_OP_B       ;       SAVE Q4 IN OP_A
                CALL    TEST_OP_FOR_0   ;       IF Q4 = 0 THEN
                JC      TEN_THOU_MORE    ;       SAVE Q3 (OP_A) TO
;                                               TEN_THOU_ASCII
                CALL    GET_OP_A
                MOV     A,OP_0
                ADD     A,#30H
                MOV     TEN_THOU_ASCII,A
                LJMP    HEX_ASCII_DONE
;
TEN_THOU_MORE:  CALL    GET_OP_B        ;       GET Q4 (GET_OP_A)
                CALL    LOAD_DAMS_0AH   ;       MENU    (LOAD_DAMS_0AH)
                CALL    MUL_16          ;       Q4 X 0AH = PRODUCT=OP
```

```
                CALL    OP_TO_DAMS          ;       SAVE PRODUCT IN DAMS
                CALL    GET_OP_A            ;       GET Q3 (GET_OP_A)
                CALL    SUB_32              ;       Q3 - PRODUCT = OP
                MOV     A,OP_0              ;       SET UPPER NIB TO 3
                ADD     A,#30H              ;       LOAD TEN_THOU_ASCII
                MOV     TEN_THOU_ASCII,A        ;
HEX_ASCII_DONE: RET
;
LOAD_DAMS_0AH:  MOV     DAMS_0,#0AH         ;0AH
                MOV     DAMS_1,#00H         ;00H
                MOV     DAMS_2,#0AH         ;00H
                MOV     DAMS_3,#00H         ;00H
                RET
;
;
TEST_OP_FOR_0:  CLR     C
                MOV     A,OP_0
                JNZ     NOT_ZERO
                MOV     A,OP_1
                JNZ     NOT_ZERO
                MOV     A,OP_2
                JNZ     NOT_ZERO
                MOV     A,OP_3
                JNZ     NOT_ZERO
                SETB    C
                RET
NOT_ZERO:       CLR     C
                RET
                END
$ep (asm.err)
$DEBUG
$XR SB DB
$NOMOD51
;$NOLIST
NAME RTCSCH
$TITLE(RTCSCH.A51)
$NOGE
$INCLUDE(REG52.PDF)
;
CSEG    AT      3D00H
;
PUBLIC  TIMER1_INTR,TIMER1_SETUP
PUBLIC  SPEED_OUT_FLAG,SPEED_ENABLE_FLAG,MOTOR_CLK
PUBLIC  INIT_PEROID_1,PEROID_1_FLAG,GEN_PEROID_1,PEROID_1_LAST_FLAG
PUBLIC  PEROID_1_CYCLE,PEROID_1_REMAINDER
PUBLIC  JOG_FLAG
EXTRN   CODE(MOT_0_INTR,DISP_DVR,KEY_SCAN)
EXTRN   BIT(DISP_DVR_FLAG)
EXTRN   DATA(TEMP_MEM,MOT_0_LOW,MOT_0_HIGH,MOT_1_LOW,MOT_1_HIGH)
;               TIMER1_SERVICE          EQU     03F00H
;
;       INTERRUPT VARIBLES AND BITS
                DVR_ADDR                EQU     2A00H
                LOW_DVR_MEM             EQU     00H
                HIGH_DVR_MEM            EQU     10H
                INTR_DVR_FLAGS          DATA    27H
                HUN_MS_COUNTER          DATA    3FH
                TEN_MS_FLAG             BIT     3AH     ;WAS T_TOGGLE
;               DISP_DVR_FLAG           BIT     3BH
                ONE_MS_FLAG             BIT     3CH     ;WAS IN_DVR_FLAG
                DVR_BUSY_FLAG           BIT     3DH
;               DISP_UPDATE_FLAG        BIT     28H.7
                SPEED_OUT_FLAG          BIT     2AH.6; IN RTCSCH.A51
                SPEED_ENABLE_FLAG       BIT     28H.7  ; IN RTCSCH.A51
                PEROID_1_FLAG           BIT     26H.4
                GEN_PEROID_1            BIT     26H.5
                PEROID_1_LAST_FLAG      BIT     26H.6
                MOTOR_CLK               BIT     29H.7
                JOG_FLAG                BIT     24H.3
;
;
                TEN_MS_COUNTER          DATA    3EH;50H
```

```
                ONE_MS_COUNTER          DATA    3DH;7FH
                PEROID_1_CNT            DATA    40H;6AH
                PEROID_1_CYCLE          DATA    41H;6BH
                PEROID_1_REMAINDER      DATA    42H;6CH
                JOG_COUNTER             DATA    4AH
;
                ONE_MS_PEROID           EQU     05H
                TEN_MS_PEROID           EQU     00AH; Was 006H WAS 21H
                HUN_MS_PEROID           EQU     032H; WAS 0FFH, WAS 64H 500ms
                JOG_PEROID              EQU     11H; 3.5MS
;
TIMER1_SETUP:   MOV     TH1,#06H                ;200uS #06H
                MOV     TL1,#06H                ;200uS #06H
                MOV     TMOD,#20H               ;
                MOV     IE,#88H ;WAS #88H THEN #8DH
;               MOV     IP,#08H
                MOV     TCON,#45H               ;
                MOV     ONE_MS_COUNTER,#ONE_MS_PEROID
                MOV     TEN_MS_COUNTER,#TEN_MS_PEROID
                MOV     HUN_MS_COUNTER,#HUN_MS_PEROID
                MOV     JOG_COUNTER,#JOG_PEROID
                CLR     JOG_FLAG
                RET
;
TIMER1_INTR:    CLR     TF1
                DJNZ    JOG_COUNTER,ONE_MS
                SETB    JOG_FLAG
                MOV     JOG_COUNTER,#JOG_PEROID
ONE_MS:         DJNZ    ONE_MS_COUNTER,CHECK_FLAGS
                MOV     ONE_MS_COUNTER,#ONE_MS_PEROID
                CPL     P1.1
                JB      SPEED_OUT_FLAG,PEROID_1_PASS
                JNB     GEN_PEROID_1,PEROID_1_PASS
                SETB    PEROID_1_FLAG
                CLR     P1.0
                DJNZ    PEROID_1_CNT,PEROID_1_PASS
                DJNZ    PEROID_1_CYCLE,PEROID_1_PASS
                JB      PEROID_1_LAST_FLAG,PEROID_1_END
                SETB    PEROID_1_LAST_FLAG
                MOV     PEROID_1_CNT,PEROID_1_REMAINDER
                MOV     PEROID_1_CYCLE,#01H
                LJMP    PEROID_1_PASS
PEROID_1_END:   SETB    SPEED_OUT_FLAG
                CLR     PEROID_1_FLAG
                CLR     PEROID_1_LAST_FLAG
                SETB    P1.0
PEROID_1_PASS:  ;SETB   MOTOR_CLK
;               CLR     P1.0
;               CLR     P3.2
;               CLR     P3.3
;               SETB    P3.2
;               SETB    P3.3
;               SETB    P1.0
TEN_MS:         DJNZ    TEN_MS_COUNTER,CHECK_FLAGS
                MOV     TEN_MS_COUNTER,#TEN_MS_PEROID   ;
                SETB    TEN_MS_FLAG
                DJNZ    HUN_MS_COUNTER,CHECK_FLAGS
                MOV     HUN_MS_COUNTER,#HUN_MS_PEROID
CHECK_FLAGS:    JB      DISP_DVR_FLAG,CALL_DISP_DVR
CHECK_DVR_FLAG: JB      DVR_BUSY_FLAG,INTR_END
                SETB    DVR_BUSY_FLAG
                CLR     EA                      ;INTERRUPT OFF
                MOV     TEMP_MEM,#LOW DRIVER    ;REPLACED DVR_ADDR
                PUSH    TEMP_MEM                ;THIS LOADS POINTER
                MOV     TEMP_MEM,#HIGH DRIVER
                PUSH    TEMP_MEM                ;DRIVER ROUTINE
                SETB    EA                      ;INTERRUPT ON
INTR_END:       RETI
;
;
CALL_DISP_DVR:  CALL    DISP_DVR
                LJMP    CHECK_DVR_FLAG
```

```
;
;*****************************************************************
DRIVER:          PUSH    ACC
                 PUSH    DPL
                 PUSH    DPH
                 PUSH    PSW
                 MOV     PSW,#08H
                 CALL    KEY_SCAN
                 POP     PSW
                 POP     DPH
                 POP     DPL
                 POP     ACC
                 CLR     DVR_BUSY_FLAG
                 RET
;
INIT_PEROID_1:   CLR     PEROID_1_FLAG
                 CLR     PEROID_1_LAST_FLAG
                 MOV     PEROID_1_CNT,#00H
                 MOV     MOT_0_LOW,#00H
                 MOV     MOT_0_HIGH,#00H
                 MOV     MOT_1_LOW,#00H
                 MOV     MOT_1_HIGH,#00H
                 SETB    GEN_PEROID_1
                 RET
END

$ep (asm.err)
$DEBUG
$XR SB DB
$NOMOD51
;$NOLIST
NAME SCDATA
$TITLE(SCDATA.A51)
$NOGE
$INCLUDE(REG52.PDF)
;
CSEG     AT      2C00H
PUBLIC   SIN_DATA,COS_DATA,SIN_000_MSB,SIN_360_MSB,SIN_000_LSB
PUBLIC   INIT_SC_DATA,SIN_TAB_MSB
EXTRN    DATA(XDATA_M0_LOW)
;
SC_DATA          DATA    20H
XDATA_M0_HIGH       DATA    31H:70H
;
DATA_BIT_0   BIT     20H.0
DATA_BIT_1   BIT     20H.1
DATA_BIT_2   BIT     20H.2
DATA_BIT_3   BIT     20H.3
DATA_BIT_4   BIT     20H.4
DATA_BIT_5   BIT     20H.5
DATA_BIT_6   BIT     20H.6
DATA_BIT_7   BIT     20H.7
;
SIN_ADDR_DPH     DATA    21H
SIN_ADDR_DPL     DATA    22H
COS_ADDR_DPH     DATA    23H
COS_ADDR_DPL     DATA    24H
REV_SIN_MSB      DATA    25H
REV_SIN_LSB      DATA    26H
REV_COS_MSB      DATA    27H
REV_COS_LSB      DATA    28H
JOB_IS_DONE      BIT     29H.0
;
SIN_TAB_MSB      EQU     2CH
SIN_TAB_LSB      EQU     2DH
COS_TAB_MSB      EQU     2EH
COS_TAB_LSB      EQU     2FH
;
ORG              2C00H
INIT_SC_DATA:    CLR     JOB_IS_DONE
                 MOV     XDATA_M0_HIGH,#HIGH SIN_DATA
                 MOV     XDATA_M0_LOW,#00H
```

```
                MOV     SIN_ADDR_DPH,#HIGH SIN_DATA
                MOV     SIN_ADDR_DPL,#LOW SIN_DATA
                MOV     COS_ADDR_DPH,#HIGH COS_DATA
                MOV     COS_ADDR_DPL,#LOW COS_DATA
NEXT_DATA:      MOV     DPH,SIN_ADDR_DPH
                MOV     DPL,SIN_ADDR_DPL
                MOV     A,#00H
                MOVC    A,@A+DPTR
                CALL    ROTATE_ACC
                MOV     REV_SIN_MSB,SC_DATA     ;bit data
                INC     DPTR
                MOV     A,#00H
                MOVC    A,@A+DPTR
                CALL    ROTATE_ACC
                MOV     REV_SIN_LSB,SC_DATA
                CLR     C                       ;NEW START
                MOV     A,REV_SIN_MSB
                RLC     A
                CPL     ACC.1
                MOV     REV_SIN_MSB,A
                MOV     A,REV_SIN_LSB
                RLC     A
                CPL     ACC.1
                MOV     REV_SIN_LSB,A   ;NEW END
                MOV     A,#LOW SIN_360_LSB
                CJNE    A,DPL,CONTINUE
                SETB    JOB_IS_DONE
CONTINUE:       INC     DPTR
                MOV     SIN_ADDR_DPH,DPH
                MOV     SIN_ADDR_DPL,DPL
;
                MOV     DPH,COS_ADDR_DPH
                MOV     DPL,COS_ADDR_DPL
                MOV     A,#00H
                MOVC    A,@A+DPTR
                CALL    ROTATE_ACC
                MOV     REV_COS_MSB,SC_DATA     ;bit data
                INC     DPTR
                MOV     A,#00H
                MOVC    A,@A+DPTR
                CALL    ROTATE_ACC
                MOV     REV_COS_LSB,SC_DATA
                CLR     C                       ;NEW START
                MOV     A,REV_COS_MSB
                RLC     A
                CPL     ACC.1
                MOV     REV_COS_MSB,A
                MOV     A,REV_COS_LSB
                RLC     A
                CPL     ACC.1
                MOV     REV_COS_LSB,A   ;NEW END
                INC     DPTR
                MOV     COS_ADDR_DPH,DPH
                MOV     COS_ADDR_DPL,DPL
                MOV     DPH,#SIN_TAB_MSB        ;NEW
                MOV     DPL,XDATA_MO_LOW
                MOV     A,REV_SIN_MSB
                MOVX    @DPTR,A
                MOV     DPH,#SIN_TAB_LSB        ;NEW
                MOV     A,REV_SIN_LSB
                MOVX    @DPTR,A
                MOV     DPH,#COS_TAB_MSB        ;NEW
                MOV     A,REV_COS_MSB
                MOVX    @DPTR,A
                MOV     DPH,#COS_TAB_LSB        ;NEW
                MOV     A,REV_COS_LSB
                MOVX    @DPTR,A
                INC     XDATA_MO_LOW            ;NEW
                JNB     JOB_IS_DONE,SHORT_NEXT_DATA
                RET
SHORT_NEXT_DATA:        LJMP    NEXT_DATA
;
```

```
;
;
ROTATE_ACC:     MOV     SC_DATA,#0FFH
BIT_0:          RLC     A
                JC      BIT_1
                CPL     DATA_BIT_0
BIT_1:          RLC     A
                JC      BIT_2
                CPL     DATA_BIT_1
BIT_2:          RLC     A
                JC      BIT_3
                CPL     DATA_BIT_2
BIT_3:          RLC     A
                JC      BIT_4
                CPL     DATA_BIT_3
BIT_4:          RLC     A
                JC      BIT_5
                CPL     DATA_BIT_4
BIT_5:          RLC     A
                JC      BIT_6
                CPL     DATA_BIT_5
BIT_6:          RLC     A
                JC      BIT_7
                CPL     DATA_BIT_6
BIT_7:          RLC     A
                JC      ROTATE_DONE
                CPL     DATA_BIT_7
ROTATE_DONE:    RET
;
SIN_DATA_TABLE          EQU     2E00H
;
                ORG     SIN_DATA_TABLE
SIN_DATA:
SIN_000_MSB:     DB     07FH     ;SHOULD BE 07FH
SIN_000_LSB:     DB     0FFH     ;SHOULD BE 0FFH
SIN_003_MSB:     DB     086H
SIN_003_LSB:     DB     0B1H
SIN_006_MSB:     DB     08BH
SIN_006_LSB:     DB     060H
SIN_009_MSB:     DB     094H
SIN_009_LSB:     DB     004H
SIN_012_MSB:     DB     09AH
SIN_012_LSB:     DB     09BH
SIN_015_MSB:     DB     0A1H
SIN_015_LSB:     DB     01FH
SIN_018_MSB:     DB     0A7H
SIN_018_LSB:     DB     08CH
SIN_021_MSB:     DB     0ADH
SIN_021_LSB:     DB     0DDH
SIN_024_MSB:     DB     0B4H
SIN_024_LSB:     DB     00EH
SIN_027_MSB:     DB     0BAH     ;WAS 06AH
SIN_027_LSB:     DB     01AH
SIN_030_MSB:     DB     0BFH     ;WAS 06FH
SIN_030_LSB:     DB     0FEH
SIN_033_MSB:     DB     0C5H
SIN_033_LSB:     DB     0B5H
SIN_036_MSB:     DB     0CBH
SIN_036_LSB:     DB     03AH
SIN_039_MSB:     DB     0D0H
SIN_039_LSB:     DB     08BH
SIN_042_MSB:     DB     0D5H
SIN_042_LSB:     DB     0A4H
SIN_045_MSB:     DB     0DAH
SIN_045_LSB:     DB     08CH
SIN_048_MSB:     DB     0DFH
SIN_048_LSB:     DB     01DH
SIN_051_MSB:     DB     0E3H
SIN_051_LSB:     DB     077H
SIN_054_MSB:     DB     0E7H
SIN_054_LSB:     DB     086H
SIN_057_MSB:     DB     0EBH
```

```
SIN_057_LSB:    DB    057H
SIN_060_MSB:    DB    0EEH
SIN_060_LSB:    DB    0D8H
SIN_063_MSB:    DB    0F2H
SIN_063_LSB:    DB    00AH
SIN_066_MSB:    DB    0F4H
SIN_066_LSB:    DB    0EDH
SIN_069_MSB:    DB    0F7H
SIN_069_LSB:    DB    07DH
SIN_072_MSB:    DB    0F9H
SIN_072_LSB:    DB    0BAH
SIN_075_MSB:    DB    0FBH
SIN_075_LSB:    DB    0A1H
SIN_078_MSB:    DB    0FDH
SIN_078_LSB:    DB    031H
SIN_081_MSB:    DB    0FEH
SIN_081_LSB:    DB    06AH
SIN_084_MSB:    DB    0FFH
SIN_084_LSB:    DB    04AH
SIN_087_MSB:    DB    0FFH
SIN_087_LSB:    DB    0D1H
SIN_090_MSB:    DB    0FFH
SIN_090_LSB:    DB    0FFH
SIN_093_MSB:    DB    0FFH
SIN_093_LSB:    DB    0D1H
SIN_096_MSB:    DB    0FFH
SIN_096_LSB:    DB    04AH
SIN_099_MSB:    DB    0FEH
SIN_099_LSB:    DB    06AH
SIN_102_MSB:    DB    0FDH
SIN_102_LSB:    DB    031H
SIN_105_MSB:    DB    0FBH
SIN_105_LSB:    DB    0A1H
SIN_108_MSB:    DB    0F9H
SIN_108_LSB:    DB    0BAH
SIN_111_MSB:    DB    0F7H
SIN_111_LSB:    DB    07DH
SIN_114_MSB:    DB    0F4H
SIN_114_LSB:    DB    0EDH
SIN_117_MSB:    DB    0F2H
SIN_117_LSB:    DB    00AH
SIN_120_MSB:    DB    0EEH
SIN_120_LSB:    DB    0D8H
SIN_123_MSB:    DB    0EEH
SIN_123_LSB:    DB    057H
SIN_126_MSB:    DB    0E7H
SIN_126_LSB:    DB    06CH
SIN_129_MSB:    DB    0E3H
SIN_129_LSB:    DB    077H
SIN_132_MSB:    DB    0DFH
SIN_132_LSB:    DB    010H
SIN_135_MSB:    DB    0DAH
SIN_135_LSB:    DB    080H
SIN_138_MSB:    DB    0D5H
SIN_138_LSB:    DB    0A4H
SIN_141_MSB:    DB    0D0H
SIN_141_LSB:    DB    08BH
SIN_144_MSB:    DB    0CBH
SIN_144_LSB:    DB    03AH
SIN_147_MSB:    DB    0C5H
SIN_147_LSB:    DB    0B5H
SIN_150_MSB:    DB    0BFH    ;WAS 06FH
SIN_150_LSB:    DB    0FEH
SIN_153_MSB:    DB    0BAH    ;WAS 06AH
SIN_153_LSB:    DB    01AH
SIN_156_MSB:    DB    0B4H
SIN_156_LSB:    DB    00EH
SIN_159_MSB:    DB    0ADH
SIN_159_LSB:    DB    0DDH
SIN_162_MSB:    DB    0A7H
SIN_162_LSB:    DB    08CH
SIN_165_MSB:    DB    0A1H
```

```
SIN_165_LSB:    DB    01FH
SIN_168_MSB:    DB    09AH
SIN_168_LSB:    DB    09BH
SIN_171_MSB:    DB    094H
SIN_171_LSB:    DB    004H
SIN_174_MSB:    DB    08BH
SIN_174_LSB:    DB    060H
SIN_177_MSB:    DB    086H
SIN_177_LSB:    DB    0B1H
SIN_180_MSB:    DB    07FH
SIN_180_LSB:    DB    0FFH
SIN_183_MSB:    DB    079H
SIN_183_LSB:    DB    0D4H
SIN_021_MSB:    DB    0ADH
SIN_021_LSB:    DB    0DDH
SIN_024_MSB:    DB    0B4H
SIN_024_LSB:    DB    00EH
SIN_027_MSB:    DB    0BAH    ;WAS 06AH
SIN_027_LSB:    DB    01AH
SIN_030_MSB:    DB    0BFH    ;WAS 06FH
SIN_030_LSB:    DB    0FEH
SIN_033_MSB:    DB    0C5H
SIN_033_LSB:    DB    0B5H
SIN_036_MSB:    DB    0CBH
SIN_036_LSB:    DB    03AH
SIN_039_MSB:    DB    0D0H
SIN_039_LSB:    DB    08BH
SIN_042_MSB:    DB    0D5H
SIN_042_LSB:    DB    0A4H
SIN_045_MSB:    DB    0DAH
SIN_045_LSB:    DB    08CH
SIN_048_MSB:    DB    0DFH
SIN_048_LSB:    DB    01DH
SIN_051_MSB:    DB    0E3H
SIN_051_LSB:    DB    077H
SIN_054_MSB:    DB    0E7H
SIN_054_LSB:    DB    086H
SIN_057_MSB:    DB    0EBH
SIN_057_LSB:    DB    057H
SIN_060_MSB:    DB    0EEH
SIN_060_LSB:    DB    0D8H
SIN_063_MSB:    DB    0F2H
SIN_063_LSB:    DB    00AH
SIN_066_MSB:    DB    0F4H
SIN_066_LSB:    DB    0EDH
SIN_069_MSB:    DB    0F7H
SIN_069_LSB:    DB    07DH
SIN_072_MSB:    DB    0F9H
SIN_072_LSB:    DB    0BAH
SIN_075_MSB:    DB    0FBH
SIN_075_LSB:    DB    0A1H
SIN_078_MSB:    DB    0FDH
SIN_078_LSB:    DB    031H
SIN_081_MSB:    DB    0FEH
SIN_081_LSB:    DB    06AH
SIN_084_MSB:    DB    0FFH
SIN_084_LSB:    DB    04AH
SIN_087_MSB:    DB    0FFH
SIN_087_LSB:    DB    0D1H
SIN_090_MSB:    DB    0FFH
SIN_090_LSB:    DB    0FFH
SIN_093_MSB:    DB    0FFH
SIN_093_LSB:    DB    0D1H
SIN_096_MSB:    DB    0FFH
SIN_096_LSB:    DB    04AH
SIN_099_MSB:    DB    0FEH
SIN_099_LSB:    DB    06AH
SIN_102_MSB:    DB    0FDH
SIN_102_LSB:    DB    031H
SIN_105_MSB:    DB    0FBH
SIN_105_LSB:    DB    0A1H
```

```
SIN_108_MSB:    DB    0F9H
SIN_108_LSB:    DB    0BAH
SIN_111_MSB:    DB    0F7H
SIN_111_LSB:    DB    07DH
SIN_114_MSB:    DB    0F4H
SIN_114_LSB:    DB    0EDH
SIN_117_MSB:    DB    0F2H
SIN_117_LSB:    DB    00AH
SIN_120_MSB:    DB    0EEH
SIN_120_LSB:    DB    0D8H
SIN_123_MSB:    DB    0EBH
SIN_123_LSB:    DB    057H
SIN_126_MSB:    DB    0E7H
SIN_126_LSB:    DB    08CH
SIN_129_MSB:    DB    0E3H
SIN_129_LSB:    DB    077H
SIN_132_MSB:    DB    0DFH
SIN_132_LSB:    DB    010H
SIN_135_MSB:    DB    0DAH
SIN_135_LSB:    DB    080H
SIN_138_MSB:    DB    0D5H
SIN_138_LSB:    DB    0A4H
SIN_141_MSB:    DB    0D0H
SIN_141_LSB:    DB    08BH
SIN_144_MSB:    DB    0CBH
SIN_144_LSB:    DB    03AH
SIN_147_MSB:    DB    0C5H
SIN_147_LSB:    DB    0B5H
SIN_150_MSB:    DB    0BFH    ;WAS 06FH
SIN_150_LSB:    DB    0FEH
SIN_153_MSB:    DB    0BAH    ;WAS 06AH
SIN_153_LSB:    DB    01AH
SIN_156_MSB:    DB    0B4H
SIN_156_LSB:    DB    00EH
SIN_159_MSB:    DB    0ADH
SIN_159_LSB:    DB    0DDH
SIN_162_MSB:    DB    0A7H
SIN_162_LSB:    DB    08CH
SIN_165_MSB:    DB    0A1H
SIN_165_LSB:    DB    01FH
SIN_168_MSB:    DB    09AH
SIN_168_LSB:    DB    09BH
SIN_171_MSB:    DB    094H
SIN_171_LSB:    DB    004H
SIN_174_MSB:    DB    08BH
SIN_174_LSB:    DB    060H
SIN_177_MSB:    DB    086H
SIN_177_LSB:    DB    0B1H
SIN_180_MSB:    DB    07FH
SIN_180_LSB:    DB    0FFH
SIN_183_MSB:    DB    079H
SIN_183_LSB:    DB    0D4H
SIN_186_MSB:    DB    072H
SIN_186_LSB:    DB    09EH
SIN_189_MSB:    DB    06BH
SIN_189_LSB:    DB    0FAH
SIN_192_MSB:    DB    065H
SIN_192_LSB:    DB    063H
SIN_195_MSB:    DB    05EH
SIN_195_LSB:    DB    0DFH
SIN_198_MSB:    DB    058H
SIN_198_LSB:    DB    072H
SIN_201_MSB:    DB    052H
SIN_201_LSB:    DB    021H
SIN_204_MSB:    DB    04BH
SIN_204_LSB:    DB    0F0H
SIN_207_MSB:    DB    045H
SIN_207_LSB:    DB    0E4H
SIN_210_MSB:    DB    040H
SIN_210_LSB:    DB    000H
SIN_213_MSB:    DB    03AH
SIN_213_LSB:    DB    049H
```

```
SIN_216_MSB:    DB    034H
SIN_216_LSB:    DB    0C4H
SIN_219_MSB:    DB    02FH
SIN_219_LSB:    DB    073H
SIN_222_MSB:    DB    02AH
SIN_222_LSB:    DB    05AH
SIN_225_MSB:    DB    025H
SIN_225_LSB:    DB    07EH
SIN_228_MSB:    DB    020H
SIN_228_LSB:    DB    0E1H
SIN_231_MSB:    DB    01CH
SIN_231_LSB:    DB    087H
SIN_234_MSB:    DB    018H
SIN_234_LSB:    DB    072H
SIN_237_MSB:    DB    014H
SIN_237_LSB:    DB    0A7H
SIN_240_MSB:    DB    011H
SIN_240_LSB:    DB    026H
SIN_243_MSB:    DB    00DH
SIN_243_LSB:    DB    0F4H
SIN_246_MSB:    DB    00BH
SIN_246_LSB:    DB    011H
SIN_249_MSB:    DB    008H
SIN_249_LSB:    DB    081H
SIN_252_MSB:    DB    006H
SIN_252_LSB:    DB    044H
SIN_255_MSB:    DB    004H
SIN_255_LSB:    DB    05DH
SIN_258_MSB:    DB    002H
SIN_258_LSB:    DB    0CDH
SIN_261_MSB:    DB    001H
SIN_261_LSB:    DB    094H
SIN_264_MSB:    DB    000H
SIN_264_LSB:    DB    0B4H
SIN_267_MSB:    DB    000H
SIN_267_LSB:    DB    0D2H
SIN_270_MSB:    DB    000H
SIN_270_LSB:    DB    000H
SIN_273_MSB:    DB    000H
SIN_273_LSB:    DB    0DDH
SIN_276_MSB:    DB    000H
SIN_276_LSB:    DB    0B4H
SIN_279_MSB:    DB    001H
SIN_279_LSB:    DB    094H
SIN_282_MSB:    DB    002H
SIN_282_LSB:    DB    0CDH
SIN_285_MSB:    DB    004H
SIN_285_LSB:    DB    05DH
SIN_288_MSB:    DB    006H
SIN_288_LSB:    DB    044H
SIN_291_MSB:    DB    008H
SIN_291_LSB:    DB    081H
SIN_294_MSB:    DB    00BH
SIN_294_LSB:    DB    011H
SIN_297_MSB:    DB    00DH
SIN_297_LSB:    DB    0F4H
SIN_300_MSB:    DB    011H
SIN_300_LSB:    DB    026H
SIN_303_MSB:    DB    014H
SIN_303_LSB:    DB    0A7H
SIN_306_MSB:    DB    018H
SIN_306_LSB:    DB    072H
SIN_309_MSB:    DB    01CH
SIN_309_LSB:    DB    087H
SIN_312_MSB:    DB    020H
SIN_312_LSB:    DB    0E1H
SIN_315_MSB:    DB    025H
SIN_315_LSB:    DB    07EH
SIN_318_MSB:    DB    02AH
SIN_318_LSB:    DB    05AH
SIN_321_MSB:    DB    02FH
SIN_321_LSB:    DB    073H
```

```
SIN_324_MSB:      DB      034H
SIN_324_LSB:      DB      0C4H
SIN_327_MSB:      DB      03AH

SIN_327_LSB:      DB      049H
SIN_330_MSB:      DB      040H
SIN_330_LSB:      DB      000H
SIN_333_MSB:      DB      045H
SIN_333_LSB:      DB      0E4H
SIN_336_MSB:      DB      04BH
SIN_336_LSB:      DB      0F0H
SIN_339_MSB:      DB      052H
SIN_339_LSB:      DB      021H
SIN_342_MSB:      DB      058H
SIN_342_LSB:      DB      072H
SIN_345_MSB:      DB      05EH
SIN_345_LSB:      DB      0DFH
SIN_348_MSB:      DB      065H
SIN_348_LSB:      DB      063H
SIN_351_MSB:      DB      06BH
SIN_351_LSB:      DB      0FAH
SIN_354_MSB:      DB      072H
SIN_354_LSB:      DB      09EH
SIN_357_MSB:      DB      079H
SIN_357_LSB:      DB      04DH
SIN_360_MSB:      DB      07FH
SIN_360_LSB:      DB      0FFH
;
COS_DATA_TABLE  EQU       2F00H
                ORG       COS_DATA_TABLE
COS_DATA:
COS_090_MSB:      DB      0FFH
COS_090_LSB:      DB      0FFH
COS_093_MSB:      DB      0FFH
COS_093_LSB:      DB      0D1H
COS_096_MSB:      DB      0FFH
COS_096_LSB:      DB      04AH
COS_099_MSB:      DB      0FEH
COS_099_LSB:      DB      06AH
COS_102_MSB:      DB      0FDH
COS_102_LSB:      DB      031H
COS_105_MSB:      DB      0FBH
COS_105_LSB:      DB      0A1H
COS_108_MSB:      DB      0F9H
COS_108_LSB:      DB      0BAH
COS_111_MSB:      DB      0F7H
COS_111_LSB:      DB      07DH
COS_114_MSB:      DB      0F4H
COS_114_LSB:      DB      0EDH
COS_117_MSB:      DB      0F2H
COS_117_LSB:      DB      00AH
COS_120_MSB:      DB      0EEH
COS_120_LSB:      DB      0D8H
COS_123_MSB:      DB      0EBH
COS_123_LSB:      DB      057H
COS_126_MSB:      DB      0E7H
COS_126_LSB:      DB      08CH
COS_129_MSB:      DB      0E3H
COS_129_LSB:      DB      077H
COS_132_MSB:      DB      0DFH
COS_132_LSB:      DB      010H
COS_135_MSB:      DB      0DAH
COS_135_LSB:      DB      080H
COS_138_MSB:      DB      0D5H
COS_138_LSB:      DB      0A4H
COS_141_MSB:      DB      0D0H
COS_141_LSB:      DB      08BH
COS_144_MSB:      DB      0CBH
COS_144_LSB:      DB      03AH
COS_147_MSB:      DB      0C5H
COS_147_LSB:      DB      0B5H
COS_150_MSB:      DB      0BFH      ;WAS
```

```
COS_150_LSB:    DB    0FEH
COS_153_MSB:    DB    0BAH    ;WAS 06AH
COS_153_LSB:    DB    01AH
COS_156_MSB:    DB    0B4H
COS_156_LSB:    DB    00EH
COS_159_MSB:    DB    0ADH
COS_159_LSB:    DB    0DDH
COS_162_MSB:    DB    0A7H
COS_162_LSB:    DB    08CH
COS_165_MSB:    DB    0A1H
COS_165_LSB:    DB    01FH
COS_168_MSB:    DB    09AH
COS_168_LSB:    DB    09BH
COS_171_MSB:    DB    094H
COS_171_LSB:    DB    004H
COS_174_MSB:    DB    08BH
COS_174_LSB:    DB    060H
COS_177_MSB:    DB    086H
COS_177_LSB:    DB    0B1H
COS_180_MSB:    DB    07FH
COS_180_LSB:    DB    0FFH
COS_183_MSB:    DB    079H
COS_183_LSB:    DB    0D4H
COS_186_MSB:    DB    072H
COS_186_LSB:    DB    09EH
COS_189_MSB:    DB    06BH
COS_189_LSB:    DB    0FAH
COS_192_MSB:    DB    065H
COS_192_LSB:    DB    063H
COS_195_MSB:    DB    05EH
COS_195_LSB:    DB    0DFH
COS_198_MSB:    DB    058H
COS_198_LSB:    DB    072H
COS_201_MSB:    DB    052H
COS_201_LSB:    DB    021H
COS_204_MSB:    DB    04BH
COS_204_LSB:    DB    0F0H
COS_207_MSB:    DB    045H
COS_207_LSB:    DB    0E4H
COS_210_MSB:    DB    040H
COS_210_LSB:    DB    000H
COS_213_MSB:    DB    03AH
COS_213_LSB:    DB    049H
COS_216_MSB:    DB    034H
COS_216_LSB:    DB    0C4H
COS_219_MSB:    DB    02FH
COS_219_LSB:    DB    073H
COS_222_MSB:    DB    02AH
COS_222_LSB:    DB    05AH
COS_225_MSB:    DB    025H
COS_225_LSB:    DB    07EH
COS_228_MSB:    DB    020H
COS_228_LSB:    DB    0E1H
COS_231_MSB:    DB    01CH
COS_231_LSB:    DB    087H
COS_234_MSB:    DB    018H
COS_234_LSB:    DB    072H
COS_237_MSB:    DB    014H
COS_237_LSB:    DB    0A7H
COS_240_MSB:    DB    011H
COS_240_LSB:    DB    026H
COS_243_MSB:    DB    00DH
COS_243_LSB:    DB    0F4H
COS_246_MSB:    DB    00BH
COS_246_LSB:    DB    011H
COS_249_MSB:    DB    008H
COS_249_LSB:    DB    081H
COS_252_MSB:    DB    006H
COS_252_LSB:    DB    044H
COS_255_MSB:    DB    004H
COS_255_LSB:    DB    05DH
COS_258_MSB:    DB    002H
```

```
COS_253_LSB:    DB    0CDH
COS_261_MSB:    DB    001H
COS_261_LSB:    DB    094H
COS_264_MSB:    DB    000H
COS_264_LSB:    DB    0B4H
COS_267_MSB:    DB    000H
COS_267_LSB:    DB    0D2H
COS_270_MSB:    DB    000H
COS_270_LSB:    DB    000H
COS_273_MSB:    DB    000H
COS_273_LSB:    DB    0DDH    ;WAS 0D2H
COS_276_MSB:    DB    000H
COS_276_LSB:    DB    0B4H
COS_279_MSB:    DB    001H
COS_279_LSB:    DB    094H
COS_282_MSB:    DB    002H
COS_282_LSB:    DB    0CDH
COS_285_MSB:    DB    004H
COS_285_LSB:    DB    05DH
COS_288_MSB:    DB    006H
COS_288_LSB:    DB    044H
COS_291_MSB:    DB    008H
COS_291_LSB:    DB    081H
COS_294_MSB:    DB    00BH
COS_294_LSB:    DB    011H
COS_297_MSB:    DB    00DH
COS_297_LSB:    DB    0F4H
COS_300_MSB:    DB    011H
COS_300_LSB:    DB    026H
COS_303_MSB:    DB    014H
COS_303_LSB:    DB    0A7H
COS_306_MSB:    DB    018H
COS_306_LSB:    DB    072H
COS_309_MSB:    DB    01CH
COS_309_LSB:    DB    087H
COS_312_MSB:    DB    020H
COS_312_LSB:    DB    0E1H
COS_315_MSB:    DB    025H
COS_315_LSB:    DB    07EH
COS_318_MSB:    DB    02AH
COS_318_LSB:    DB    05AH
COS_321_MSB:    DB    02FH
COS_321_LSB:    DB    073H
COS_324_MSB:    DB    034H
COS_324_LSB:    DB    0C4H
COS_327_MSB:    DB    03AH
COS_327_LSB:    DB    043H
COS_330_MSB:    DB    040H
COS_330_LSB:    DB    000H
COS_333_MSB:    DB    045H
COS_333_LSB:    DB    0E4H
COS_336_MSB:    DB    04BH
COS_336_LSB:    DB    0F0H
COS_339_MSB:    DB    052H
COS_339_LSB:    DB    021H
COS_342_MSB:    DB    058H
COS_342_LSB:    DB    072H
COS_345_MSB:    DB    05EH
COS_345_LSB:    DB    0DFH
COS_348_MSB:    DB    065H
COS_348_LSB:    DB    063H
COS_351_MSB:    DB    06BH
COS_351_LSB:    DB    0FAH
COS_354_MSB:    DB    072H
COS_354_LSB:    DB    09EH
COS_357_MSB:    DB    079H
COS_357_LSB:    DB    04DH
COS_360_MSB:    DB    07FH
COS_360_LSB:    DB    0FFH
COS_000_MSB:    DB    07FH
COS_000_LSB:    DB    0FFH
COS_003_MSB:    DB    086H
```

```
COS_003_LSB:      DB      0B1H
COS_006_MSB:      DB      08BH
COS_006_LSB:      DB      060H
COS_009_MSB:      DB      094H
COS_009_LSB:      DB      004H
COS_012_MSB:      DB      09AH
COS_012_LSB:      DB      09BH
COS_015_MSB:      DB      0A1H
COS_015_LSB:      DB      01FH
COS_018_MSB:      DB      0A7H
COS_018_LSB:      DB      08CH
COS_021_MSB:      DB      0ADH
COS_021_LSB:      DB      0DDH
COS_024_MSB:      DB      0B4H
COS_024_LSB:      DB      00EH
COS_027_MSB:      DB      0BAH      ;WAS 06AH
COS_027_LSB:      DB      01AH
COS_030_MSB:      DB      0BFH      ;WAS 06FH
COS_030_LSB:      DB      0FEH
COS_033_MSB:      DB      0C5H
COS_033_LSB:      DB      0B5H
COS_036_MSB:      DB      0CBH
COS_036_LSB:      DB      03AH
COS_039_MSB:      DB      0D0H
COS_039_LSB:      DB      08BH
COS_042_MSB:      DB      0D5H
COS_042_LSB:      DB      0A4H
COS_045_MSB:      DB      0DAH
COS_045_LSB:      DB      080H
COS_048_MSB:      DB      0DFH
COS_048_LSB:      DB      01DH
COS_051_MSB:      DB      0E3H
COS_051_LSB:      DB      077H
COS_054_MSB:      DB      0E7H
COS_054_LSB:      DB      086H
COS_057_MSB:      DB      0EBH
COS_057_LSB:      DB      057H
COS_060_MSB:      DB      0EEH
COS_060_LSB:      DB      0D8H
COS_063_MSB:      DB      0F2H
COS_063_LSB:      DB      00AH
COS_066_MSB:      DB      0F4H
COS_066_LSB:      DB      0EDH
COS_069_MSB:      DB      0F7H
COS_069_LSB:      DB      07DH
COS_072_MSB:      DB      0F9H
COS_072_LSB:      DB      0BAH
COS_075_MSB:      DB      0FBH
COS_075_LSB:      DB      0A1H
COS_078_MSB:      DB      0FDH
COS_078_LSB:      DB      031H
COS_081_MSB:      DB      0FEH
COS_081_LSB:      DB      06AH
COS_084_MSB:      DB      0FFH
COS_084_LSB:      DB      04AH
COS_087_MSB:      DB      0FFH
COS_087_LSB:      DB      0D1H
;
END
$ep (asm.err)
$DEBUG
$XR SB DB
$NOMOD51
;$NOLIST
NAME SCMOT_0
$TITLE(SCMOT_0.A51)
$NOGE
$INCLUDE(REG52.PDF)
;
CSEG    AT      3300H
;
PUBLIC EXTRN_INTR_ENABLE_FLAG,MOT_0_INTR,SETUP_ENV
```

```
PUBLIC TEMP_MEM,XDATA_MO_LOW
PUBLIC X_DIR_FLAG,Y_DIR_FLAG
PUBLIC MOT_O_LOW,MOT_O_HIGH
EXTRN  CODE(SIN_DATA,COS_DATA)
EXTRN   BIT(SPEED_ENABLE_FLAG,SPEED_OUT_FLAG,PEROID_1_FLAG)
EXTRN   DATA(XDATA_M1_LOW)
EXTRN   CODE(SIN_TAB_MSB)
;
EXTRN_INTR_ENABLE_FLAG          BIT     28H.6  ;IN SCMOT_O.A51
RUN_NOT_PROG                    BIT     27H.7
RUN_MOT1_FLAG                   BIT     26H.0
X_DIR_FLAG                  BIT     29H.5
Y_DIR_FLAG                  BIT     29H.6
;
MOT_O_PEROID_COUNTER            DATA   4EH ;43H
TEMP_MEM                        DATA    43H;51
MOT_O_LOW                       DATA    4FH;47H
MOT_O_HIGH                      DATA    50H;48H
;*********************************************************************
;       THIS IS THE INTERRUPT SERVICE ROUTINE FOR THE INTERRUPT
;       GENERATED BY THE EXTERNAL VCO.
;*********************************************************************
;
        WS_CLK_O          BIT     P1.3
;
        MOT_O_PEROID    EQU     10H
;
;        XDATA_MO_HIGH      DATA    51H;70H
        XDATA_MO_LOW       DATA    52H;71H
;        SIN_MSB          DATA    53H;72H
;        SIN_LSB          DATA    54H;73H
;        COS_MSB          DATA    55H;74H
;        COS_LSB          DATA    56H;75H
;
ORG             3300H
;
SETUP_ENV:      MOV     PSW,#00H
                MOV     TMOD,#20H       ;8-BIT AUTO-RELOAD TIMER 1
                MOV     TCON,#00H       ;TIMER O & 1 DISABLED
                SETB    IT0             ;EXT INT O FALLING EDGE TRIG
                SETB    IT1             ;EXT INT 1 FALLING EDGE TRIG
                MOV     T2CON,#00H
                MOV     SCON,#00H       ;MODE O
                MOV     IE,#00H         ;ALL INTERRUPTS DISABLED
                MOV     IP,#00H         ;ALL INTERRUPTS LOW LEVEL
                SETB    PX0             ;EXT INT O HIGH PRIORITY HIGHEST
                SETB    PX1             ;EXT INT 1 HIGH PRIORITY NEXT
;                MOV     XDATA_MO_HIGH,#HIGH SIN_DATA
                MOV     XDATA_MO_LOW,#LOW SIN_DATA
;                MOV     XDATA_M1_HIGH,#HIGH SIN_DATA
                MOV     XDATA_M1_LOW,#LOW SIN_DATA
                CLR     WS_CLK_O
                RET
;
MOT_O_INTR:     CLR     EA              ;DISABLE ALL INTERRUPTS
                CLR     WS_CLK_O          ;TRANSFER PREVIOUS LOAD TO DAC OUTPUT
                PUSH    PSW
                PUSH    ACC
                PUSH    DPH
                PUSH    DPL
                SETB    P1.4
                CLR     P1.5
                SETB    P1.6
                SETB    P1.7
;                DJNZ    MOT_O_PEROID_COUNTER,MOT_O_INTR_END
;                MOV     MOT_O_PEROID_COUNTER,#MOT_O_PEROID
                MOV     DPL,XDATA_MO_LOW
                MOV     DPH,#SIN_TAB_MSB
                MOVX    A,@DPTR         ;GET SIN_XXX_MSB
                MOV     SBUF,A          ;OUTPUT SIN_XXX_MSB
                INC     DPH
                MOVX    A,@DPTR         ;GET SIN_XXX_LSB
```

```
WAIT_1:          JNB     TI,WAIT_1
                 CLR     TI
                 MOV     SBUF,A          ;OUTPUT SIN_XXX_LSB
                 INC     DPH
                 MOVX    A,@DPTR         ;GET COS_XXX_MSB
WAIT_2:          JNB     TI,WAIT_2
                 CLR     TI
                 SETB    WS_CLK_0
                 MOV     SBUF,A          ;OUTPUT COS_XXX_MSB
                 INC     DPH
                 MOVX    A,@DPTR         ;GET COS_XXX_LSB
WAIT_3:          JNB     TI,WAIT_3
                 CLR     TI
                 MOV     SBUF,A          ;OUTPUT COS_XXX_LSB
                 JB      X_DIR_FLAG,MO_CCW   ;WHICH DIR NEXT
MO_CW:           INC     XDATA_MO_LOW
                 MOV     A,#78H
                 CJNE    A,XDATA_MO_LOW,WAIT_4       ;IS THIS THE END
                 MOV     XDATA_MO_LOW,#00H
                 LJMP    WAIT_4
;
MO_CCW:          DEC     XDATA_MO_LOW
                 MOV     A,#0FFH
                 CJNE    A,XDATA_MO_LOW,WAIT_4
                 MOV     XDATA_MO_LOW,#077H
;
WAIT_4:          JNB     TI,WAIT_4
                 CLR     TI
                 JNB     PERIOD_1_FLAG,MOT_0_INTR_END
                 MOV     DPL,MOT_0_LOW
                 MOV     DPH,MOT_0_HIGH
                 INC     DPTR
                 MOV     MOT_0_LOW,DPL
                 MOV     MOT_0_HIGH,DPH
MOT_0_INTR_END:  SETB    P1.5
                 POP     DPL
                 POP     DPH
                 POP     ACC
                 POP     PSW
                 SETB    EA
                 RETI
END

$ep (asm.err)
$DEBUG
$XR SB DS
$NOMOD51
;$NOLIST
NAME SCMOT_1
$TITLE(SCMOT_1.A51)
$NOGE
$INCLUDE(REG52.PDF)
;
CSEG    AT      3400H
;
PUBLIC MOT_1_INTR
PUBLIC XDATA_M1_LOW
PUBLIC MOT_1_LOW,MOT_1_HIGH
EXTRN  CODE(SIN_DATA,COS_DATA)
EXTRN   BIT(SPEED_ENABLE_FLAG,SPEED_OUT_FLAG,PERIOD_1_FLAG)
EXTRN   BIT(X_DIR_FLAG,Y_DIR_FLAG)
EXTRN   DATA(TEMP_MEM)
EXTRN   CODE(SIN_TAB_MSB)
;
MOT_1_PERIOD_COUNTER            DATA   57H ;44H
;TEMP_MEM                       DATA    51H
MOT_1_LOW                       DATA    58H;45H
MOT_1_HIGH                      DATA    59H;46H
;*********************************************************************
;       THIS IS THE INTERRUPT SERVICE ROUTINE FOR THE INTERRUPT
;       GENERATED BY THE EXTERNAL VCO.
;*********************************************************************
```

```
;
        WS_CLK_1            BIT     P1.2
;
        MOT_1_PEROID    EQU     10H
;
;        XDATA_M1_HIGH       DATA    5AH;52H
        XDATA_M1_LOW        DATA    5BH;53H
;        SIN_MSB_1           DATA    5CH;59H
;        SIN_LSB_1           DATA    5DH;5AH
;        COS_MSB_1           DATA    5EH;5BH
;        COS_LSB_1           DATA    5FH;5CH
;
;
ORG             3400H
;
MOT_1_INTR:     CLR     EA                  ;DISABLE ALL INTERRUPTS
                CLR     WS_CLK_1              ;TRANSFER PREVIOUS LOAD TO DAC OUTPUT
                PUSH    PSW
                PUSH    ACC
                PUSH    DPH
                PUSH    DPL
                CLR     P1.4
                SETB    P1.5
                SETB    P1.6
                SETB    P1.7
;                DJNZ    MOT_1_PEROID_COUNTER,MOT_1_INTR_END
;                MOV     MOT_1_PEROID_COUNTER,#MOT_1_PEROID
                MOV     DPL,XDATA_M1_LOW
                MOV     DPH,#SIN_TAB_MSB
                MOVX    A,@DPTR             ;GET SIN_XXX_MSB
                MOV     SBUF,A              ;OUTPUT SIN_XXX_MSB
                INC     DPH
                MOVX    A,@DPTR             ;GET SIN_XXX_LSB
WAIT_1.         JNB     TI,WAIT_1
                CLR     TI
                MOV     SBUF,A              ;OUTPUT SIN_XXX_LSB
                INC     DPH
                MOVX    A,@DPTR             ;GET COS_XXX_MSB
WAIT_2:         JNB     TI,WAIT_2
                CLR     TI
                SETB    WS_CLK_1
                MOV     SBUF,A              ;OUTPUT COS_XXX_MSB
                INC     DPH
                MOVX    A,@DPTR             ;GET COS_XXX_LSB
WAIT_3:         JNB     TI,WAIT_3
                CLR     TI
                MOV     SBUF,A              ;OUTPUT COS_XXX_LSB
                JB      Y_DIR_FLAG,M1_CCW   ;WHICH DIR NEXT
M1_CW:          INC     XDATA_M1_LOW
                MOV     A,#78H
                CJNE    A,XDATA_M1_LOW,WAIT_4       ;IS THIS THE END
                MOV     XDATA_M1_LOW,#00H
                LJMP    WAIT_4
;
M1_CCW:         DEC     XDATA_M1_LOW
                MOV     A,#0FFH
                CJNE    A,XDATA_M1_LOW,WAIT_4
                MOV     XDATA_M1_LOW,#077H
;
WAIT_4:         JNB     TI,WAIT_4
                CLR     TI
                JNB     PEROID_1_FLAG,MOT_1_INTR_END
                MOV     DPL,MOT_1_LOW
                MOV     DPH,MOT_1_HIGH
                INC     DPTR
                MOV     MOT_1_LOW,DPL
                MOV     MOT_1_HIGH,DPH
MOT_1_INTR_END: SETB    P1.4
                POP     DPL
                POP     DPH
                POP     ACC
                POP     PSW
```

```
                SETB    EA
                RETI
END
$ep (asm.err)
$DEBUG
$XR SB DB
$NOMOD51
;$NOLIST
NAME SATDISP
$TITLE(SATDISP.A51)
$NOGE
$INCLUDE(REG52.PDF)
;
CSEG    AT      0000H
;
;
;OPERATING PARAMETERS FOR THE MODULE [ KEYSCAN ]
EXTRN BIT(KEY_00_FOUND,KEY_01_FOUND,KEY_02_FOUND,KEY_03_FOUND,KEY_04_FOUND)
EXTRN BIT(KEY_10_FOUND,KEY_11_FOUND,KEY_12_FOUND,KEY_13_FOUND,KEY_14_FOUND)
EXTRN BIT(KEY_20_FOUND,KEY_21_FOUND,KEY_22_FOUND,KEY_23_FOUND,KEY_24_FOUND)
EXTRN BIT(KEY_30_FOUND,KEY_31_FOUND,KEY_32_FOUND,KEY_33_FOUND,KEY_34_FOUND)
EXTRN BIT(KEY_40_FOUND,KEY_41_FOUND,KEY_42_FOUND,KEY_43_FOUND,KEY_44_FOUND)
EXTRN DATA(KEY_FLAGS1,KEY_FLAGS2,KEY_FLAGS3,KEY_FLAGS4)
EXTRN BIT(KEY_FOUND)
EXTRN CODE(KEY_SCAN,CLEAR_KEYS)
;
;OPERATING PARAMETERS FOR THE MODULE [ MATH]
EXTRN CODE(DIV_16,MUL_16,ADD_32,SUB_32,ASC_BIN,HEX_ASCII)
EXTRN CODE(SAVE_OP_A,SAVE_OP_B,OP_TO_DAMS,GET_OP_A,GET_OP_B)
EXTRN DATA(OP_0,OP_1,OP_2,OP_3,TMP_0,TMP_1,TMP_2,TMP_3,KEY_VALUE)
EXTRN DATA(DAMS_0,DAMS_1,DAMS_2,DAMS_3)
EXTRN DATA(TEN_THOU_ASCII,THOU_ASCII,HUNDRED_ASCII,TEN_ASCII,ONE_ASCII)
;EXTRN DATA(LOW_ASC_TO_BIN_ADDR,HIGH_ASC_TO_BIN_ADDR)
;
;OPERATING PARAMETERS FOR THE MODULE [ SCDATA ]
EXTRN CODE(SIN_DATA,COS_DATA,SIN_000_LSB,SIN_000_MSB,SIN_360_MSB)
EXTRN CODE(INIT_SC_DATA)
;
;OPERATING PARAMETERS FOR THE MODULE [ LCD ]
EXTRN CODE(DISP_DVR,LINE_SCAN_RAM_OUT1,LINE_SCAN_RAM_OUT2,OUT_RAM_LINE1)
EXTRN CODE(SCAN,OUT_RAM_LINE2,LCDINIT,OUT_LINE1,OUT_LINE2)
EXTRN BIT(LCD_INST_NOT_DATA,LCD_DIGIT_START_FLAG)
EXTRN DATA(FLASH_BLANK_SYMBOL,INST,LCD_DIGIT_START1_ADDRESS,LCD_SET_L1)
EXTRN BIT(DISP_DVR_FLAG)
EXTRN DATA(LCD_LOW_LINE_BUFFER,BLANK_CHAR,LCD_DIGIT_START2_ADDRESS)
;
;OPERATING PARAMETERS FOR THE MODULE [ E2PROM ]
EXTRN   DATA(E2_DPL,E2_DPH)
EXTRN   CODE(E2PROM_INIT,READ_E2PROM,WRITE_E2PROM)
;
;OPERATING PARAMETERS FOR THE MODULE [ SCMOT_0 ]
EXTRN   CODE(MOT_0_INTR,SETUP_ENV)
EXTRN   DATA(TEMP_MEM,XDATA_M0_LOW,MOT_0_LOW,MOT_0_HIGH)
EXTRN   BIT(X_DIR_FLAG)
;
;OPERATING PARAMETERS FOR THE MODULE [ SCMOT_1 ]
EXTRN   CODE(MOT_1_INTR)
EXTRN   DATA(XDATA_M1_LOW,MOT_1_LOW,MOT_1_HIGH)
EXTRN   BIT(Y_DIR_FLAG)
;
;OPERATING PARAMETERS FOR THE MODULE [ RTCSCH ]
EXTRN   CODE(TIMER1_INTR,TIMER1_SETUP,INIT_PEROID_1)
EXTRN   BIT(SPEED_OUT_FLAG,SPEED_ENABLE_FLAG,PEROID_1_FLAG,GEN_PEROID_1)
EXTRN   BIT(PEROID_1_LAST_FLAG,MOTOR_CLK,JOG_FLAG)
EXTRN   DATA(PEROID_1_CYCLE,PEROID_1_REMAINDER)
;OPERATING PARAMETERS FOR THE ANALOG MODULE [ALOG12.A51]
EXTRN   CODE(READ_CH1,READ_CH2,READ_CH3,READ_CH4,READ_ALL)
```

```
;*****************************************************************
;       NOTE STACK POINTER ( SP ) IS NOW AT 080H RATHER THAN 070H.
;
;       THIS FREES UP 16 MORE BYTES OF DIRECTLY ADDRESSABLE INTERNAL
;       DATA MEMORY.
;
;       THIS IS THE BIGINNING OF THE MICRO-CONTROL SOFTWARE PACKAGE
;       8/13/90
;*****************************************************************
;
;
;
SOFT1_FOUND                     BIT     03H     ;KEY_03_FOUND  "A"
SOFT2_FOUND                     BIT     08H     ;KEY_13_FOUND  "B"
SOFT3_FOUND                     BIT     0DH     ;KEY_23_FOUND  "C"
KEY_A                           BIT     03H
KEY_B                           BIT     08H
KEY_C                           BIT     0DH
START                           BIT     14H     ;KEY_40_FOUND  "START"
STOP                            BIT     15H     ;KEY_41_FOUND  "STOP"
DIR_CHANGE                      BIT     16H     ;KEY_42_FOUND  "DIR CHANGE"
JOG_X                       BIT     17H     ;KEY_43_FOUND  "X JOG"
JOG_Y                       BIT     18H     ;KEY_44_FOUND  "Y JOG"
MOT_OUT_TOGGLE                  BIT     2AH.7
UP_TOGGLE                       BIT     29H.3
DOWN_TOGGLE                     BIT     29H.4
;
TENSION_HEX             DATA    44H
TENSION_TENTH_ASCII     DATA    45H
TENSION_ONE_ASCII       DATA    46H
TEN_PROG_TENTH_ASCII    DATA    47H
TEN_PROG_ONE_ASCII      DATA    48H
TEN_PROG_HEX            DATA    49H
TORQUE_TENTH_ASCII      DATA    4BH
TORQUE_ONE_ASCII        DATA    4CH
TORQUE_HEX              DATA    4DH
RAD_SMALL_HEX           DATA    53H
RAD_LARGE_HEX           DATA    54H
;
E2_PAGE_1                       EQU     80H     ;HEX
E2_Y_DIR_FLAG                   EQU     00H     ;Y_DIR_FLAG;HEX
E2_X_DIR_FLAG                   EQU     01H     ;X_DIR_FLAG;HEX
;*****************************************************************
;E2PROM MEMORY LOCATIONS OF PROGRAMMED TENSION VALUES
;*****************************************************************
E2_TEN_PROG_TENTH_ASCII         EQU     02H     ;ASCII
E2_TEN_PROG_ONE_ASCII           EQU     03H     ;ASCII
E2_TEN_PROG_HEX                 EQU     04H     ;HEX
;*****************************************************************
;E2PROM MEMORY LOCATIONS OF  ROLL RADII BOTH MEASURED AND KEYED IN
;*****************************************************************
E2_SMALL_RAD_LSB                EQU     05H     ;HEX
E2_SMALL_RAD_MSB                EQU     06H     ;HEX
E2_LARGE_RAD_LSB                EQU     07H     ;HEX
E2_LARGE_RAD_MSB                EQU     08H     ;HEX
E2_SMALL_RAD_KEY_HEX            EQU     09H     ;HEX
E2_LARGE_RAD_KEY_HEX            EQU     0AH     ;HEX
;*****************************************************************
;E2PROM MEMORY LOCATIONS OF TORQUE CALIBRATION MEASURMENTS
;*****************************************************************
TORQUE_CAL_LOAD_CW_LSB          EQU     0BH     ;HEX
TORQUE_CAL_LOAD_CW_MSB          EQU     0CH     ;HEX
TORQUE_CAL_LOAD_CCW_LSB         EQU     0DH     ;HEX
TORQUE_CAL_LOAD_CCW_MSB         EQU     0EH     ;HEX
E2_TORQUE_CAL_TENTH_KEY         EQU     0FH     ;ASCII
E2_TORQUE_CAL_ONE_KEY           EQU     10H     ;ASCII
E2_TORQUE_CAL_KEY_HEX           EQU     11H     ;HEX
;
;
;
                CSEG AT 0000H
                ORG     00H
                LJMP    POWER_ON
```

```
                ORG     03
                LJMP    MOT_0_INTR
                ORG     13H                     ;
                LJMP    MOT_1_INTR
                ORG     1BH                     ;
                LJMP    TIMER1_INTR             ;
                ORG     100H
POWER_ON:
                MOV     IE,#00          ; disable all intrs
                MOV     P0,#0FFH
                MOV     P1,#0FFH
                MOV     P2,#0FFH
                MOV     P3,#0FFH
                MOV     SP,#80H
                MOV     A,#00H
                MOV     R0,#00H
CLEAR_DATA_MEM_1: MOV     @R0,A           ;CLEARING INTRENAL MEM
                INC     R0
                CJNE    R0,#0FFH,CLEAR_DATA_MEM_1
                MOV     @R0,A
                MOV     R0,#00
                CALL    INIT_SC_DATA    ;BUILDS SIN/COS TABLES IN RAM
                MOV     IE,#00          ; disable all intrs
                MOV     P0,#0FFH
                MOV     P1,#0FFH
                MOV     P2,#0FFH
                MOV     P3,#0FFH
                MOV     SP,#80H
                MOV     A,#00H
                MOV     R0,#00H
CLEAR_DATA_MEM_2: MOV     @R0,A           ;CLEARING INTRENAL MEM
                INC     R0
                CJNE    R0,#0FFH,CLEAR_DATA_MEM_2
                MOV     @R0,A
                MOV     R0,#00
                CALL    E2PROM_INIT
;
;               SETB    IT1             ;SETS EDGE TRIG MODE ON INT1
                MOV     E2_DPL,#E2_Y_DIR_FLAG     ;Y DIR FLAG IN ACC.0
                MOV     E2_DPH,#80H
                CALL    READ_E2PROM
                JB      ACC.0,SET_Y_DIR_FLAG_A
                CLR     Y_DIR_FLAG
                LJMP    NOW_DO_X
;
SET_Y_DIR_FLAG_A:     SETB    Y_DIR_FLAG
;
NOW_DO_X:   INC     E2_DPL          ;X DIR FLAG
                CALL    READ_E2PROM
                JB      ACC.0,SET_X_DIR_FLAG_A
                CLR     X_DIR_FLAG
                LJMP    DONE_WITH_THIS
SET_X_DIR_FLAG_A:     SETB    X_DIR_FLAG
;
RESTORE_PROG_TEN:       MOV     E2_DPH,#E2_PAGE_1
                        MOV     E2_DPL,#E2_TEN_PROG_TENTH_ASCII
                        CALL    READ_E2PROM
                        MOV     TEN_PROG_TENTH_ASCII,A
                        INC     E2_DPL
                        CALL    READ_E2PROM
                        MOV     TEN_PROG_ONE_ASCII,A
;
DONE_WITH_THIS: CALL    LCDINIT
;               CALL    E2PROM_INIT
                CALL    SETUP_ENV
                CALL    TIMER1_SETUP
                LJMP    MAIN_LINE
;
;
;SYSTEM_READY:   NOP
;
;
```

```
MEM_DATA        DATA    29H
MEM_LOOP        DATA    2AH
STOP_TEST       BIT     28H.2
;
;************RAM************TEST****************
;
XMEM_TEST:      MOV     MEM_DATA,#00H
XRAM_TEST:      MOV     DPTR,#0000H
MORE_TO_LOAD:   MOV     A,MEM_DATA
                MOVX    @DPTR,A
                INC     DPTR
                MOV     A,DPH
                CJNE    A,#80H,MORE_TO_LOAD
                MOV     DPTR,#0000H
MORE_TO_TEST:   MOVX    A,@DPTR
                INC     DPTR
                CJNE    A,MEM_DATA,XRAM_ERROR
                MOV     A,DPH
                CJNE    A,#80H,MORE_TO_TEST
                RET
;                LJMP    MAIN_LINE
MID_TEST:       INC     MEM_DATA
                MOV     A,MEM_DATA
                CJNE    A,MEM_LOOP,XRAM_TEST
                JB      STOP_TEST,XRAM_OK
;                LJMP    XRAM_TEST
XRAM_OK:        LJMP    POWER_ON
XRAM_ERROR:     LJMP    XRAM_ERROR
;
;
;
MAIN_LINE:      NOP
                MOV     THOU_ASCII,#30H
                MOV     HUNDRED_ASCII,#30H
                MOV     TEN_ASCII,#30H
                MOV     THOU_ASCII,#30H
                MOV     HUNDRED_ASCII,#30H
                MOV     TEN_ASCII,#30H
                MOV     TH1,#9CH
DISP_100A:      JB      X_DIR_FLAG,DISP_100B      ;CW
                MOV     DPTR,#MSG_100A            ;CCW
                CALL    OUT_LINE1
                JMP     DISP_100C
DISP_100B:      MOV     DPTR,#MSG_100B
                CALL    OUT_LINE1
DISP_100C:      MOV     DPTR,#MSG_100C
                CALL    OUT_LINE2
                CALL    CLEAR_KEYS
WAIT_100B:      JB      KEY_A,DISP_102A
                JB      KEY_B,SHORT_DISP_101A
                JB      KEY_C,REV_100
;                CALL    CLEAR_KEYS
                LJMP    WAIT_100B
SHORT_DISP_101A:        LJMP    DISP_101A
REV_100:        CALL    CLEAR_KEYS
                CPL     X_DIR_FLAG
                JB      X_DIR_FLAG,SET_X100_DIR_FLAG
                MOV     A,#00H
                LJMP    CLEAR_X_DIR_FLAG
SET_X100_DIR_FLAG:          SETB    ACC.0
CLEAR_X_DIR_FLAG:       MOV     E2_DPL,#E2_X_DIR_FLAG
                MOV     E2_DPH,#80H
                CALL    WRITE_E2PROM
                LJMP    DISP_100A
;
DISP_102A:      MOV     DPTR,#MSG_102A
                CALL    LINE_SCAN_RAM_OUT1
                CALL    CLEAR_KEYS
                MOV     R0,LCD_DIGIT_START1_ADDRESS
;       MOV      TEN_PROG_TENTH_ASCII,#33H
;       MOV      TEN_PROG_ONE_ASCII,#36H
                MOV     @R0,TEN_PROG_ONE_ASCII
```

```
                CLR     LCD_DIGIT_START_FLAG
                INC     R0
                INC     R0
                MOV     @R0,TEN_PROG_TENTH_ASCII
                CALL    OUT_RAM_LINE1
DISP_102B:      MOV     DPTR,#MSG_102B
                CALL    OUT_LINE2
                CALL    CLEAR_KEYS
WAIT_102B:      JB      KEY_A,DISP_104A
                JB      KEY_B,SHORT_DISP_103A
                JB      KEY_C,DISP_100A
                LJMP    WAIT_102B
SHORT_DISP_103A:        LJMP    DISP_103A
DISP_104A:      MOV     DPTR,#MSG_104A
                CALL    OUT_LINE1
DISP_104B:      MOV     DPTR,#MSG_104B
                CALL    OUT_LINE2
                CALL    CLEAR_KEYS
WAIT_104B:      JB      KEY_A,DISP_106A
                JB      KEY_B,SHORT_DISP_109A
                JB      KEY_C,SHORT_CAL_SYS
                LJMP    WAIT_104B
SHORT_CAL_SYS:  CALL    CAL_SYS
                LJMP    DISP_102A
SHORT_DISP_109A:        LJMP    DISP_109A
;DISP_105A:      MOV     DPTR,#MSG_105A
;               CALL    OUT_LINE1
;               MOV     DPTR,#MSG_105B
;               CALL    OUT_LINE2
;               CALL    CLEAR_KEYS
;WAIT_105B:     JB      KEY_A,PASS_105B
;               JB      KEY_B,PASS_105B
;               JB      KEY_C,READ_105B
;               LJMP    WAIT_105B
;PASS_105B:     CALL    CLEAR_KEYS
;               LJMP    WAIT_105B
;READ_105B:     CALL    READ_CH1
;               CALL
DISP_106A:      MOV     DPTR,#MSG_106A
                CALL    OUT_LINE1
                MOV     DPTR,#MSG_106B
                CALL    OUT_LINE2
                CALL    CLEAR_KEYS
WAIT_106B:      JB      KEY_A,PASS_106B
                JB      KEY_B,PASS_106B
                JB      KEY_C,READ_106B
                LJMP    WAIT_106B
READ_106B:      CALL    READ_CH1        ;CW TORQUE CALIBRATION LOAD
                CALL    SAVE_OP_A
                MOV     E2_DPH,#E2_PAGE_1
                MOV     E2_DPL,#TORQUE_CAL_LOAD_CW_LSB
                MOV     A,OP_0
                CALL    WRITE_E2PROM
                MOV     E2_DPH,#E2_PAGE_1
                MOV     E2_DPL,#TORQUE_CAL_LOAD_CW_MSB
                MOV     A,OP_1
                CALL    WRITE_E2PROM
                LJMP    DISP_107A
PASS_106B:      CALL    CLEAR_KEYS
                LJMP    WAIT_106B
DISP_107A:      MOV     DPTR,#MSG_107A
                CALL    OUT_LINE1
                MOV     DPTR,#MSG_107B
                CALL    OUT_LINE2
                CALL    CLEAR_KEYS
WAIT_107B:      JB      KEY_A,PASS_107B
                JB      KEY_B,PASS_107B
                JB      KEY_C,READ_107B
                LJMP    WAIT_107B
READ_107B:      CALL    READ_CH1        ;CCW TORQUE CALIBRATION LOAD
                CALL    SAVE_OP_B
                MOV     E2_DPH,#E2_PAGE_1
```

```
                MOV     E2_DPL,#TORQUE_CAL_LOAD_CCW_LSB
                MOV     A,OP_0
                CALL    WRITE_E2PROM
                MOV     E2_DPH,#E2_PAGE_1
                MOV     E2_DPL,#TORQUE_CAL_LOAD_CCW_MSB
                MOV     A,OP_1
                CALL    WRITE_E2PROM
                LJMP    DISP_108A
PASS_107B:      CALL    CLEAR_KEYS
                LJMP    WAIT_107B
DISP_108A:      MOV     DPTR,#MSG_108A
                CALL    OUT_LINE1
DISP_108B:      MOV     DPTR,#MSG_108B
                CALL    LINE_SCAN_RAM_OUT2
                CLR     LCD_DIGIT_START_FLAG
                CALL    CLEAR_KEYS
WAIT_108B:      JB      KEY_A,PASS_108B
                JB      KEY_B,PASS_108B
                JB      KEY_C,PASS_108B
                JB      KEY_FOUND,KEY_108B
                LJMP    WAIT_108B
PASS_108B:      CALL    CLEAR_KEYS
                LJMP    WAIT_108B
;
SHORT_DISP_115A:        LJMP    DISP_115A
;
KEY_108B:       MOV     OP_1,KEY_VALUE
                MOV     DPTR,#MSG_108B
                CALL    LINE_SCAN_RAM_OUT2
                CALL    CLEAR_KEYS
                MOV     R0,LCD_DIGIT_START1_ADDRESS
                MOV     @R0,OP_1
                MOV     OP_2,R0
                CLR     LCD_DIGIT_START_FLAG
                CALL    OUT_RAM_LINE2
WAIT_108B1:     JB      KEY_A,PASS_108B1
                JB      KEY_B,DISP_108B
                JB      KEY_C,PASS_108B1
                JB      KEY_FOUND,KEY_108B1
                LJMP    WAIT_108B1
PASS_108B1:     CALL    CLEAR_KEYS
                LJMP    WAIT_108B1

KEY_108B1:      MOV     OP_0,KEY_VALUE
                CALL    CLEAR_KEYS
                MOV     R0,OP_2
                INC     R0
                INC     R0
                MOV     @R0,OP_0
                MOV     OP_2,R0
                CLR     LCD_DIGIT_START_FLAG
                CALL    OUT_RAM_LINE2
WAIT_108B2:     JB      KEY_A,PASS_108B2
                JB      KEY_B,DISP_108B
                JB      KEY_C,SHORT_SAVE_115A
                LJMP    WAIT_108B2
PASS_108B2:     CALL    CLEAR_KEYS
                LJMP    WAIT_108B2
SHORT_SAVE_115A:        MOV     TORQUE_ONE_ASCII,OP_1
                        MOV     TORQUE_TENTH_ASCII,OP_0
                        MOV     E2_DPH,#E2_PAGE_1
                        MOV     E2_DPL,#E2_TORQUE_CAL_TENTH_KEY
                        MOV     A,OP_0
                        CALL    WRITE_E2PROM
                        MOV     E2_DPH,#E2_PAGE_1
                        MOV     E2_DPL,#E2_TORQUE_CAL_ONE_KEY
                        MOV     A,OP_1
                        CALL    WRITE_E2PROM
                        MOV     TEN_THOU_ASCII,#00H
                        MOV     THOU_ASCII,#00H
                        MOV     HUNDRED_ASCII,#00H
                        MOV     TEN_ASCII,TORQUE_ONE_ASCII
```

```
                    MOV     ONE_ASCII,TORQUE_TENTH_ASCII
                    CALL    ASC_BIN
                    MOV     TORQUE_HEX,OP_0
                    MOV     E2_DPH,#E2_PAGE_1
                    MOV     E2_DPL,#E2_TORQUE_CAL_KEY_HEX
                    MOV     A,OP_0
                    CALL    WRITE_E2PROM
                    LJMP    DISP_115A
;
DISP_115A:          MOV     DPTR,#MSG_115A
                    CALL    OUT_LINE1
                    MOV     DPTR,#MSG_115B
                    CALL    OUT_LINE2
                    CALL    CLEAR_KEYS
WAIT_115B:          JB      KEY_A,PASS_115B
                    JB      KEY_B,PASS_115B
                    JB      KEY_C,SHORT_115B_DISP_104A
                    LJMP    WAIT_115B
SHORT_115B_DISP_104A:       LJMP    DISP_104A
PASS_115B:          CALL    CLEAR_KEYS
                    LJMP    WAIT_115B
;
DISP_109A:          MOV     DPTR,#MSG_109A
                    CALL    OUT_LINE1
                    MOV     DPTR,#MSG_109B
                    CALL    OUT_LINE2
                    CALL    CLEAR_KEYS
WAIT_109B:          JB      KEY_A,PASS_109B
                    JB      KEY_B,PASS_109B
                    JB      KEY_C,READ_SMALL_RAD
                    LJMP    WAIT_109B
PASS_109B:          CALL    CLEAR_KEYS
                    LJMP    WAIT_109B
;
READ_SMALL_RAD:     CALL    READ_CH2
                    MOV     E2_DPH,#E2_PAGE_1
                    MOV     E2_DPL,#E2_SMALL_RAD_LSB
                    MOV     A,OP_0
                    CALL    WRITE_E2PROM
                    MOV     E2_DPH,#E2_PAGE_1
                    MOV     E2_DPL,#E2_SMALL_RAD_MSB
                    MOV     A,OP_1
                    CALL    WRITE_E2PROM
                    LJMP    DISP_110A
;
DISP_110A:          MOV     DPTR,#MSG_110A
                    CALL    OUT_LINE1
DISP_110B:          MOV     DPTR,#MSG_110B
                    CALL    LINE_SCAN_RAM_OUT2
                    MOV     R0,LCD_DIGIT_START1_ADDRESS
                    CLR     LCD_DIGIT_START_FLAG
                    CALL    CLEAR_KEYS
WAIT_110B:          JB      KEY_A,PASS_110B
                    JB      KEY_B,DISP_110B
                    JB      KEY_C,PASS_110B
                    JB      KEY_FOUND,KEY_110B
                    LJMP    WAIT_110B
PASS_110B:          CALL    CLEAR_KEYS
                    LJMP    WAIT_110B
;
;
KEY_110B:           MOV     HUNDRED_ASCII,KEY_VALUE
                    MOV     @R0,KEY_VALUE
                    CALL    CLEAR_KEYS
                    INC     R0
                    CALL    OUT_RAM_LINE2
WAIT_110B1:         JB      KEY_A,PASS_110B1
                    JB      KEY_B,DISP_110B
                    JB      KEY_C,PASS_110B1
                    JB      KEY_FOUND,KEY_110B2
                    LJMP    WAIT_110B1
```

```
PASS_110B1:     CALL    CLEAR_KEYS
                LJMP    WAIT_110B1
;
KEY_110B2:      MOV     TEN_ASCII,KEY_VALUE
                CALL    CLEAR_KEYS
                MOV     @R0,KEY_VALUE
                CALL    OUT_RAM_LINE2
                INC     R0
                INC     R0
WAIT_110B2:     JB      KEY_A,PASS_110B2
                JB      KEY_B,DISP_110B
                JB      KEY_C,PASS_110B2
                JB      KEY_FOUND,KEY_110B3
                LJMP    WAIT_110B2
PASS_110B2:     CALL    CLEAR_KEYS
                LJMP    WAIT_110B2
;
KEY_110B3:      MOV     ONE_ASCII,KEY_VALUE
                CALL    CLEAR_KEYS
                MOV     @R0,KEY_VALUE
                CALL    OUT_RAM_LINE2
WAIT_110B3:     JB      KEY_A,PASS_110B3
                JB      KEY_B,DISP_110B
                JB      KEY_C,SAVE_DISP_110B
                LJMP    WAIT_110B3
PASS_110B3:     CALL    CLEAR_KEYS
                LJMP    WAIT_110B3
;
SAVE_DISP_110B: CALL    ASC_BIN
                MOV     RAD_SMALL_HEX,OP_0
                MOV     E2_DPH,#E2_PAGE_1
                MOV     E2_DPL,#E2_SMALL_RAD_KEY_HEX
                MOV     A,OP_0
                CALL    WRITE_E2PROM
                LJMP    DISP_111A
;
DISP_111A:      MOV     DPTR,#MSG_111A
                CALL    OUT_LINE1
                MOV     DPTR,#MSG_111B
                CALL    OUT_LINE2
                CALL    CLEAR_KEYS
WAIT_111B:      JB      KEY_A,PASS_111B
                JB      KEY_B,PASS_111B
                JB      KEY_C,READ_LARGE_RAD
                LJMP    WAIT_111B
PASS_111B:      CALL    CLEAR_KEYS
                LJMP    WAIT_111B
;
READ_LARGE_RAD: CALL    READ_CH2
                MOV     E2_DPH,#E2_PAGE_1
                MOV     E2_DPL,#E2_LARGE_RAD_LSB
                MOV     A,OP_0
                CALL    WRITE_E2PROM
                MOV     E2_DPH,#E2_PAGE_1
                MOV     E2_DPL,#E2_LARGE_RAD_MSB
                MOV     A,OP_1
                CALL    WRITE_E2PROM
                LJMP    DISP_112A
;
DISP_112A:      MOV     DPTR,#MSG_112A
                CALL    OUT_LINE1
DISP_112B:      MOV     DPTR,#MSG_112B
                CALL    LINE_SCAN_RAM_OUT2
                CLR     LCD_DIGIT_START_FLAG
                MOV     R0,LCD_DIGIT_START1_ADDRESS
                CALL    CLEAR_KEYS
WAIT_112B:      JB      KEY_A,PASS_112B
                JB      KEY_B,PASS_112B
                JB      KEY_C,PASS_112B
                JB      KEY_FOUND,KEY_112B
                LJMP    WAIT_112B
PASS_112B:      CALL    CLEAR_KEYS
```

```
                LJMP    WAIT_112B
;
KEY_112B:       MOV     HUNDRED_ASCII,KEY_VALUE
                MOV     @R0,KEY_VALUE
                CALL    CLEAR_KEYS
                INC     R0
                CALL    OUT_RAM_LINE2
WAIT_112B1:     JB      KEY_A,PASS_112B1
                JB      KEY_B,DISP_112B
                JB      KEY_C,PASS_112B1
                JB      KEY_FOUND,KEY_112B2
                LJMP    WAIT_112B1
;
PASS_112B1:      CALL    CLEAR_KEYS
                LJMP    WAIT_112B1
;
KEY_112B2:      MOV     TEN_ASCII,KEY_VALUE
                CALL    CLEAR_KEYS
                MOV     @R0,KEY_VALUE
                CALL    OUT_RAM_LINE2
                INC     R0
                INC     R0
WAIT_112B2:     JB      KEY_A,PASS_112B2
                JB      KEY_B,DISP_112B
                JB      KEY_C,PASS_112B2
                JB      KEY_FOUND,KEY_112B3
                LJMP    WAIT_112B2
;
PASS_112B2:      CALL    CLEAR_KEYS
                LJMP    WAIT_112B2
;
KEY_112B3:      MOV     ONE_ASCII,KEY_VALUE
                CALL    CLEAR_KEYS
                MOV     @R0,KEY_VALUE
                CALL    OUT_RAM_LINE2
WAIT_112B3:     JB      KEY_A,PASS_112B3
                JB      KEY_B,DISP_112B
                JB      KEY_C,SAVE_DISP_112B
                LJMP    WAIT_112B3
;
SAVE_DISP_112B: CALL    ASC_BIN
                MOV     RAD_LARGE_HEX,OP_0
                MOV     E2_DPH,#E2_PAGE_1
                MOV     E2_DPL,#E2_LARGE_RAD_KEY_HEX
                MOV     A,OP_0
                CALL    WRITE_E2PROM
                LJMP    DISP_113A
;
PASS_112B3:      CALL    CLEAR_KEYS
                LJMP    WAIT_112B3
;
DISP_113A:      MOV     DPTR,#MSG_113A
                CALL    OUT_LINE1
                MOV     DPTR,#MSG_113B
                CALL    OUT_LINE2
                CALL    CLEAR_KEYS
WAIT_113B:      JB      KEY_A,PASS_113B
                JB      KEY_B,PASS_113B
                JB      KEY_C,SHORT_113B_DISP_104A
                LJMP    WAIT_113B
SHORT_113B_DISP_104A:   LJMP    DISP_104A
PASS_113B:      CALL    CLEAR_KEYS
                LJMP    WAIT_113B
;
DISP_103A:      MOV     DPTR,#MSG_103A
                CALL    OUT_LINE1
DISP_103B:      MOV     DPTR,#MSG_103B
                CALL    LINE_SCAN_RAM_OUT2
                CLR     LCD_DIGIT_START_FLAG
                CALL    CLEAR_KEYS
WAIT_103B:      JB      KEY_A,PASS_103B
                JB      KEY_B,DISP_103B
```

```
                JB      KEY_C,PASS_103B
                JB      KEY_FOUND,KEY_103B
                LJMP    WAIT_103B
PASS_103B:      CALL    CLEAR_KEYS
                LJMP    WAIT_103B
;
KEY_103B:       MOV     OP_0,KEY_VALUE
                MOV     DPTR,#MSG_103B
                CALL    LINE_SCAN_RAM_OUT2
                CALL    CLEAR_KEYS
                MOV     R0,LCD_DIGIT_START1_ADDRESS
                MOV     @R0,OP_0
                MOV     OP_2,R0
                CLR     LCD_DIGIT_START_FLAG
                CALL    OUT_RAM_LINE2
WAIT_103B1:     JB      KEY_A,PASS_103B1
                JB      KEY_B,DISP_103B
                JB      KEY_C,PASS_103B1
                JB      KEY_FOUND,KEY_103B1
                LJMP    WAIT_103B1
PASS_103B1:     CALL    CLEAR_KEYS
                LJMP    WAIT_103B1
;
KEY_103B1:      MOV     OP_1,KEY_VALUE
                CALL    CLEAR_KEYS
                MOV     R0,OP_2
                INC     R0
                INC     R0
                MOV     @R0,OP_1
                MOV     OP_2,R0
                CLR     LCD_DIGIT_START_FLAG
                CALL    OUT_RAM_LINE2
WAIT_103B2:     JB      KEY_A,PASS_103B2
                JB      KEY_B,DISP_103B
                JB      KEY_C,SHORT_SAVE_102A
                LJMP    WAIT_103B2
PASS_103B2:     CALL    CLEAR_KEYS
                LJMP    WAIT_103B2
SHORT_SAVE_102A:        MOV     TEN_PROG_ONE_ASCII,OP_0
                        MOV     TEN_PROG_TENTH_ASCII,OP_1
                        MOV     E2_DPH,#E2_PAGE_1
                        MOV     E2_DPL,#E2_TEN_PROG_TENTH_ASCII
                        MOV     A,OP_1
                        CALL    WRITE_E2PROM
                        MOV     E2_DPH,#E2_PAGE_1
                        MOV     E2_DPL,#E2_TEN_PROG_ONE_ASCII
                        MOV     A,OP_0
                        CALL    WRITE_E2PROM
                        LJMP    DISP_102A
;
DISP_101A:      MOV     DPTR,#MSG_101A
                CALL    OUT_LINE1
                JB      X_DIR_FLAG,DISP_101B
                MOV     DPTR,#MSG_101C
                CALL    LINE_SCAN_RAM_OUT2
                CALL    CLEAR_KEYS
                MOV     R0,LCD_DIGIT_START1_ADDRESS
        MOV     TENSION_TENTH_ASCII,#31H
        MOV     TENSION_ONE_ASCII,#32H
                MOV     @R0,TENSION_ONE_ASCII
                CLR     LCD_DIGIT_START_FLAG
                INC     R0
                INC     R0
                MOV     @R0,TENSION_TENTH_ASCII
                CALL    OUT_RAM_LINE2
;
;               MOV     OP_0,MOT_0_LOW
;               MOV     OP_1,MOT_0_HIGH
;               MOV     OP_2,#00H
;               MOV     OP_3,#00H
;               CALL    HEX_ASCII
```

```
;
                LJMP    WAIT_101B
DISP_101B:      MOV     DPTR,#MSG_101B
                CALL    LINE_SCAN_RAM_OUT2
                CALL    CLEAR_KEYS
                MOV     R0,LCD_DIGIT_START1_ADDRESS
        MOV     TENSION_TENTH_ASCII,#35H
        MOV     TENSION_ONE_ASCII,#37H
                MOV     @R0,TENSION_ONE_ASCII
                CLR     LCD_DIGIT_START_FLAG
                INC     R0
                INC     R0
                MOV     @R0,TENSION_TENTH_ASCII
                CALL    OUT_RAM_LINE2
                CALL    CLEAR_KEYS
WAIT_101B:      JB      KEY_A,PASS_101B
                JB      KEY_B,PASS_101B
                JB      KEY_C,SHORT_DISP_100A
                LJMP    WAIT_101B
SHORT_DISP_100A:        CALL    CLEAR_KEYS
                        LJMP    DISP_100A
PASS_101B:      CALL    CLEAR_KEYS
                LJMP    WAIT_101B
                LJMP    DISP_100A
;
CAL_SYS:        RET
;
OUT_X_CCW:      MOV     DPTR,#MSG_100A
                CALL    LINE_SCAN_RAM_OUT1
                MOV     R0,LCD_DIGIT_START1_ADDRESS
                MOV     @R0,THOU_ASCII
                CLR     LCD_DIGIT_START_FLAG
                INC     R0
                MOV     @R0,HUNDRED_ASCII
                INC     R0
                INC     R0
                MOV     @R0,TEN_ASCII
                CALL    OUT_RAM_LINE1
                RET
;
OUT_X_CW:       MOV     DPTR,#MSG_101A
                CALL    LINE_SCAN_RAM_OUT1
                MOV     R0,LCD_DIGIT_START1_ADDRESS
                MOV     @R0,THOU_ASCII
                CLR     LCD_DIGIT_START_FLAG
                INC     R0
                MOV     @R0,HUNDRED_ASCII
                INC     R0
                INC     R0
                MOV     @R0,TEN_ASCII
                CALL    OUT_RAM_LINE1
                RET
;
CONTROL_KEYS:   JB      START,START_MOTORS
                JB      DIR_CHANGE,SHORT_REVERSE_A_MOTOR
                JB      JOG_X,SHORT_JOG_X_MOTOR
                JB      JOG_Y,SHORT_JOG_Y_MOTOR
                JB      STOP,SHORT_XMEM_TEST
                LJMP    CONTROL_KEYS
SHORT_XMEM_TEST: CALL   CLEAR_KEYS
                CALL    XMEM_TEST
MORE_XMEM:      CPL     X_DIR_FLAG
                JB      X_DIR_FLAG,DISP_CW
                CALL    OUT_X_CCW
                CALL    MID_TEST
                LJMP    MORE_XMEM
DISP_CW:        CALL    OUT_X_CW
                CALL    MID_TEST
                LJMP    MORE_XMEM
;
SHORT_REVERSE_A_MOTOR:  LJMP    REVERSE_A_MOTOR
```

```
SHORT_JOG_X_MOTOR:  LJMP    JOG_X_MOTOR
SHORT_JOG_Y_MOTOR:  LJMP    JOG_Y_MOTOR
;
GET_PEROID_1:       MOV     PEROID_1_CYCLE,#04H
                    MOV     PEROID_1_REMAINDER,#17H ;GEN NUMBER 1047
                    CALL    INIT_PEROID_1
                    RET
;
START_MOTORS:       CALL    CLEAR_KEYS
                    SETB    EX0     ;ENABLE VCO INTERRUPTS AT INT0
                    SETB    EX1     ;ENABLE VCO INTERRUPTS AT INT1
                    SETB    IE0
                    SETB    IE1
START_LOOP:         JB      SPEED_OUT_FLAG,MOT_SPEED
                    JB      GEN_PEROID_1,PASS_PEROID
                    CALL    GET_PEROID_1
PASS_PEROID:        JB      STOP,SHORT_STOP_MOTORS
                    LJMP    START_LOOP
SHORT_STOP_MOTORS:          LJMP    STOP_MOTORS
;
MOT_SPEED:           CLR     GEN_PEROID_1
                     CLR     SPEED_OUT_FLAG
                    MOV     OP_0,MOT_0_LOW
                    MOV     OP_1,MOT_0_HIGH
                    MOV     OP_2,#00H
                    MOV     OP_3,#00H
                    CALL    HEX_ASCII
                    JB      X_DIR_FLAG,X_CODE_CW ;X OUT
                    CALL    OUT_X_CCW
                    LJMP    Y_OUT
X_CODE_CW:              CALL    OUT_X_CW
;                    LJMP    Y_OUT
Y_OUT:        MOV       OP_0,MOT_1_LOW
                    MOV     OP_1,MOT_1_HIGH
                    MOV     OP_2,#00H
                    MOV     OP_3,#00H
                    CALL    HEX_ASCII
                    JB      Y_DIR_FLAG,LOW_CW ;Y OUT
                    CALL    OUT_LOW_CCW
                    LJMP    START_LOOP
LOW_CW:             CALL    OUT_LOW_CW
                    LJMP    START_LOOP
OUT_LOW_CCW:        MOV     DPTR,#MSG_100B
                    CALL    LINE_SCAN_RAM_OUT2
                    MOV     R0,LCD_DIGIT_START1_ADDRESS
                    MOV     @R0,THOU_ASCII
                    CLR     LCD_DIGIT_START_FLAG
                    INC     R0
                    MOV     @R0,HUNDRED_ASCII
                    INC     R0
                    INC     R0
                    MOV     @R0,TEN_ASCII
                    CALL    OUT_RAM_LINE2
                    RET
;
OUT_LOW_CW:         MOV     DPTR,#MSG_101B
                    CALL    LINE_SCAN_RAM_OUT2
                    MOV     R0,LCD_DIGIT_START1_ADDRESS
                    MOV     @R0,THOU_ASCII
                    CLR     LCD_DIGIT_START_FLAG
                    INC     R0
                    MOV     @R0,HUNDRED_ASCII
                    INC     R0
                    INC     R0
                    MOV     @R0,TEN_ASCII
                    CALL    OUT_RAM_LINE2
                    RET
;
STOP_MOTORS:        CLR     EA
                    CLR     EX0     ;DISABLE EXT INT0
                    CLR     EX1     ;DISABLE EXT INT1
                    CLR     IE0
```

```
                CLR     IE1
                CLR     GEN_PEROID_1
                CLR     PEROID_1_FLAG
                CLR     SPEED_OUT_FLAG
                CLR     PEROID_1_LAST_FLAG
                CALL    CLEAR_KEYS
                SETB    EA
                JB      X_DIR_FLAG,STOP_X_CW ;X OUT
                MOV     THOU_ASCII,#30H
                MOV     HUNDRED_ASCII,#30H
                MOV     TEN_ASCII,#30H
                CALL    OUT_X_CCW
                LJMP    STOP_Y_OUT
STOP_X_CW:  MOV     THOU_ASCII,#30H
                MOV     HUNDRED_ASCII,#30H
                MOV     TEN_ASCII,#30H
                CALL    OUT_X_CW
                LJMP    STOP_Y_OUT
;
STOP_Y_OUT: JB      Y_DIR_FLAG,STOP_Y_CW ;Y OUT
                MOV     THOU_ASCII,#30H
                MOV     HUNDRED_ASCII,#30H
                MOV     TEN_ASCII,#30H
                CALL    OUT_LOW_CCW
                LJMP    CONTROL_KEYS
;
STOP_Y_CW:  MOV     THOU_ASCII,#30H
                MOV     HUNDRED_ASCII,#30H
                MOV     TEN_ASCII,#30H
                CALL    OUT_LOW_CW
                LJMP    CONTROL_KEYS
;
REVERSE_A_MOTOR:        CLR     DIR_CHANGE
                        JB      JOG_X,REVERSE_X
                        JB      JOG_Y,REVERSE_Y
                        JB      STOP,NO_REVERSE
                        LJMP    REVERSE_A_MOTOR
NO_REVERSE:             CALL    CLEAR_KEYS
                        LJMP    CONTROL_KEYS
SET_X_DIR_FLAG:     LJMP    X_DIR_LINK
REVERSE_X:          CPL     X_DIR_FLAG
                        JB      X_DIR_FLAG,SET_X_DIR_FLAG
                        MOV     A,#00H
                        MOV     E2_DPL,#E2_X_DIR_FLAG
                        MOV     E2_DPH,#80H
                        CALL    WRITE_E2PROM
                        LJMP    CLEAR_THE_X_KEYS
X_DIR_LINK:         MOV     A,#00H
                        SETB    ACC.0
                        MOV     E2_DPL,#E2_X_DIR_FLAG
                        MOV     E2_DPH,#80H
                        CALL    WRITE_E2PROM
CLEAR_THE_X_KEYS:   CALL    CLEAR_KEYS
                        LJMP    DISP_100A
;
SET_Y_DIR_FLAG:     LJMP    Y_DIR_LINK
REVERSE_Y:          CPL     Y_DIR_FLAG
                        JB      Y_DIR_FLAG,SET_Y_DIR_FLAG
                        MOV     A,#00H
                        MOV     E2_DPL,#E2_Y_DIR_FLAG
                        MOV     E2_DPH,#80H
                        CALL    WRITE_E2PROM
                        LJMP    CLEAR_THE_Y_KEYS
Y_DIR_LINK:         MOV     A,#00H
                        SETB    ACC.0
                        MOV     E2_DPL,#E2_Y_DIR_FLAG
                        MOV     E2_DPH,#80H
                        CALL    WRITE_E2PROM
CLEAR_THE_Y_KEYS:   CALL    CLEAR_KEYS
                        LJMP    DISP_100A
;
;JOG_X_MOTOR:        CLR     JOG_X
```

```
;                        SETB    EX0      ;ENABLE VCO INTERRUPTS AT INT0
TEST_END_X_JOG:         JB      JOG_X,END_X_JOG
WAIT_FOR_JOG_0:          JNB     JOG_FLAG,WAIT_FOR_JOG_0
                         CLR     JOG_FLAG
                         CALL    MOT_0_INTR
                         LJMP    TEST_END_X_JOG
END_X_JOG:              CLR     UP_TOGGLE
                         LJMP    STOP_MOTORS
;
;
JOG_Y_MOTOR:        JB      DOWN_TOGGLE,TEST_END_DOWN_JOG
                         CLR     JOG_Y
                         SETB    DOWN_TOGGLE
;                        SETB    EX1      ;ENABLE VCO INTERRUPS AT INT1
TEST_END_DOWN_JOG:       JB      JOG_Y,END_DOWN_JOG
WAIT_FOR_JOG_1:          JNB     JOG_FLAG,WAIT_FOR_JOG_1
                         CLR     JOG_FLAG
                         CALL    MOT_1_INTR
                         LJMP    TEST_END_DOWN_JOG
END_DOWN_JOG:            CLR     DOWN_TOGGLE
                         LJMP    STOP_MOTORS
;
;
;;*****************************************************
;
;
;       THIS IS THE EPROM MSG LOCATIONS
;
;
;MSG                     '...S1......S2......S3...'
;
MSG_CLR:        DB      '                        '; CLEAR SCREEN
;
MSG_100A:       DB      ' MICRO-TENSIONER   CCW  '
MSG_100B:       DB      ' MICRO-TENSIONER    CW  '
MSG_100C:       DB      'PROGRAM(A) RUN(B) REV(C)'
MSG_101A:       DB      'MICRO-TENSIONER  RUNNING'
MSG_101B:       DB      '@.X LB    CW    STOP(C)'
MSG_101C:       DB      '@.X LB   CCW    STOP(C)'
MSG_102A:       DB      'PROG.  TENSION    @.X LB'
MSG_102B:       DB      'CAL(A)  PROG(B)  EXIT(C)'
MSG_103A:       DB      'ENTER   NEW   TENSION   '
MSG_103B:       DB      '@.X LB  DEL(B)   EXIT(C)'
MSG_104A:       DB      '       CALIBRATE        '
MSG_104B:       DB      'TORQU(A) ROLL(B) EXIT(C)'
MSG_105A:       DB      'REMOVE ROLL FROM SHAFT  '
MSG_105B:       DB      '                 NEXT(C)'
MSG_106A:       DB      'PLACE LOAD ON RIGHT SIDE'
MSG_106B:       DB      'OF SHAFT  (CW)   NEXT(C)'
MSG_107A:       DB      'PLACE LOAD ON LEFT SIDE '
MSG_107B:       DB      'OF SHAFT (CCW)   NEXT(C)'
MSG_108A:       DB      'ENTER  TORQUE  OF  LOAD '
MSG_108B:       DB      '@.X FTLBS DEL(B) NEXT(C)'
MSG_115A:       DB      'TORQUE CALIBRATION IS   '
MSG_115B:       DB      'COMPLETED        EXIT(C)'
MSG_109A:       DB      'PLACE  SMALL  ROLL      '
MSG_109B:       DB      'ON  SHAFT        NEXT(C)'
MSG_110A:       DB      'ENTER RAD. OF SMALL ROLL'
MSG_110B:       DB      '@X.X IN. DEL(B)  NEXT(C)'
MSG_111A:       DB      'PLACE  LARGE  ROLL      '
MSG_111B:       DB      'ON SHAFT         NEXT(C)'
MSG_112A:       DB      'ENTER RAD. OF LARGE ROLL'
MSG_112B:       DB      '@X.X IN. DEL(B)  NEXT(C)'
MSG_113A:       DB      'ROLL SIZE CALIBRATION   '
MSG_113B:       DB      'COMPLETED        EXIT(C)'
;
;
MSG_114A:       DB      '       XRAM_ERROR       '
MSG_114B:       DB      '  [                     '
;
;                ORG     1FB0H
                DB      10H     ;0
```

```
                DB      11H     ;1
                DB      12H     ;2
                DB      13H     ;3
                DB      14H     ;4
                DB      15H     ;5
                DB      16H     ;6
                DB      17H     ;7
                DB      18H     ;8
                DB      19H     ;9
;                ORG     1FAAH
                DB      1EH     ;*
;                ORG     1FA3H
                DB      1FH     ;#
;                ORG     1FD0H
                DB      80H     ;P
;
;                ORG     1F78H
                DB      00H
                DB      20H
                DB      40H
                DB      60H
                DB      80H
                DB      0A0H
                DB      0C0H
;
FCOT:           RET
END
```

I claim:

1. A control system for maintaining a substantially constant predetermined tension on material being unwound from or wound onto a roll of material, the system comprising a frame, a shaft for holding the roll of material, a motor coupled to the shaft for rotating the shaft at a predetermined speed to maintain the material at a substantially constant predetermined tension, means for rotatably coupling the shaft and the motor to the frame to position the motor in an initial preset position relative to the frame, the coupling means permitting limited rotational movement of the motor relative to the frame in response to the tension on the material deviating from the predetermined tension, means for generating an output signal indicative of rotational displacement of the motor relative to the frame away from to its initial preset position, and means for adjusting the speed at which the motor rotates the shaft by an amount based upon the output signal to maintain the tension of the material at substantially the predetermined tension, the adjusting means being coupled between the generating means and the motor.

2. The system of claim 1, wherein the coupling means includes bearing means for permitting rotation of the shaft relative to the frame and movement resisting means coupled to the motor for resisting movement of the motor relative to the frame, the movement resisting means having a predetermined resistance related to the predetermined tension so that the motor moves relative to the frame only when the tension on the material exceeds the predetermined tension.

3. The system of claim 2, wherein the movement resisting means includes at least one spring member having a predetermined spring constant coupled between the frame and the motor.

4. The system of claim 2, further comprising means for damping movement of the motor relative to the frame to limit the rate of movement of the motor.

5. The system of claim 4, wherein the damping means includes a piston and cylinder assembly coupled between the motor and the frame for limiting the rate of movement of the motor relative to the frame.

6. The system of claim 1, wherein the generating means includes a differential transformer coupled to the motor, the differential transformer having an output coupled to the adjusting means.

7. The apparatus of claim 1, further comprising means for measuring the radius of the roll of material, and means for coupling the measuring means to the adjusting means so that the speed at which the motor rotates the shaft is also adjusted based upon the radius of the roll of material.

8. The system of claim 7, wherein the measuring means includes an ultrasonic sensor for measuring the radius of the roll of material, the ultrasonic sensor having an output coupled to the adjusting means.

9. A control system for maintaining a substantially constant predetermined tension on a material being unwound from or wound onto a roll of material, the system comprising a frame, a shaft for holding the roll of material, a motor coupled to the shaft for rotating the shaft, means for rotatably coupling the shaft and the motor to the frame to position the motor in an initial preset position relative to the frame, the coupling means permitting limited rotational movement of the motor relative to the frame in response to the tension on the material deviating from the predetermined tension, drive means for generating a control signal to drive the motor, the motor rotating the shaft at a predetermined speed to maintain the material at substantially the predetermined tension, means for detecting rotational displacement of the motor relative to the frame away from its preset position, and processing means coupled between the detecting means and the drive means for altering the control signal to change the speed of rotation of the shaft in response to rotational movement of the motor relative to the frame indicating a change in tension of the material to maintain the tension of the material at substantially the predetermined tension.

10. The system of claim 9, wherein the coupling means includes bearing means for permitting rotation of the shaft relative to the frame and movement resisting means coupled to the motor for resisting movement of the motor relative to the frame, the movement resisting means having a predetermined resistance related to the predetermined tension so that the motor moves relative to the frame only when the tension on the material exceeds the predetermined tension, the resisting means returning the motor to its initial preset position when the tension of the material returns to the predetermined tension.

11. The system of claim 10, wherein the movement resisting means includes at least one spring member having a predetermined spring constant coupled between the frame and the motor.

12. The system of claim 10, further comprising means for damping movement of the motor relative to the frame to limit the rate of movement to the motor.

13. The system of claim 12, wherein the damping means includes a piston and cylinder assembly coupled between the motor and the frame for limiting the rate of movement of the motor relative to the frame.

14. The system of claim 9, wherein the means for detecting displacement of the motor includes a differential transformer having an output coupled to the processing means.

15. The system of claim 9, further comprising means for measuring the radius of the roll of material, and means for coupling an output of the measuring means to the processing means so that the control signal is altered to change the speed of rotation of the shaft based upon the radius of the roll of material.

16. The system of claim 15, wherein the measuring means includes an ultrasonic sensor for measuring the radius of the roll material, the ultrasonic sensor including an output coupled to an input of the processing means.

17. The system of claim 9, wherein the motor is a stepper motor.

18. The system of claim 17, wherein the control signal for driving the motor is a sinusoidal signal for providing smooth movement of the stepper motor.

19. A control system for maintaining a substantially constant predetermined tension on a material being unwound from or wound onto a roll of material, the system comprising a frame, a shaft for holding the roll of material, a motor coupled to the shaft for rotating the shaft, bearing means for coupling the shaft to the frame to permit rotational movement of the shaft and the motor relative to the frame, drive means for generating a control signal to drive the motor, the motor rotating the shaft at a predetermined speed to maintain the material at substantially the predetermined tension, a mounting plate rigidly coupled to the motor, a damper coupled between the frame and the mounting plate for limiting the rate of movement of the motor relative to the frame, spring means coupled between the frame and the mounting plate for resisting movement of the motor relative to the frame, the spring means being configured to retain the motor in its initial preset position when the tension on the material is at the predetermined tension, the spring means having a predetermined resistance related to the predetermined tension so that the motor rotates relative to the frame only when the tension of the material deviates from the predetermined tension, a displacement detector coupled between the frame and the mounting plate for detecting rotational displacement of the motor relative to the frame away from its initial preset position, the displacement detector including output means for generating a signal indicative of the rotational displacement of the motor, and processing means including an input coupled to the output means of the displacement detector and an output coupled to the drive means for altering the control signal to change the speed of rotation of the shaft in response to rotational movement of the motor relative to the frame indicating a change in the tension of the material to maintain the tension of the material at substantially the predetermined tension.

20. The system of claim 19, further comprising an ultrasonic sensor coupled to the frame for detecting the radius of the roll of material, the ultrasonic sensor including an output coupled to a second input of the processing means, the processing means also altering the control signal to change the speed of rotation of the shaft based upon the radius of the roll of material.

21. In an apparatus for winding and unwinding material from a roll of material including a shaft for holding the roll of material and a motor coupled to and rotating the shaft, a control system for maintaining a substantially constant predetermined tension on the material comprising means for mounting the shaft and the motor to permit limited rotational movement of the motor away from an initial position at which the material is at a substantially constant predetermined tension upon deviation of the tension on the material away from the predetermined tension, means for generating an output signal indicative of rotational displacement of the motor away from its initial position in response to a deviation of the tension on the material away from the predetermined tension, and means for adjusting the speed at which the motor rotates the shaft in response to the output signal to return the motor to the initial position at which the tension of the material returns to the substantially constant predetermined tension.

22. The system of claim 21, wherein the generating means includes a differential transformer coupled to the motor, the differential transformer having an output coupled to the adjusting means.

23. The system of claim 21, further comprising means for measuring a radius of the roll of material, and means for coupling the measuring means to the adjusting means so that the speed at which the motor rotates the shaft is also adjusted based upon the radius of the roll of material.

24. The system of claim 23, wherein the measuring means includes an ultrasonic sensor for measuring the radius of the roll of material, the ultrasonic sensor having an output coupled to the adjusting means.

25. A method for maintaining a substantially constant predetermined tension on material being unwound from or wound onto a roll of material mounted on a shaft which is coupled to and driven by a motor, the method comprising the steps of establishing a predetermined initial position of the motor when the material is at the predetermined tension, generating an output signal indicative of rotational displacement of the motor away from its initial position upon deviation of the tension on the material away from the predetermined tension, and adjusting the speed at which the motor rotates the shaft by an amount based upon the output signal to maintain the tension on the material at substantially the predetermined tension.

26. The method of claim 25, further comprising the steps of determining a radius of the roll of material, and changing the speed of rotation of the shaft based upon the radius of the roll of material to maintain the tension on the material at substantially the predetermined tension.

* * * * *